US009956792B2

(12) United States Patent
Yoshida

(10) Patent No.: US 9,956,792 B2
(45) **Date of Patent: *May 1, 2018**

(54) PRINTER AND COMPUTER-READABLE STORAGE MEDIUM FOR EXECUTING MULTI-PASS PRINTING

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/493,435

(22) Filed: Apr. 21, 2017

(65) Prior Publication Data

US 2017/0217232 A1 Aug. 3, 2017

Related U.S. Application Data

(62) Division of application No. 15/045,450, filed on Feb. 17, 2016, now Pat. No. 9,630,422.

(30) Foreign Application Priority Data

Feb. 20, 2015 (JP) ..... 2015-031594

(51) Int. Cl.
*B41J 2/21* (2006.01)
*B41J 11/00* (2006.01)
(Continued)

(52) U.S. Cl.
CPC ..... *B41J 11/008* (2013.01); *B41J 2/2132* (2013.01); *B41J 2/5056* (2013.01); *B41J 13/0009* (2013.01)

(58) Field of Classification Search
CPC .... B41J 11/008; B41J 13/0009; B41J 2/2132; B41J 2/5056
See application file for complete search history.

(56) References Cited

U.S. PATENT DOCUMENTS 5,847,721 A 12/1998 Ogata et al.
9,630,422 B2 * 4/2017 Yoshida ..... B41J 2/5056
(Continued)

FOREIGN PATENT DOCUMENTS

JP 8-244253 A 9/1996
JP 2006-76029 A 3/2006
(Continued)

OTHER PUBLICATIONS

Related U.S. Appl. No. 15/045,706, filed Feb. 17, 2016.
(Continued)

*Primary Examiner* — Yaovi M Ameh
(74) *Attorney, Agent, or Firm* — Merchant & Gould P.C.

(57) ABSTRACT

A printer performs a multi-pass printing including: (a) pass process executed with Ka number of nozzles; (c1) pass process executed with Kc1 number of nozzles; (c2) pass process executed with Kc2 number of nozzles; and (b) pass process executed with Kb number of nozzles. Kc1 and Kc2 are greater than or equal to Kb and smaller than Ka. An upstream gradient of dot recording rates of (c1) pass process is greater than a gradient of (a) pass process. A downstream gradient of (c1) pass process is the same as the gradient of (a) pass process. An upstream gradient of (c2)-pass process is the same as a gradient of (b) pass process. A downstream gradient of (c2)-pass process is greater than the gradient of the (a) pass process. Kc1 is greater than Kc2.

12 Claims, 27 Drawing Sheets

(51) Int. Cl.

| | |
|---|---|
| ***B41J 2/505*** | (2006.01) |
| *B41J 13/00* | (2006.01) |

(56) References Cited

U.S. PATENT DOCUMENTS

| | | | |
|---|---|---|---|
| 2006/0044333 | A1 | 3/2006 | Nishikori et al. |
| 2007/0057996 | A1 | 3/2007 | Yazawa et al. |
| 2014/0085371 | A1 | 3/2014 | Ebisawa |
| 2014/0292867 | A1 | 10/2014 | Takata |
| 2015/0035891 | A1 | 2/2015 | Yoshida et al. |
| 2016/0243821 | A1 | 8/2016 | Yoshida |
| 2016/0243822 | A1 | 8/2016 | Yoshida |
| 2016/0243862 | A1 | 8/2016 | Yoshida |

FOREIGN PATENT DOCUMENTS

| | | | |
|---|---|---|---|
| JP | 2006-96031 | A | 4/2006 |
| JP | 2007-185941 | A | 7/2007 |
| JP | 2015-030149 | A | 2/2015 |

OTHER PUBLICATIONS

Related U.S. Appl. No. 15/045,604, filed Feb. 17, 2016.
Office Action (Notice of Allowance) issued in related U.S. Appl. No. 15/045,604 dated Feb. 8, 2017.

* cited by examiner

FIG. 8A

DOT PATTERN DATA

DPDa

MAIN SCANNING DIRECTION

CONVEYING DIRECTION

| | | | | | | | |
|---|---|---|---|---|---|---|---|
| N1 | 0 | 0 | 1 | 0 | 0 | 0 | 1 |
| N2 | 1 | 0 | 0 | 1 | 0 | 0 | 0 |
| N3 | 0 | 1 | 0 | 0 | 0 | 1 | 0 |
| N4 | 1 | 0 | 0 | 1 | 0 | 0 | 0 |
| N5 | 0 | 1 | 0 | 0 | 1 | 0 | 1 |

FIG. 8B

PARTIAL DOT DATA

PDo

MAIN SCANNING DIRECTION

CONVEYING DIRECTION

| | | | | | | | |
|---|---|---|---|---|---|---|---|
| N1 | 0 | 1 | 1 | 1 | 1 | 0 | 0 |
| N2 | 1 | 0 | 1 | 1 | 1 | 1 | 0 |
| N3 | 0 | 1 | 1 | 1 | 1 | 0 | 0 |
| N4 | 1 | 0 | 1 | 1 | 1 | 0 | 0 |
| N5 | 0 | 1 | 1 | 0 | 1 | 1 | 0 |

FIG. 8C

PASS DATA

PD

MAIN SCANNING DIRECTION

CONVEYING DIRECTION

| | | | | | | | |
|---|---|---|---|---|---|---|---|
| N1 | 0 | 0 | 1 | 0 | 0 | 0 | 0 |
| N2 | 1 | 0 | 0 | 1 | 0 | 0 | 0 |
| N3 | 0 | 1 | 0 | 0 | 0 | 0 | 0 |
| N4 | 1 | 0 | 0 | 1 | 0 | 0 | 0 |
| N5 | 0 | 1 | 0 | 0 | 1 | 0 | 0 |

FIRST EMBODIMENT

4-PASS PRINTING, NORMAL CONTROL,
BORDERLESS, DOWNSTREAM EDGE → MIDDLE SECTION

FIG. 12

FIRST EMBODIMENT
4-PASS PRINTING, NORMAL CONTROL,
BORDERLESS, DOWNSTREAM EDGE → MIDDLE SECTION (A) GRADED RECORDING RATE DR (1)~DR (6)

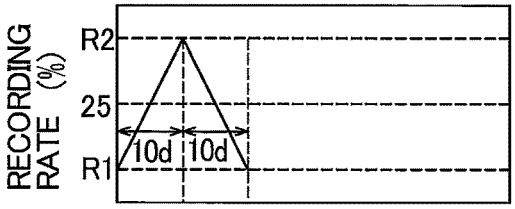

DOWNSTREAM ← NOZZLE POSITION → UPSTREAM (B) GRADED RECORDING RATE DR (7)

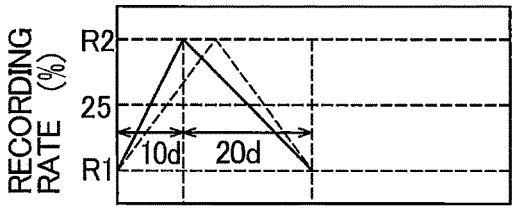

DOWNSTREAM ← NOZZLE POSITION → UPSTREAM (C) GRADED RECORDING RATE DR (8)

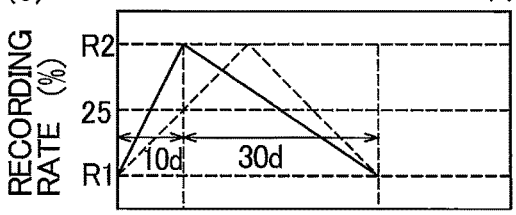

DOWNSTREAM ← NOZZLE POSITION → UPSTREAM (D) GRADED RECORDING RATE DR (9)

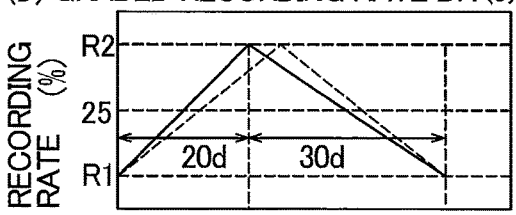

DOWNSTREAM ← NOZZLE POSITION → UPSTREAM (E) GRADED RECORDING RATE DR (10)~DR (14)

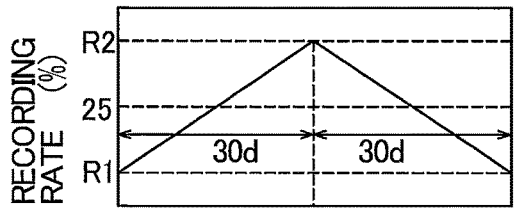

DOWNSTREAM ← NOZZLE POSITION → UPSTREAM

FIRST EMBODIMENT

4-PASS PRINTING, NORMAL CONTROL,
BORDERLESS, MIDDLE SECTION → UPSTREAM EDGE, ONLY DOWNSTREAM INK RECEIVER

FIRST EMBODIMENT

4-PASS PRINTING, NORMAL CONTROL,
BORDERLESS, MIDDLE SECTION → UPSTREAM EDGE, ONLY DOWNSTREAM INK RECEIVER

FIG. 15

FIRST EMBODIMENT

4-PASS PRINTING, NORMAL CONTROL,
BORDERLESS, MIDDLE SECTION → UPSTREAM EDGE, ONLY DOWNSTREAM INK RECEIVER (A) GRADED RECORDING RATE DR (16)~DR (17)

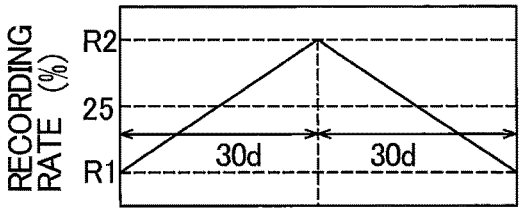

DOWNSTREAM ← NOZZLE POSITION → UPSTREAM (B) GRADED RECORDING RATE DR (18)

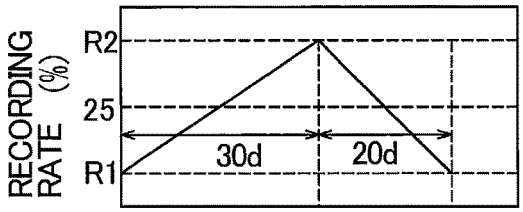

DOWNSTREAM ← NOZZLE POSITION → UPSTREAM (C) GRADED RECORDING RATE DR (19)

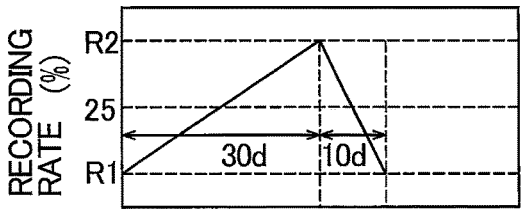

DOWNSTREAM ← NOZZLE POSITION → UPSTREAM (D) GRADED RECORDING RATE DR (20)

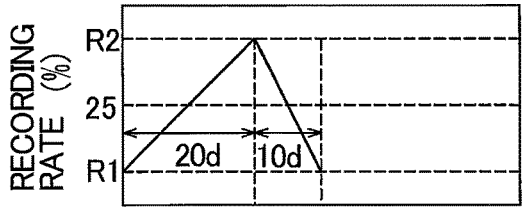

DOWNSTREAM ← NOZZLE POSITION → UPSTREAM (E) GRADED RECORDING RATE DR (21)~DR (26)

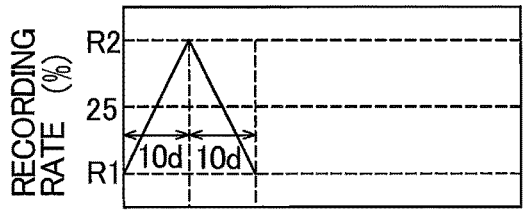

DOWNSTREAM ← NOZZLE POSITION → UPSTREAM

FIRST EMBODIMENT
4-PASS PRINTING, SPECIAL CONTROL,
BORDERLESS, MIDDLE SECTION → UPSTREAM EDGE

FIRST EMBODIMENT

4-PASS PRINTING, SPECIAL CONTROL,
BORDERLESS, MIDDLE SECTION → UPSTREAM EDGE

SECOND EMBODIMENT

4-PASS PRINTING, NORMAL CONTROL,
BORDERLESS, MIDDLE SECTION → UPSTREAM EDGE, INK RECEIVERS ON BOTH SIDES

FIG. 21

SECOND EMBODIMENT

4-PASS PRINTING, NORMAL CONTROL,
BORDERLESS, MIDDLE SECTION → UPSTREAM EDGE, INK RECEIVERS ON BOTH SIDES (A) GRADED RECORDING RATE DR (16)~DR (17)

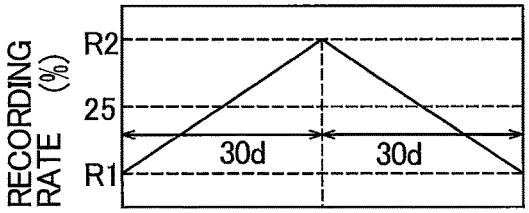

DOWNSTREAM ← NOZZLE POSITION → UPSTREAM (B) GRADED RECORDING RATE DR (18)

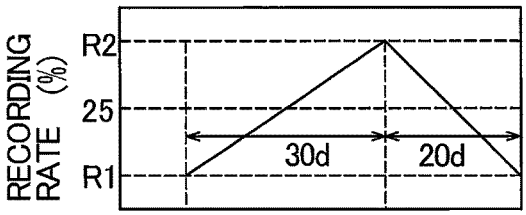

DOWNSTREAM ← NOZZLE POSITION → UPSTREAM (C) GRADED RECORDING RATE DR (19)

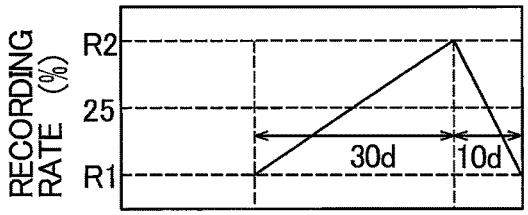

DOWNSTREAM ← NOZZLE POSITION → UPSTREAM (D) GRADED RECORDING RATE DR (20)

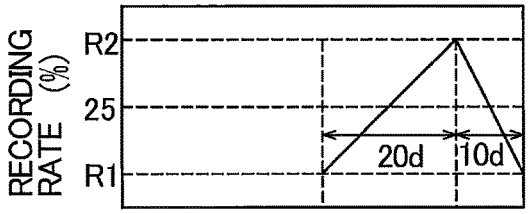

DOWNSTREAM ← NOZZLE POSITION → UPSTREAM (E) GRADED RECORDING RATE DR (21)~DR (26)

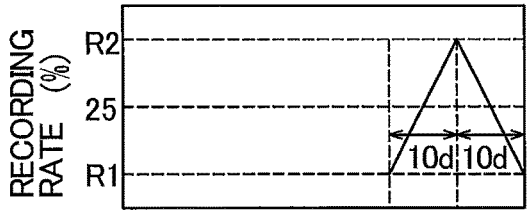

DOWNSTREAM ← NOZZLE POSITION → UPSTREAM

FIG. 22 THIRD EMBODIMENT
3-PASS PRINTING, NORMAL CONTROL, BORDERLESS, DOWNSTREAM EDGE → MIDDLE SECTION
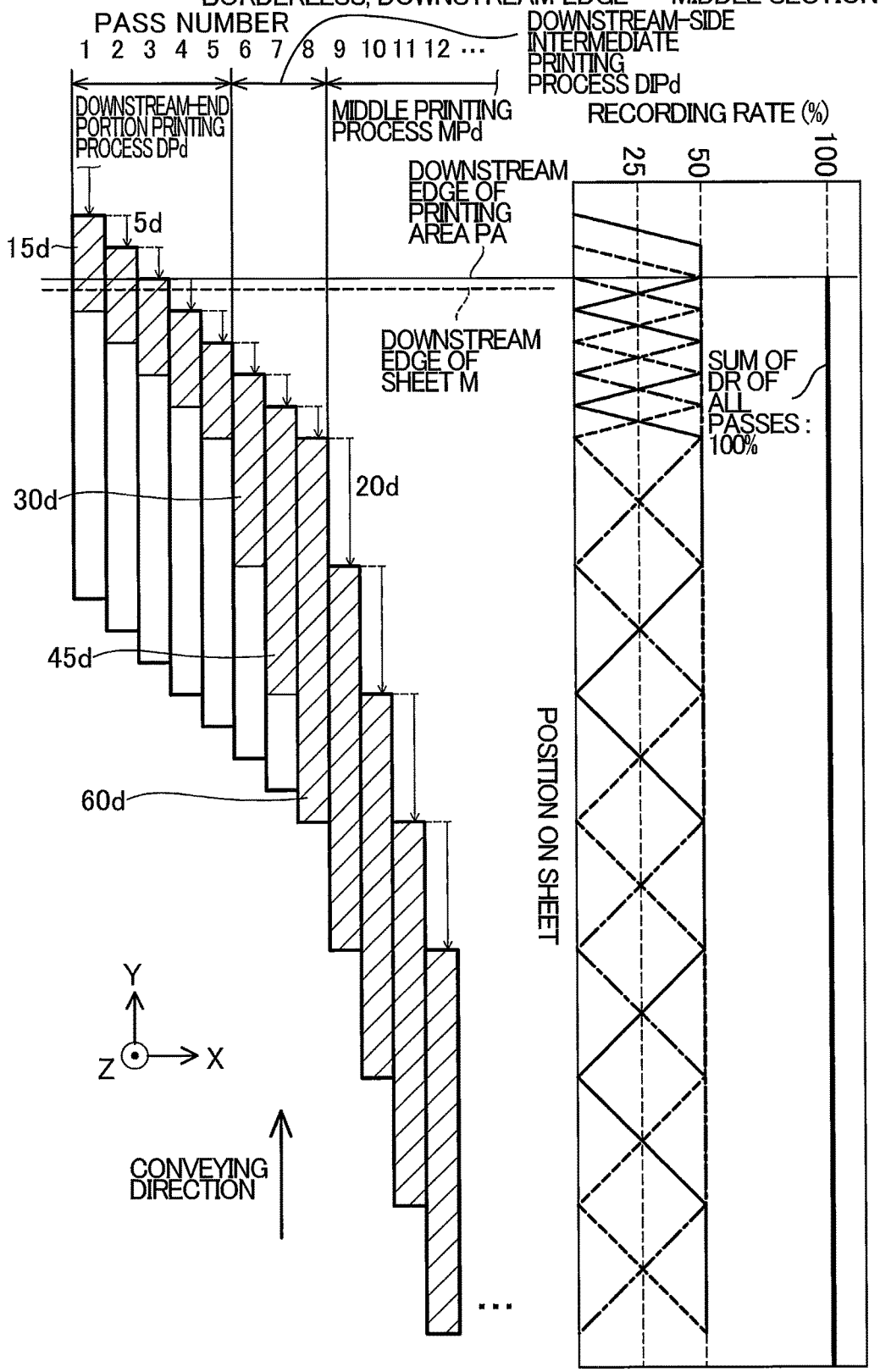

FIG. 23
THIRD EMBODIMENT
3-PASS PRINTING, NORMAL CONTROL,
BORDERLESS, DOWNSTREAM EDGE → MIDDLE SECTION
(A) GRADED RECORDING RATE DR (1)~DR (5)
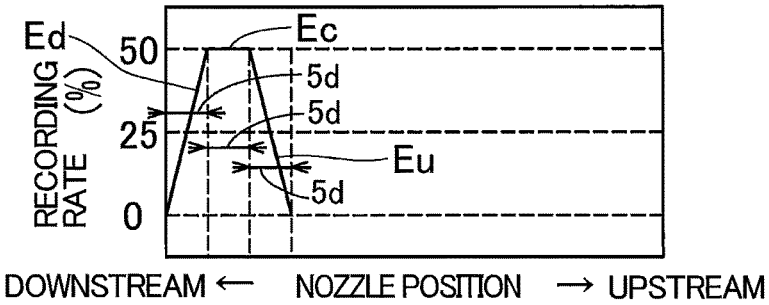
(B) GRADED RECORDING RATE DR (6)
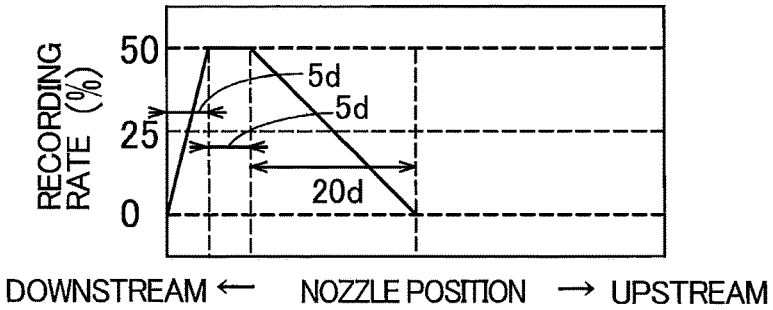
(C) GRADED RECORDING RATE DR (7)
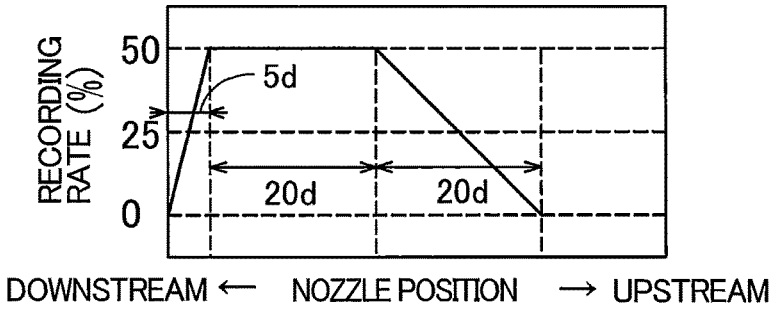
(D) GRADED RECORDING RATE DR (8)~DR (12)
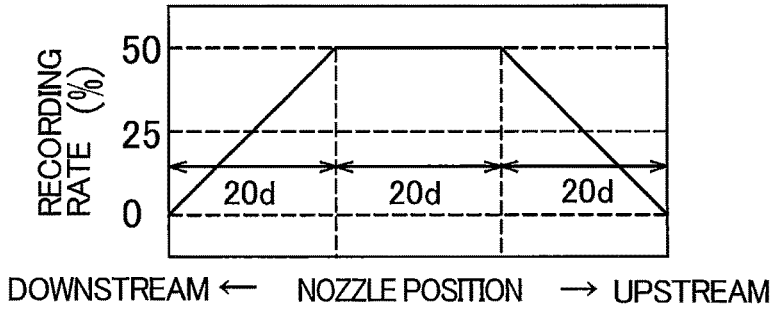

FIG. 24 THIRD EMBODIMENT
3-PASS PRINTING, NORMAL CONTROL, BORDERLESS, MIDDLE SECTION → UPSTREAM EDGE
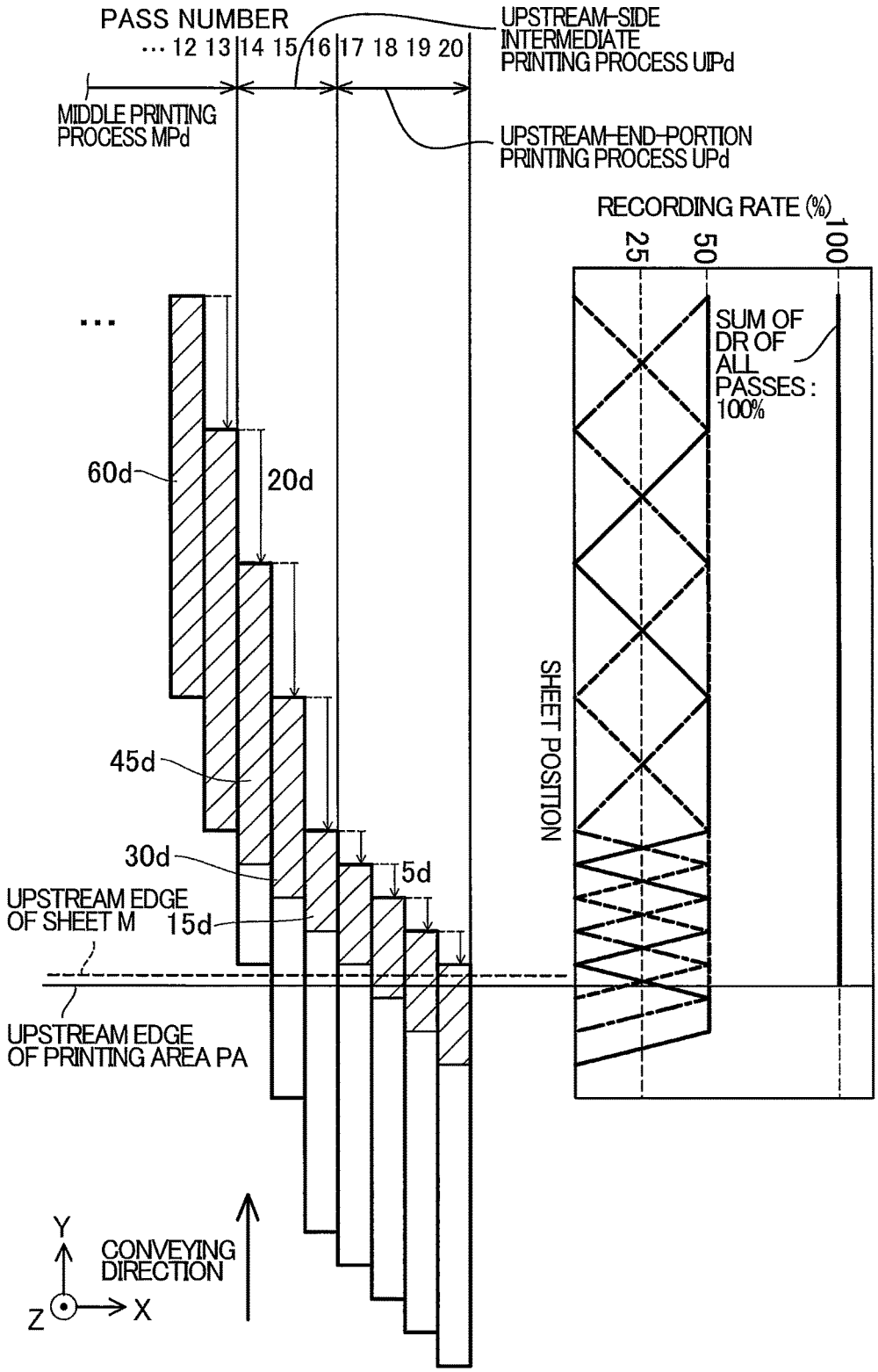

FIG. 25 THIRD EMBODIMENT
3-PASS PRINTING, NORMAL CONTROL,
BORDERLESS, MIDDLE SECTION → UPSTREAM EDGE
(A) GRADED RECORDING RATE DR (12), DR (13)
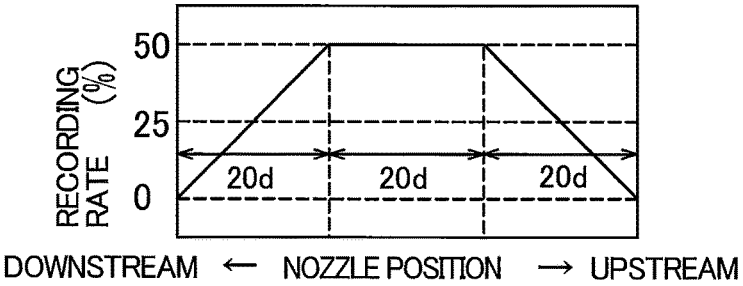
(B) GRADED RECORDING RATE DR (14)
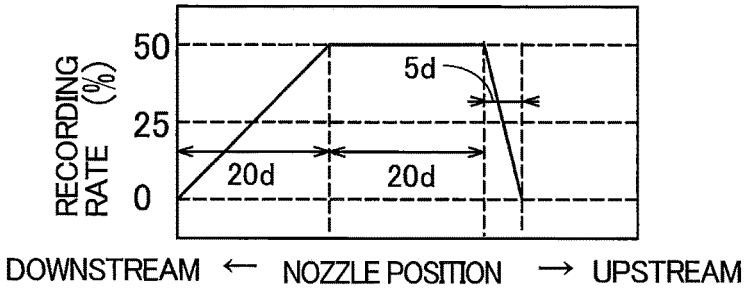
(C) GRADED RECORDING RATE DR (15)
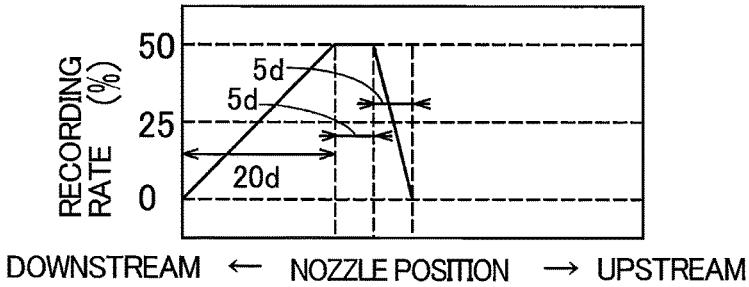
(D) GRADED RECORDING RATE DR (16)~DR (20)
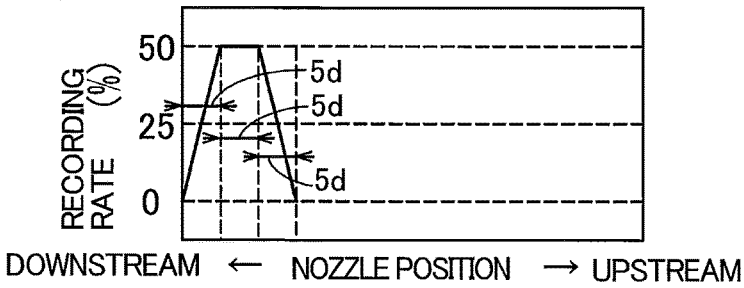

FIG. 26

VARIATION

4-PASS PRINTING, NORMAL CONTROL,
BORDERLESS, MIDDLE SECTION → UPSTREAM EDGE, INK RECEIVERS ON BOTH SIDES (A) GRADED RECORDING RATE DR (16)~DR (17)

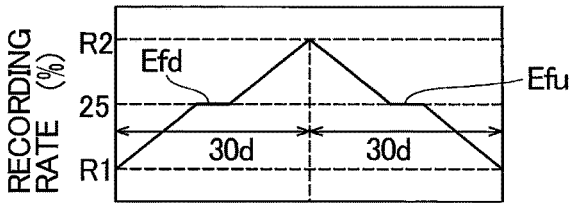

DOWNSTREAM ← NOZZLE POSITION → UPSTREAM (B) GRADED RECORDING RATE DR (18)

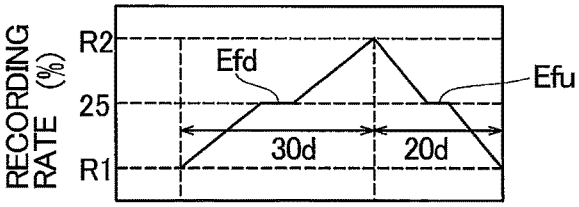

DOWNSTREAM ← NOZZLE POSITION → UPSTREAM (C) GRADED RECORDING RATE DR (19)

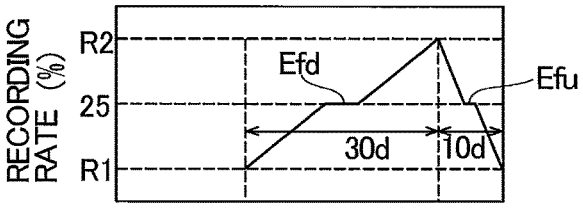

DOWNSTREAM ← NOZZLE POSITION → UPSTREAM (D) GRADED RECORDING RATE DR (20)

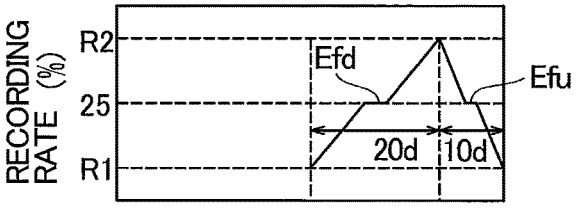

DOWNSTREAM ← NOZZLE POSITION → UPSTREAM (E) GRADED RECORDING RATE DR (21)~DR (26)

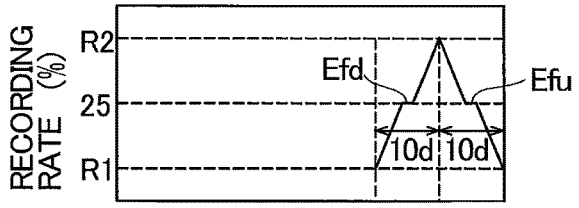

DOWNSTREAM ← NOZZLE POSITION → UPSTREAM

PRINTER AND COMPUTER-READABLE STORAGE MEDIUM FOR EXECUTING MULTI-PASS PRINTING

CROSS REFERENCE TO RELATED APPLICATION

This application is a divisional of U.S. patent application Ser. No. 15/045,450, filed Feb. 17, 2016, and further claims priority from Japanese Patent Application No. 2015-031594 filed Feb. 20, 2015. The entire contents of both of which are incorporated herein by reference. The present application is closely related to a co-pending U.S. Patent Application corresponding to Japanese Patent Application No. 2015-031599 filed Feb. 20, 2015 and a co-pending U.S. Patent Application corresponding to Japanese Patent application No. 2015-031609 filed Feb. 20, 2015.

TECHNICAL FIELD

The present disclosure relates to a printer, a print control apparatus, and a method for controlling a print executing unit to execute a printing operation. The print executing unit includes a conveying mechanism that conveys sheets of paper in a conveying direction, and a print head having a plurality of nozzles arranged in the conveying direction.

BACKGROUND

A printer known in the art has a conveying mechanism for conveying sheets of paper and performs a printing operation by ejecting ink from a plurality of nozzles onto the sheet conveyed by the conveying mechanism. However, this type of printer is susceptible to a problem in the printed image called banding that is caused by irregularities in the amounts at which the sheets are conveyed.

A conventional technique modifies the dot recording rate for each nozzle used in printing on the basis of the position of the nozzle in the conveying direction. In this technique, the device maximizes the recording rate for nozzles whose position in the conveying direction is near the center of the nozzle rows and reduces the recording rate for nozzles to a larger degree the closer they are positioned near the ends of the nozzle rows. Further, fewer nozzles are utilized for printing edge regions of sheets than for printing middle regions of sheets. In this way, the conventional printer suppresses the occurrence of banding in the printed image.

SUMMARY

However, this conventional technique does not go far enough in considering the best way to perform printing when transitioning between the printing of end regions of the sheet in which fewer nozzles are used and the printing of the middle region of the sheet in which more nozzles are used. Consequently, this technique may still produce irregular printing densities in regions printed during these transitions.

In view of the foregoing, it is an object of the disclosure to provide a technique capable of suppressing banding that occurs due to irregularities in the amounts that a sheet is conveyed, while no producing irregularities in printing density.

In order to attain the above and other objects, the disclosure provides a printer including a print executing unit and a controller. The print executing unit includes a conveying mechanism, a print head, and a main scanning mechanism.

The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The controller is configured to control the print executing unit to perform a multi-pass printing for printing a target image on the sheet with a plurality of pass processes. The plurality of pass processes forms a plurality of partial images respectively. Two partial images formed with successive two pass processes overlap partially. K-number of active nozzles consecutively arranged are selected from the plurality of nozzles for each of the plurality of pass processes. Dot recording rates of the K-number of active nozzles decrease at an upstream gradient from a nozzle having a maximum dot recording rate among the dot recording rates of the K-number of active nozzles toward a most-upstream nozzle of the K-number of active nozzles in the conveying direction. The dot recording rates of the K-number of active nozzles decrease at a downstream gradient from a nozzle having the maximum dot recording rate toward a most-downstream nozzle of the K-number of active nozzles in the conveying direction. The controller is further configured to control the print executing unit to perform: executing an (a)-print process in which the conveying mechanism conveys the sheet and a pass process is executed with Ka number of active nozzles, the upstream gradient of the dot recording rates of the Ka number of active nozzles used in the (a)-print process being the same as the downstream gradient of the dot recording rates of the Ka number of active nozzles used in the (a)-print process; executing, after the (a)-print process is executed, a (b)-print process in which the conveying mechanism conveys the sheet and a pass process is executed with Kb number of active nozzles, Kb being smaller than Ka, the upstream gradient of the dot recording rates of the Kb number of active nozzles used in the (b)-print process being the same as the downstream gradient of the dot recording rates of the Kb number of active nozzles used in the (b)-print process; and executing, after the (a)-print process is executed and before the (b)-print process is executed, a (c)-print process in which the conveying mechanism conveys the sheet and at least two pass processes are executed with Kc number of active nozzles, Kc being greater than or equal to Kb and smaller than Ka. The at least two pass processes includes: a (c1)-pass process with Kc1 number of active nozzles as the Kc number of active nozzles, the upstream gradient of the dot recording rates of the Kc1 number of active nozzles used in the (c1)-pass process being greater than at least one of the upstream gradient and the downstream gradient of the dot recording rates of the Ka number of active nozzles used in the (a)-print process, the downstream gradient of the dot recording rates of the Kc1 number of active nozzles used in the (c1)-pass process being the same as at least one of the upstream gradient and the downstream gradient of the dot recording rates of the Ka number of active nozzles used in the (a)-print process; and a (c2)-pass process with Kc2 number of active nozzles as the Kc number of active nozzles, the (c2)-pass process being executed after the (c1)-pass process, the upstream gradient of the dot recording rates of the Kc2 number of active nozzles used in the (c2)-pass process being the same as at least one of the upstream gradient and the downstream gradient of the dot recording rates of the Kb number of active nozzles used in the (b)-print process, the downstream gradient of the dot recording rates of the Kc2 number of active nozzles used in the (c2)-pass process being greater than at least one of the upstream gradient and the downstream gradient of the dot recording rates of the Ka number of active nozzles used in the (a)-print process. Kc1 is greater than Kc2. The meaning of "gradient" may encompass not only the magnitude of slope of a linear segment between dot recording rates of two active nozzles (the most-upstream/most-downstream nozzles and a nozzle having the maximum dot recording rate), but also the magnitude of slope of a curve defined by a plurality of dot recording rates of a plurality of active nozzles including the most-upstream/most-downstream nozzles and a nozzle having the maximum dot recording rate. K denotes the number of active nozzles selected from the plurality of nozzles and is an integer greater than or equal to 2. Similarly, Ka, Kb, Kc, Kc1, Kc2, Kd, Ke, Ke1, Ke2, and Kc3 denote the number of active nozzles used in respective processes.

According to another aspect, the present disclosure provides a printer including a print executing unit and a controller. The print executing unit includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The controller is configured to control the print executing unit to perform a multi-pass printing for printing a target image on the sheet with a plurality of pass processes. The plurality of pass processes forms a plurality of partial images, respectively. Two partial images formed with successive two pass processes overlap partially. K-number of active nozzles consecutively arranged are selected from the plurality of nozzles for each of the plurality of pass processes. Dot recording rates of the K-number of active nozzles decrease at an upstream gradient from a nozzle having a maximum dot recording rate among the dot recording rates of the K-number of active nozzles toward a most-upstream nozzle of the K-number of active nozzles in the conveying direction. The dot recording rates of the K-number of active nozzles decrease at a downstream gradient from a nozzle having the maximum dot recording rate toward a most-downstream nozzle of the K-number of active nozzles in the conveying direction. The controller is further configured to control the print executing unit to perform: executing an (A)-print process in which the conveying mechanism conveys the sheet and a pass process is executed with KA number of active nozzles, the upstream gradient of the dot recording rates of the KA number of active nozzles used in the (A)-print process being the same as the downstream gradient of the dot recording rates of the KA number of active nozzles used in the (A)-print process; executing, before the (A)-print process is executed, a (B)-print process in which the conveying mechanism conveys the sheet and a pass process is executed with KB number of active nozzles, KB being smaller than KA, the upstream gradient of the dot recording rates of the KB number of active nozzles used in the (B)-print process being the same as the downstream gradient of the dot recording rates of the KB number of active nozzles used in the (B)-print process; and executing, after the (B)-print process is executed before the (A)-print process is executed, a (C)-print process in which the conveying mechanism conveys the sheet and at least two pass processes are executed with KC number of active nozzles, KC being greater than or equal to KB and smaller than KA. The (C)-print process includes: a (C1)-pass process with KC1 number of active nozzles as the KC number of active nozzles, the upstream gradient of the dot recording rates of the KC1 number of active nozzles used in the (C1)-pass process being smaller than at least one of the upstream gradient and the downstream gradient of the dot recording rates of the KB number of active nozzles used in the (B)-print process, the downstream gradient of the dot recording rates of the KC1 number of active nozzles used in the (C1)-pass process being the same as at least one of the upstream gradient and the downstream gradient of the dot recording rates of the KB number of active nozzles used in the (B)-print process; and a (C2)-pass process with KC2 number of active nozzles as the KC number of active nozzles, the (C2)-pass process being executed after the (C1) pass process, the upstream gradient of the dot recording rates of the KC2 number of active nozzles used in the (C2)-pass process being the same as one of the upstream gradient and the downstream gradient of the dot recording rates of the KA number of active nozzles used in the (A)-print process, the downstream gradient of the dot recording rates of the KC2 number of active nozzles used in the (C2)-pass process being smaller than at least one of the upstream gradient and the downstream gradient of the dot recording rates of the KB number of active nozzles used in the (B)-print process. KC1 is smaller than KC2.

According to still another aspect, the present disclosure provides a non-transitory computer readable storage medium storing a set of program instructions executable by a processor. The program instructions, when executed by the processor, cause the processor to control a print executing apparatus to perform a multi-pass printing. The print executing apparatus includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The processor is configured to control the print executing apparatus to perform the multi-pass printing for printing a target image on the sheet with a plurality of pass processes. The plurality of pass processes forms a plurality of partial images respectively. Two partial images formed with successive two pass processes overlap partially. K-number of active nozzles consecutively arranged are selected from the plurality of nozzles for each of the plurality of pass processes. Dot recording rates of the K-number of active nozzles decrease at an upstream gradient from a nozzle having a maximum dot recording rate among the dot recording rates of the K-number of active nozzles toward a most-upstream nozzle of the K-number of active nozzles in the conveying direction. The dot recording rates of the K-number of active nozzles decrease at a downstream gradient from a nozzle having the maximum dot recording rate toward a most-downstream nozzle of the K-number of active nozzles in the conveying direction. The program instructions further include controlling the print executing apparatus to perform: executing an (a)-print process in which the conveying mechanism conveys the sheet and a pass process is executed with Ka number of active nozzles, the upstream gradient of the dot recording rates of the Ka number of active nozzles used in the (a)-print process being the same as the downstream gradient of the dot recording rates of the Ka number of active nozzles used in the (a)-print process; executing, after the (a)-print process is executed, a (b)-print process in which the conveying mechanism conveys the sheet and a pass process is executed with Kb number of active nozzles, Kb being smaller than Ka, the upstream gradient of the dot recording rates of the Kb number of active nozzles used in the (b)-print process being the same as the downstream gradient of the dot recording rates of the Kb number of active nozzles used in the (b)-print process; and executing, after the (a)-print process is executed and before the (b)-print process is executed, a (c)-print process in which the conveying mechanism conveys the sheet and at least two pass processes are executed with Kc number of active nozzles, Kc being greater than or equal to Kb and smaller than Ka. The at least two pass processes includes: a (c1)-pass process with Kc1 number of active nozzles as the Kc number of active nozzles, the upstream gradient of the dot recording rates of the Kc1 number of active nozzles used in the (c1)-pass process being greater than at least one of the upstream gradient and the downstream gradient of the dot recording rates of the Ka number of active nozzles used in the (a)-print process, the downstream gradient of the dot recording rates of the Kc1 number of active nozzles used in the (c1)-pass process being the same as at least one of the upstream gradient and the downstream gradient of the dot recording rates of the Ka number of active nozzles used in the (a)-print process; and a (c2)-pass process with Kc2 number of active nozzles as the Kc number of active nozzles, the (c2)-pass process being executed after the (c1)-pass process, the upstream gradient of the dot recording rates of the Kc2 number of active nozzles used in the (c2)-pass process being the same as at least one of the upstream gradient and the downstream gradient of the dot recording rates of the Kb number of active nozzles used in the (b)-print process, the downstream gradient of the dot recording rates of the Kc2 number of active nozzles used in the (c2)-pass process being greater than at least one of the upstream gradient and the downstream gradient of the dot recording rates of the Ka number of active nozzles used in the (a)-print process. Kc1 is greater than Kc2.

According to one of other aspects, the present disclosure provides a non-transitory computer readable storage medium storing a set of program instructions executable by a processor. The program instructions, when executed by the processor, cause the processor to control a print executing apparatus to perform a multi-pass printing. The print executing apparatus includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The processor is configured to control the print executing apparatus to perform the multi-pass printing for printing a target image on the sheet with a plurality of pass processes. The plurality of pass processes forms a plurality of partial images respectively. Two partial images formed with successive two pass processes overlap partially. K-number of active nozzles consecutively arranged are selected from the plurality of nozzles for each of the plurality of pass processes. Dot recording rates of the K-number of active nozzles decrease at an upstream gradient from a nozzle having a maximum dot recording rate among the dot recording rates of the K-number of active nozzles toward a most-upstream nozzle of the K-number of active nozzles in the conveying direction. The dot recording rates of the K-number of active nozzles decrease at a downstream gradient from a nozzle having the maximum dot recording rate toward a most-downstream nozzle of the K-number of active nozzles in the conveying direction. The program instructions further comprise controlling the print executing apparatus to perform: executing an (A)-print process in which the conveying mechanism conveys the sheet and a pass process is executed with KA number of active nozzles, the upstream gradient of the dot recording rates of the KA number of active nozzles used in the (A)-print process being the same as the downstream gradient of the dot recording rates of the KA number of active nozzles used in the (A)-print process; executing, before the (A)-print process is executed, a (B)-print process in which the conveying mechanism conveys the sheet and a pass process is executed with KB number of active nozzles, KB being smaller than KA, the upstream gradient of the dot recording rates of the KB number of active nozzles used in the (B)-print process being the downstream gradient of the dot recording rates of the KB number of active nozzles used in the (B)-print process; and executing, after the (B)-print process is executed before the (A)-print process is executed, a (C)-print process in which the conveying mechanism conveys the sheet and at least two pass processes are executed with KC number of active nozzles, KC being greater than or equal to KB and smaller than KA. The (C)-print process includes: a (C1)-pass process with KC1 number of active nozzles as the KC number of active nozzles, the upstream gradient of the dot recording rates of the KC1 number of active nozzles used in the (C1)-pass process being smaller than at least one of the upstream gradient and the downstream gradient of the dot recording rates of the KB number of active nozzles used in the (B)-print process, the downstream gradient of the dot recording rates of the KC1 number of active nozzles used in the (C1)-pass process being the same as at least one of the downstream gradient and the upstream gradient of the dot recording rates of the KB number of active nozzles used in the (B)-print process; and a (C2)-pass process with KC2 number of active nozzles as the KC number of active nozzles, the (C2)-pass process being executed after the (C1) pass process, the upstream gradient of the dot recording rates of the KC2 number of active nozzles used in the (C2)-pass process being the same as one of the upstream gradient and the downstream gradient of the dot recording rates of the KA number of active nozzles used in the (A)-print process, the downstream gradient of the dot recording rates of the KC2 number of active nozzles used in the (C2)-pass process being smaller than the downstream gradient of the dot recording rates of the KB number of active nozzles used in the (B)-print process. KC1 is smaller than KC2.

According to one of other aspects, the present disclosure provides a printer including a print executing unit and a controller.

The print executing unit includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The controller is configured to control the print executing unit to perform a multi-pass printing for printing a target image on the sheet with a plurality of pass processes. The plurality of pass processes forms a plurality of partial images respectively. Two partial images formed with successive two pass processes overlap partially. K-number of active nozzles consecutively arranged are selected from the plurality of nozzles for each of the plurality of pass processes. Dot recording rates of the K-number of active nozzles decrease at an upstream gradient from a nozzle having a maximum dot recording rate among the dot recording rates of the K-number of active nozzles toward a most-upstream nozzle of the K-number of active nozzles in the conveying direction. The dot recording rates of the K-number of active nozzles decrease at a downstream gradient from a nozzle having the maximum dot recording rate toward a most-downstream nozzle of the K-number of active nozzles in the conveying direction. The controller is further configured to control the print executing unit to perform: executing an (a)-print process in which the conveying mechanism conveys the sheet and a pass process is executed with Ka number of active nozzles; executing, after the (a)-print process is executed, a (b)-print process in which the conveying mechanism conveys the sheet and a pass process is executed with Kb number of active nozzles, Kb being smaller than Ka; and executing, after the (a)-print process is executed and before the (b)-print process is executed, a (c)-print process in which the conveying mechanism conveys the sheet and at least two pass processes are executed with Kc number of active nozzles, Kc being greater than or equal to Kb and smaller than Ka. The at least two pass processes includes: a (c1)-pass process with Kc1 number of active nozzles as the Kc number of active nozzles, the downstream gradient of the dot recording rates of the Kc1 number of active nozzles used in the (c1)-pass process being the same as the upstream gradient of the dot recording rates of the Ka number of active nozzles used in the (a)-print process, the upstream gradient of the dot recording rates of the Kc1 number of active nozzles used in the (c1)-pass process being greater than the upstream gradient of the dot recording rates of the Ka number of active nozzles used in the (a)-print process; and a (c2)-pass process with Kc2 number of active nozzles, the (c2)-pass process being executed after the (c1)-pass process, the upstream gradient of the dot recording rates of the Kc2 number of active nozzles used in the (c2)-pass process being the same as the downstream gradient of the dot recording rates of the Kb number of active nozzles used in the (b)-print process, the downstream gradient of the dot recording rates of the Kc2 number of active nozzles used in the (c2)-pass process being greater than the downstream gradient of the dot recording rates of the Ka number of active nozzles used in the (a)-pass process. Kc1 is greater than Kc2.

According to one of other aspects, the present disclosure provides a printer including a print executing unit and a controller. The print executing unit includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The controller is configured to control the print executing unit to perform a multi-pass printing for printing a target image on the sheet with a plurality of pass processes. The plurality of pass processes forms a plurality of partial images respectively. Two partial images formed with successive two pass processes overlap partially. K-number of active nozzles consecutively arranged are selected from the plurality of nozzles for each of the plurality of pass processes. Dot recording rates of the K-number of active nozzles decrease at an upstream gradient from a nozzle having a maximum dot recording rate among the dot recording rates of the K-number of active nozzles toward a most-upstream nozzle of the K-number of active nozzles in the conveying direction. The dot recording rates of the K-number of active nozzles decrease at a downstream gradient from a nozzle having the maximum dot recording rate toward a most-downstream nozzle of the K-number of active nozzles in the conveying direction. The controller is further configured to control the print executing unit to perform: executing an (A)-print process in which the conveying mechanism conveys the sheet and a pass process is executed with KA number of active nozzles; executing, before the (A)-print process is executed, a (B)-print process in which the conveying mechanism conveys the sheet and a pass process is executed with KB number of active nozzles, KB being smaller than KA; and executing, after the (B)-print process is executed before the (A)-print process is executed, a (C)-print process in which the conveying mechanism conveys the sheet and at least two pass processes are executed with KC number of active nozzles, KC being greater than or equal to KB and smaller than KA. The (C)-print process includes: a (C1)-pass process with KC1 number of active nozzles as the KC number of active nozzles, the upstream gradient of the dot recording rates of the KC1 number of active nozzles used in the (C1)-pass process being smaller than the upstream gradient of the dot recording rates of the KB number of active nozzles used in the (B)-print process, the downstream gradient of the dot recording rates of the KC1 number of active nozzles used in the (C1)-pass process being the same as the upstream gradient of the dot recording rates of the KB number of active nozzles used in the (B)-print process; and a (C2)-pass process with KC2 number of active nozzles as the KC number of active nozzles, the (C2)-pass process being executed after the (C1) pass process, the upstream gradient of the dot recording rates of the KC2 number of active nozzles used in the (C2)-pass process being the same as the downstream gradient of the dot recording rates of the KA number of active nozzles used in the (A)-print process, the downstream gradient of the dot recording rates of the KC2 number of active nozzles used in the (C2)-pass process being smaller than the downstream gradient of the dot recording rates of the KB number of active nozzles used in the (B)-pass process. KC1 is smaller than KC2.

BRIEF DESCRIPTION OF THE DRAWINGS

The particular features and advantages of the disclosures as well as other objects will become apparent from the following description taken in connection with the accompanying drawings, in which:

FIG. 8A shows an example of dot pattern data for a target pass process;

FIG. 8B shows an example of partial dot data for the target pass process;

FIG. 8C shows pass data generated on the basis of the dot pattern data shown in FIG. 8A and the partial dot data shown in FIG. 8B;

FIG. 12 shows graphs denoting graded recording rates when printing from the downstream edge to the middle section of the sheet in the normal control according to the first embodiment;

FIG. 15 shows graphs denoting the graded recording rates when printing from the middle section to the upstream edge of the sheet in the normal control according to the first embodiment;

FIG. 21 shows graphs denoting the graded recording rates when printing from the middle section to the upstream edge of the sheet in the normal control according to the second embodiment;

FIG. 22 is an explanatory diagram showing positions of the print head when printing from the downstream edge to the middle section of the sheet in the normal control according to a third embodiment;

FIG. 23 shows graphs denoting graded recording rates when printing from the downstream edge to the middle section of the sheet in the normal control according to the third embodiment;

FIG. 24 is an explanatory diagram showing the positions of the print head when printing from the middle section to the upstream edge of the sheet in the normal control according to the third embodiment;

FIG. 25 shows graphs denoting graded recording rates when printing from the middle section to the upstream edge of the sheet in the normal control according to the third embodiment;

FIG. 26 shows graphs denoting the graded recording rates when printing from the middle section to the upstream edge of the sheet in the normal control according to a variation of the embodiments.

DETAILED DESCRIPTION

A. First Embodiment

A-1. Structure of a Printing Device

Figure 1:
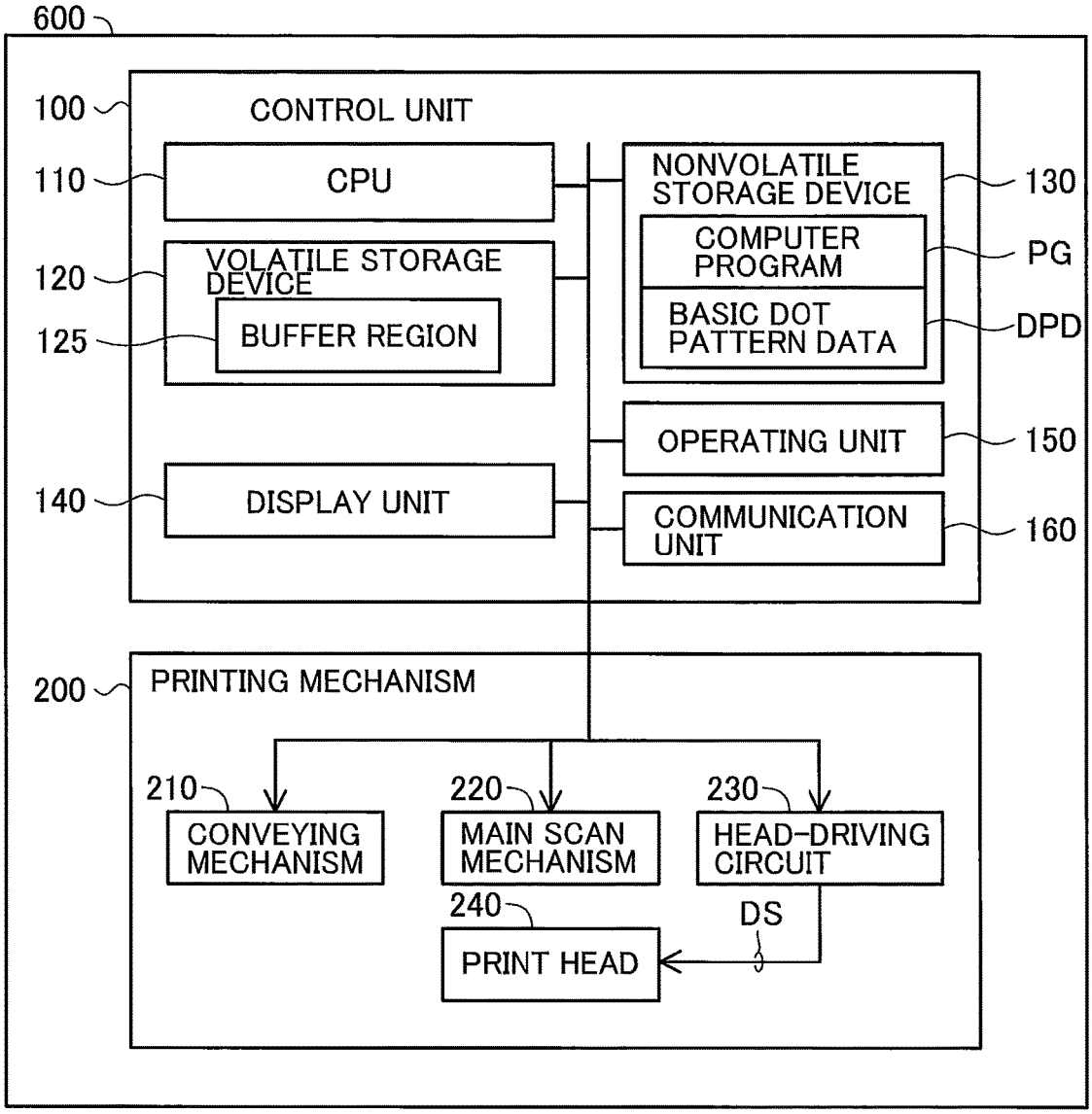
FIG. 1 is a block diagram showing a structure of a printer according to embodiments.

FIG. 1 is a block diagram showing the structure of a printer 600 according to the first embodiment. The printer 600 is an inkjet printer that prints images on sheets of paper by forming dots on the paper with ink. The printer 600 includes a control unit 100 for controlling all operations of the printer 600, and a printing mechanism 200 serving as the print executing unit.

The control unit 100 includes a CPU 110 serving as a controller; a volatile storage device 120, such as DRAM; a nonvolatile storage device 130, such as flash memory or a hard disk drive; a display unit 140, such as a liquid crystal display; an operating unit 150, such as a touchscreen superimposed on a liquid crystal display panel and various buttons; and a communication unit 160 having a communication interface for communicating with external devices, such as a personal computer (not shown).

The volatile storage device 120 is provided with a buffer region 125 for temporarily storing various intermediate data generated when the CPU 110 performs processes. The nonvolatile storage device 130 stores a computer program PG for controlling the printer 600, and basic dot pattern data DPD used in a print data generation process described later.

The computer program PG is pre-stored in the nonvolatile storage device 130 prior to shipping the printer 600. Note that the computer program PG may be supplied to the user on a DVD-ROM or other storage medium, or may be made available for download from a server. By executing the computer program PG, the CPU 110 implements a control process of the printer 600 described later. The basic dot pattern data DPD may be incorporated with the computer program PG or supplied together with the computer program PG.

The printing mechanism 200 executes printing operations by ejecting ink in the colors cyan (C), magenta (M), yellow (Y), and black (K) under control of the CPU 110 in the control unit 100. The printing mechanism 200 includes a conveying mechanism 210, a main scan mechanism 220, a head-driving circuit 230, and a print head 240. The conveying mechanism 210 is provided with a conveying motor (not shown) that produces a drive force for conveying sheets of paper along a prescribed conveying path. As will be described later, the conveying mechanism 210 in the first embodiment is capable of conveying sheets of paper accommodated in two trays along respectively different conveying paths. The two trays are an upper tray and a lower tray (not shown). The main scan mechanism 220 is provided with a main scan motor (not shown) that produces a drive force for reciprocating the print head 240 in the main scanning direction (hereinafter also called a "main scan"). The head-driving circuit 230 provides a drive signal DS to the print head 240 for driving the print head 240 while the main scan mechanism 220 is moving the print head 240 in a main scan. The print head 240 forms dots on a sheet of paper conveyed by the conveying mechanism 210 by ejecting ink according to the drive signal DS. In this description, the process of forming dots on the sheet while performing a main scan will be called a "pass process." The CPU 110 of the control unit 100 executes printing by repeatedly controlling the printing mechanism 200 to execute a conveying process for conveying the sheet in the conveying direction with the conveying mechanism 210, and a pass process.

Figure 2:
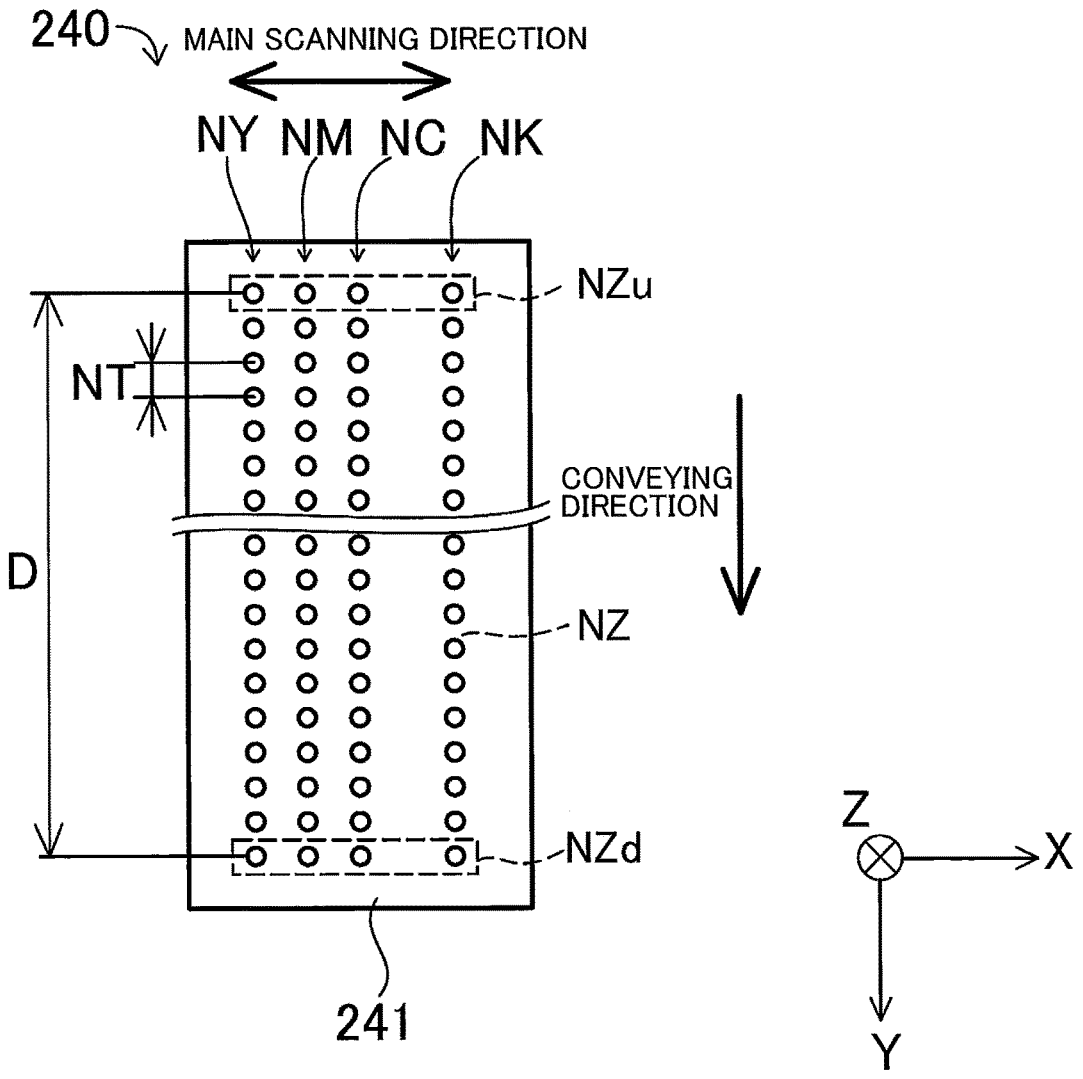
FIG. 2 shows a general structure of a print head of the printer.

FIG. 2 shows the general structure of the print head 240. As shown in FIG. 2, the print head 240 has a nozzle-forming surface 241 constituting the −Z side thereof. Nozzle rows NC, NM, NY, and NK for ejecting ink droplets in the respective colors C, M, Y, and K are formed in the nozzle-forming surface 241 of the print head 240. Each nozzle row includes a plurality of nozzles NZ (100, for example) spaced at a prescribed nozzle pitch NT in the conveying direction. The nozzle rows are arranged at different positions from each other relative to the main scanning direction. In FIG. 2 and subsequent drawings, the +Y direction denotes the conveying direction (sub scanning direction), and the X direction (+X and −X directions) denotes the main scanning direction perpendicular to the conveying direction. The nozzle NZ in each nozzle row on the downstream end in the conveying direction (i.e., the +Y end in FIG. 2) will be called a downstream nozzle NZd, while the nozzle NZ positioned on the upstream end in the conveying direction (i.e., the −Y end in FIG. 2) will be called an upstream nozzle NZu. In the following description, the length in the conveying direction of the nozzle rows from one specific nozzle NZ (nozzle NZ1, for example) to another specific nozzle NZ (nozzle NZ2, for example) will be called the nozzle length from nozzle NZ1 to nozzle NZ2. The nozzle length in the conveying direction from the upstream nozzle NZu to the downstream nozzle NZd will be called the total nozzle length D (see FIG. 2). Hereinafter, the +Y side will be simply called the "downstream side," while the −Y side will be simply called the "upstream side." Further, an end on the +Y side will be simply called the "downstream end," while an end on the −Y side will be simply called the "upstream end."

Figure 3A:
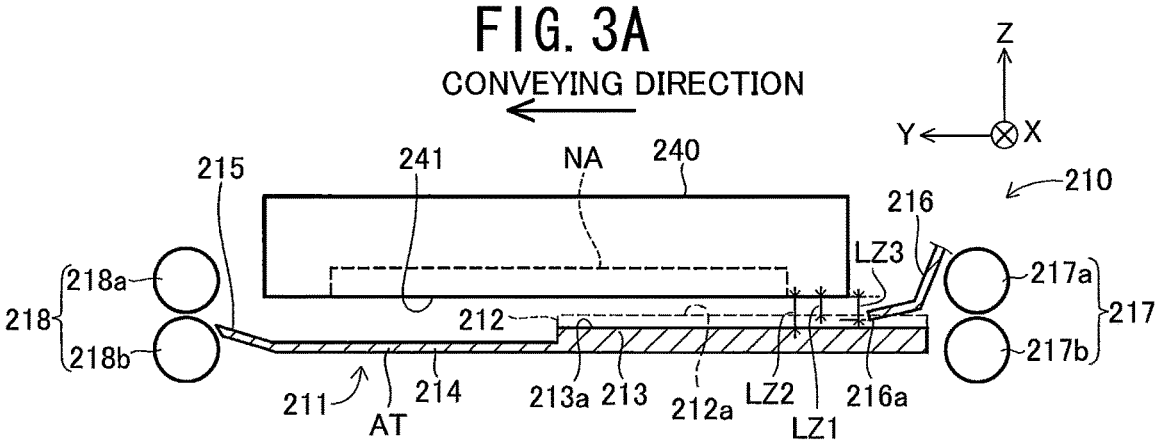
FIG. 3A shows a general structure of a conveying mechanism of the printer.

FIG. 3A shows the general structure of the conveying mechanism 210. As shown in FIG. 3A, the conveying mechanism 210 includes a sheet support 211, a pair of upstream rollers 217 and a pair of downstream rollers 218 for holding and conveying sheets, and a plurality of pressing members 216 for holding sheets.

The upstream rollers 217 are disposed on the upstream side (−Y side) of the print head 240 in the conveying direction, while the downstream rollers 218 are disposed on the downstream side (+Y side) of the print head 240. The upstream rollers 217 include a drive roller 217*a* and a follow roller 217*b*. The drive roller 217*a* is driven to rotate by a conveying motor (not shown). The follow roller 217*b* rotates along with the rotation of the drive roller 217*a*. Similarly, the downstream rollers 218 include a drive roller 218*a* and a follow roller 218*b*. Note that plate members may be employed in place of the follow rollers 217*b* and 218*b*, whereby sheets of paper are held between the drive rollers and corresponding plate members.

The sheet support 211 is disposed at a position between the upstream rollers 217 and the downstream rollers 218 and confronts the nozzle-forming surface 241 of the print head 240. The pressing members 216 are arranged between the upstream rollers 217 and the print head 240.

Figure 3B:
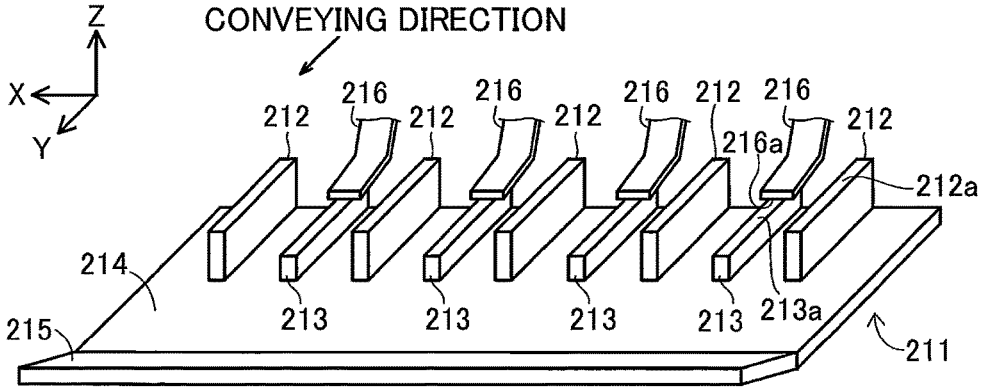
FIG. 3B is a perspective view of a sheet support and pressing members of the conveying mechanism when a sheet is not interposed between the sheet support and the pressing members.
Figure 3C:
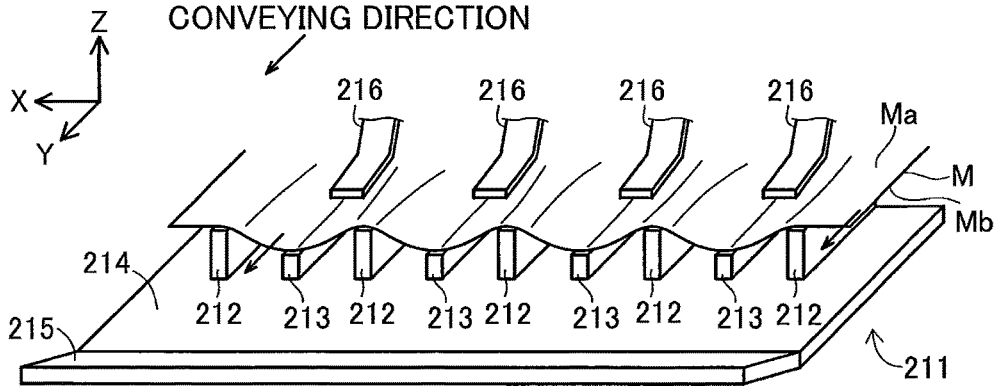
FIG. 3C is a perspective view of the sheet support and the pressing members when a sheet is interposed between the sheet support and the pressing members.

FIGS. 3B and 3C are perspective views of the sheet support 211 and the pressing members 216. FIG. 3B shows the components when a sheet M is not interposed between the pressing members 216 and sheet support 211, and FIG. 3C shows the components when a sheet M is interposed between the pressing members 216 and the sheet support 211. The sheet support 211 includes a plurality of high support members 212, a plurality of low support members 213, a flat plate 214, and a sloped part 215.

The flat plate 214 is a plate-shaped member that is arranged substantially parallel to the main scanning direction (X direction) and the conveying direction (+Y direction). The upstream edge of the flat plate 214 is positioned near the upstream rollers 217 and extends farther upstream than the upstream edge of the print head 240. The sloped part 215 is a plate-shaped member positioned on the downstream side of the flat plate 214 and slopes upward in the downstream direction. The downstream edge of the sloped part 215 is positioned near the downstream rollers 218 and extends farther downstream than the downstream side of the print head 240. The dimension of the flat plate 214 in the X direction is longer than the dimension of a sheet M in the X direction by a prescribed amount. Accordingly, when the printer 600 executes borderless printing for printing both edges of the sheet M relative to the X direction (main scanning direction) so that no margins remain on these edges, the flat plate 214 can receive ink ejected beyond the edges of the sheet M in the X direction.

The high support members 212 and the low support members 213 are alternately arranged on the flat plate 214 in the X direction. Thus, each of the low support members 213 is disposed between two high support members 212 neighboring the low support members 213. Each high support member 212 is a rib extends in the Y direction. The upstream end of each high support member 212 is flush with the upstream edge of the flat plate 214, and the downstream end of each high support member 212 is disposed in the center region of the flat plate 214 relative to the Y direction. The downstream end of each high support member 212 may be said to be positioned in the center region of a nozzle area NA relative to the Y direction, where the nozzle area NA is the region in which the plurality of nozzles NZ is formed in the print head 240. The positions of both ends of the low support members 213 in the Y direction are identical to the same end positions of the high support members 212 in the Y direction.

The pressing members 216 are disposed on the +Z side of the corresponding low support members 213 and at the same positions in the X direction as the low support members 213. In other words, each pressing member 216 is positioned between two high support members 212 neighboring the pressing member 216 in the X direction. The pressing members 216 are plate-shaped members that slope toward the low support members 213 in the downstream direction (+Y direction). The downstream ends of the pressing members 216 are positioned between the upstream edge of the print head 240 and the upstream rollers 217.

The pluralities of high support members 212, low support members 213, and pressing members 216 are positioned closer to the upstream rollers 217 than to the downstream rollers 218 and, hence, may be considered to be provided on the upstream rollers 217 side of the conveying mechanism 210 with respect to the upstream rollers 217 and downstream rollers 218.

As shown in FIG. 3C, a sheet M of paper conveyed by the conveying mechanism 210 has a printing surface Ma on which the print head 240 ejects ink droplets, and a back surface Mb on the opposite side of the printing surface Ma. As the sheet M is conveyed, the high support members 212 and the low support members 213 support the sheet M on the back surface Mb side and the pressing members 216 support the sheet M on the printing surface Ma side. The parts of the high support members 212 that support the sheet M (and specifically, surfaces 212*a* of the high support members 212 on the +Z side; see FIG. 3A) are positioned higher in the +Z direction than the parts of the low support members 213 that support the sheet M (and specifically, surfaces 213*a* of the low support members 213; see FIG. 3A). In other words, a distance LZ1 between the surfaces 212*a* of the high support members 212 supporting the sheet M and a plane passing through the nozzle-forming surface 241 of the print head 240 is shorter than a distance LZ2 between the surfaces 213*a* of the low support members 213 supporting the sheet M and a plane passing through the nozzle-forming surface 241 of the print head 240.

Further, the surfaces 212*a* of the high support members 212 are positioned farther in the +Z direction than the portions of the pressing members 216 that support the sheet M (and specifically, bottom edges 216*a* of the pressing members 216 on the −Z side and at the downstream end of the same; see FIG. 3A). Therefore, the distance LZ1 between the surfaces 212*a* of the high support members 212 and a plane passing through the nozzle-forming surface 241 of the print head 240 is shorter than a distance LZ3 between the bottom edges 216*a* of the pressing members 216 supporting the sheet M and a plane passing through the nozzle-forming surface 241 of the print head 240.

Thus, the sheet M is supported by the high support members 212, the low support members 213, and the pressing members 216 in a corrugated state, with undulations progressing in the X direction (see FIG. 3C). While remaining deformed in this corrugated state, the sheet M is conveyed in the conveying direction (+Y direction). When deformed in this corrugated shape, the sheet M has greater rigidity and is resistant to deformation along the Y direction.

A downstream portion AT of the flat plate 214 positioned on the downstream side of the high support members 212 and the low support members 213 is separated farther from the nozzle-forming surface 241 of the print head 240 than the high support members 212 and the low support members 213 are separated from the nozzle-forming surface 241 of the print head 240, and hence do not support the sheet M conveyed along the flat plate 214 from below. Hereinafter, this downstream portion AT of the flat plate 214 will be called a non-supporting part AT. In the first embodiment, the high support members 212 and the low support members 213 oppose the portion of the nozzle-forming surface 241 of the print head 240 in which approximately half of the nozzles are formed, and specifically the upstream nozzles that include the upstream nozzle NZu. The non-supporting part AT opposes the portion of the nozzle-forming surface 241 of the print head 240 in which the approximately other half of the nozzles are formed, and specifically the downstream nozzles that include the downstream nozzle NZd. This non-supporting part AT functions as an ink receiver for receiving ink ejected beyond the sheet M when performing borderless printing.

A-2. Overview of the Control Process

Figure 4:
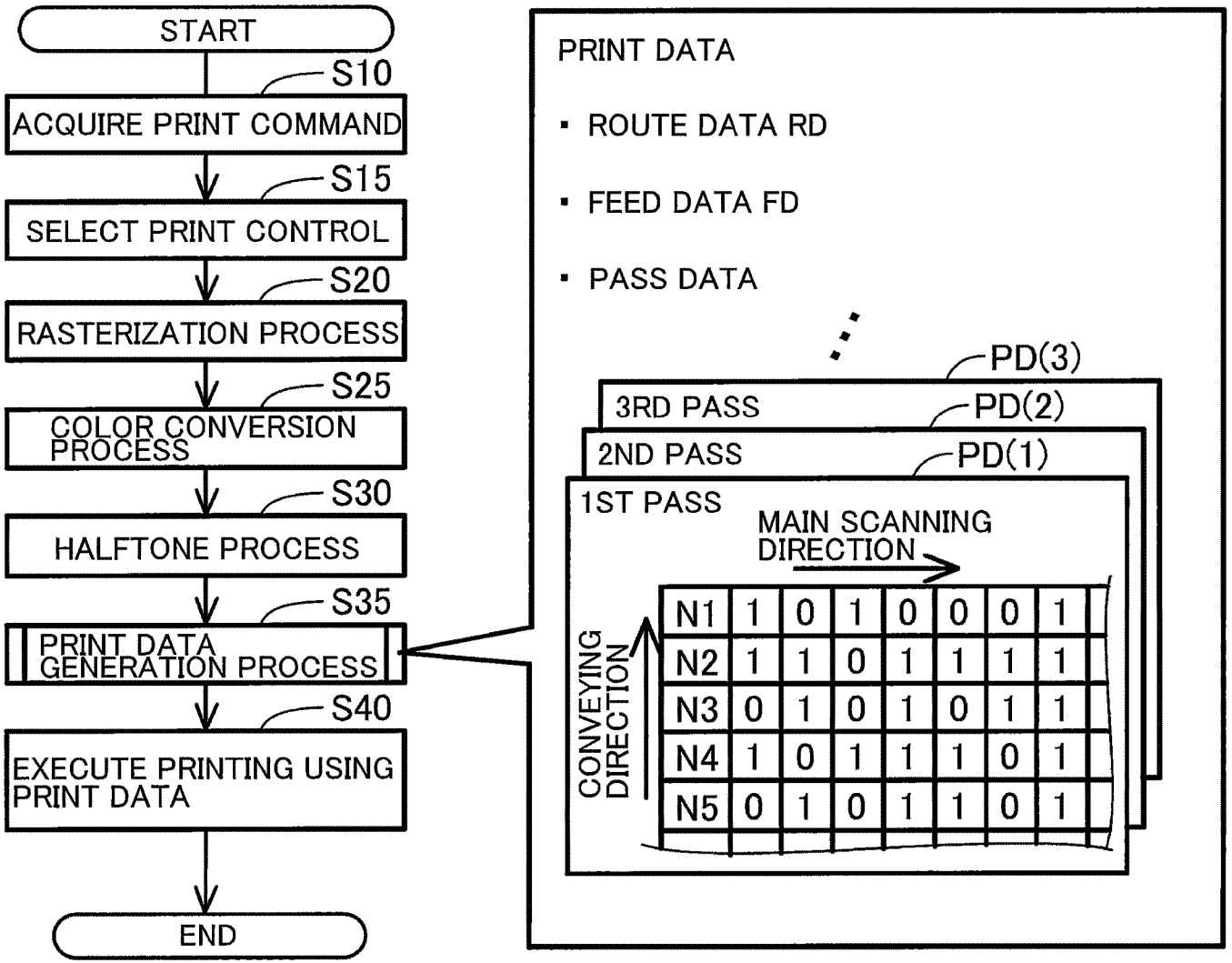
FIG. 4 is a flowchart illustrating steps in a control process.

The CPU 110 of the control unit 100 executes a control process for controlling the printing mechanism 200 to execute a printing operation based on a print command from the user. FIG. 4 is a flowchart illustrating steps in this control process.

In S10 of FIG. 4, the CPU 110 acquires a prescribed print command from the user via the operating unit 150. The print command includes an instruction specifying image data to be printed, and an instruction specifying the tray (the upper tray or the lower tray) accommodating sheets M to be used in the printing operation.

In S15 the CPU 110 selects one type of print control from among normal control and special control described later. More specifically, the CPU 110 identifies an upper path as the conveying path for conveying the sheet M when the user has specified the upper tray, and identifies a lower path as the conveying path when the user has specified the lower tray. The upper and lower paths will be described later. Next, the CPU 110 selects the special control as the type of print control when identifying the upper path as the conveying path, and selects the normal control as the type of print control when identifying the lower path as the conveying path, for reasons that will be described later.

In S20 the CPU 110 acquires the image data specified by the user from the nonvolatile storage device 130 and executes a rasterization process on the image data to generate bitmap data representing a target image having a plurality of pixels. The bitmap data is RGB image data representing the color of each pixel in RGB values. Each of the three component values included in the RGB values, i.e., each of the R value, G value, and B value, is a gradation value expressed in one of 256 gradations, for example.

In S25 the CPU 110 executes a color conversion process on the RGB image data to generate CMYK image data. The CMYK image data represents a color for each pixel as gradation values for the four color components CMYK (hereinafter called the CMYK values). The color conversion process is performed using a lookup table that defines correlations between RGB values and CMYK values, for example.

In S30 the CPU 110 executes a halftone process, such as an error diffusion method or a dither method, on the CMYK image data to generate dot data representing the dot formation state of each pixel and for each ink color. Each pixel value in the dot data is one of two values indicating one of two types of dot formation states. Specifically, a pixel value of "1" denotes "dot," while a pixel value of "0" denotes "no dot." Alternatively, each pixel value in the dot data may take on one of four values specifying four types of dot formation states, including "large dot," "medium dot," "small dot," and "no dot."

In S35 the CPU 110 generates print data based on the type of print control selected in S15 (i.e., the normal control or the special control), and the dot data generated in S30. The print data includes route data RD specifying the conveying path (i.e., the upper path or lower path), feed data FD, and a plurality of sets of pass data PD(1)-PD(m), where m indicates the number of pass processes. One set of pass data corresponds to one pass process. One set of pass data is correlated with one set of raster line data for each of the nozzles NZ. Data for one raster line specifies the dot formation state of each pixel in one raster line that includes a plurality of pixels aligned in the main scanning direction and corresponding to one nozzle. For example, data for the first raster line in the first set of pass data PD(1) shown in FIG. 4 specifies either a "1" denoting "dot" or a "0" denoting "no dot" for each of the plurality of pixels in the raster line corresponding to the nozzle NZ having nozzle number "N1". The feed data FD includes m values specifying the feed amounts in sheet-conveying processes performed prior to the respective m passes. The print data generation process will be described later in greater detail.

In S40 the CPU 110 controls the printing mechanism 200 to execute a printing operation by controlling the printing mechanism 200 on the basis of the print data generated in S35. Through this process, the control unit 100 prints an image on paper.

According to the above description, in the first embodiment the control unit 100 that includes the CPU 110 is an example of a controller or processor and the printing mechanism 200 is an example of a print executing unit. Alternatively, a personal computer or other terminal device connected to the printer 600 may generate print data by executing the process in S10-S35 described above and may control the printer 600 to execute a printing operation by supplying this print data to the printer 600. In this case, the terminal device is an example of a processor and the printer 600 is an example of the print executing unit.

A-3. Conveying Paths and Print Control

Figure 5:
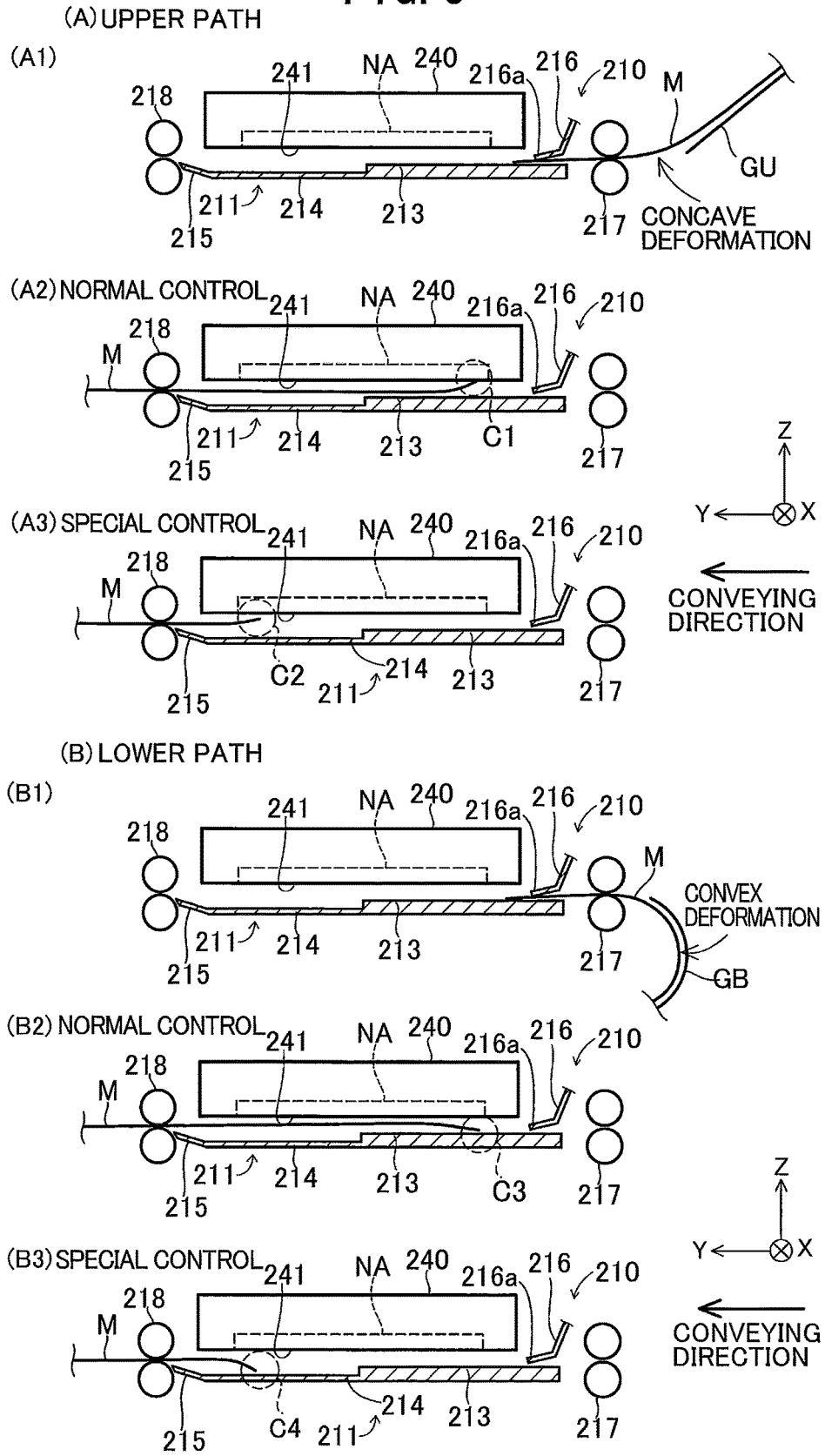
FIG. 5 is an explanatory diagram showing an example of conveying paths and print controls.

FIG. 5 shows an example of the conveying paths and the methods of print control. FIG. 5(A) includes explanatory diagrams illustrating cases in which the conveying path is the upper path. (A1) shows a state of a sheet M conveyed from the upper tray via the upper path to a position near the print head 240 prior to performing a printing operation on the sheet M. In this state, the upstream rollers 217 hold the sheet M. The portion of the sheet M positioned on the downstream side of the upstream rollers 217 extends leftward in FIG. 5(A) along the flat plate 214 while the portion of the sheet M positioned on the upstream side of the upstream rollers 217 extends diagonally upward and rightward along a guide member GU that function to guide sheets M from the upper tray. Hence, the sheet M is bent into a concave shape in this state. It is known that the sheet M will be deformed in a concave shape when conveyed along the upper path.

(A2) shows the state of a sheet M conveyed according to the normal control, while (A3) shows the state of a sheet M conveyed according to the special control. As illustrated in (A2) and (A3), the upstream edge region of the sheet M is printed after the upstream edge of the sheet M has moved downstream from the bottom edges 216*a* of the pressing members 216 and while the sheet M is held only by the downstream rollers 218. Thus, when the conveying path is the upper path, the sheet M is deformed into a concave shape.

As will be described later in greater detail, the CPU 110 conveys the sheet M with relatively short feeds rather than long feeds when printing the portion of the sheet M near the upstream edge (hereinafter called the "upstream end portion") during the normal control. Accordingly, when the CPU 110 prints the upstream end portion of the sheet M, the length in the conveying direction of the portion of the sheet M positioned on the upstream side of the downstream rollers 218 is greater during the normal control than during the special control, as illustrated in (A2). When the sheet M is deformed into a concave shape, the amount of upward deformation in the upstream edge of the sheet M is significantly large, as indicated in the dashed circle C1 in (A2) so that the upstream edge of the sheet M may contact the nozzle-forming surface 241 of the print head 240. Such cases increase the potential for ink on the nozzle-forming surface 241 of the print head 240 adhering to and smudging the sheet M.

During the special control described later, on the other hand, the sheet M is conveyed with large feeds when executing printing on the upstream end portion of the sheet M. Accordingly, the portion of the sheet M positioned on the upstream side of the downstream rollers 218 when the printer 600 is printing on the upstream end portion of the sheet M in the special control has a shorter length in the conveying direction than the same portion in the normal control as illustrated in (A3). This results in less deformation in the upstream edge (i.e., the right edge in FIG. 5(A)) of the sheet M. Thus, even though the sheet M may be deformed into a concave shape, the upward deformation in the upstream edge of the sheet M is relatively small, as illustrated in the dashed circle C2 in (A3), thereby restraining the upstream edge of the sheet M from coming into contact with the nozzle-forming surface 241 of the print head 240 during printing. Accordingly, this control method reduces the potential for ink on the nozzle-forming surface 241 of the print head 240 from becoming deposited on and smudging the sheet M.

As described above, the CPU 110 selects the special control rather than the normal control in S15 of FIG. 4 in the first embodiment when the conveying path is set to the upper path, in order to avoid smudging the sheet M.

FIG. 5(B) illustrates cases in which the conveying path is the lower path. (B1) shows the state of a sheet M having been conveyed along the lower path from the lower tray to a position near the print head 240 prior to being printed. At this time, the upstream rollers 217 hold the sheet M. The portion of the sheet M positioned on the downstream side of the upstream rollers 217 extends leftward in (B1) along the flat plate 214, while the portion positioned on the upstream side of the upstream rollers 217 extends downward along a guide member GB serving to guide sheets M from the lower tray. Since the sheet M is bent into a convex shape in this case, it can be seen that the sheet M is deformed into a convex shape when conveyed along the lower path.

(B2) shows the state of a sheet M conveyed according to the normal control, and (B3) shows the state of a sheet M conveyed according to the special control. As shown in (B2) and (B3), the CPU 110 prints on the upstream end portion of the sheet M after the upstream edge of the sheet M has moved downstream from the bottom edges 216*a* of the pressing members 216 and the sheet M is held only by the downstream rollers 218. Hence, the sheet M is deformed in a convex shape in this state when the conveying path is the lower path.

As described above, the portion of the sheet M positioned on the upstream side of the downstream rollers 218 when printing on the upstream end portion of the sheet M in the normal control has a longer length in the conveying direction than the upstream side portion in the special control. However, since the sheet M is deformed into a convex shape, the upstream edge of the sheet M is not deformed upward and, hence, the upstream edge of the sheet M is unlikely to contact the nozzle-forming surface 241 of the print head 240 during printing, as illustrated in the dashed circle C3 of (B2).

In the special control, on the other hand, the portion of the sheet M positioned on the upstream side of the downstream rollers 218 when printing on the upstream end portion of the sheet M has a shorter length in the conveying direction than the same portion in the normal control. Since the sheet M is deformed into a convex shape, the upstream edge of the sheet M is not deformed upward and, hence, the upstream edge of the sheet M is still unlikely to contact the nozzle-forming surface 241 of the print head 240 during printing, as illustrated in the dashed circle C4 in (B3). Accordingly, when the conveying path is set to the lower path, potential for the sheet M becoming soiled is low, whether performing the normal control or the special control.

However, as will be described later in greater detail, the special control requires execution of a plurality of short feeds shorter than the feeding amount during the normal control before and after conveying the sheet with a long feed. Accordingly, the number of pass processes executed while the upstream end portion of the sheet M is not supported by the high support members 212 and low support members 213 from below is greater in the special control than in the normal control. Thus, there is a greater chance that positional deviation will occur in raster lines of the printed image due to instability in the upstream edge of the sheet M, increasing the potential for noticeable banding in the image printed near the upstream edge. Therefore, when there is a low probability of the sheet M becoming soiled whether using the normal control or the special control, it is preferable to select the normal control from the viewpoint of suppressing banding.

As described above, the CPU 110 selects the normal control rather than the special control in S15 of FIG. 4 in the first embodiment in order to suppress banding when the conveying path is set to the lower path.

A-4. Print Data Generating Process

Figure 6:
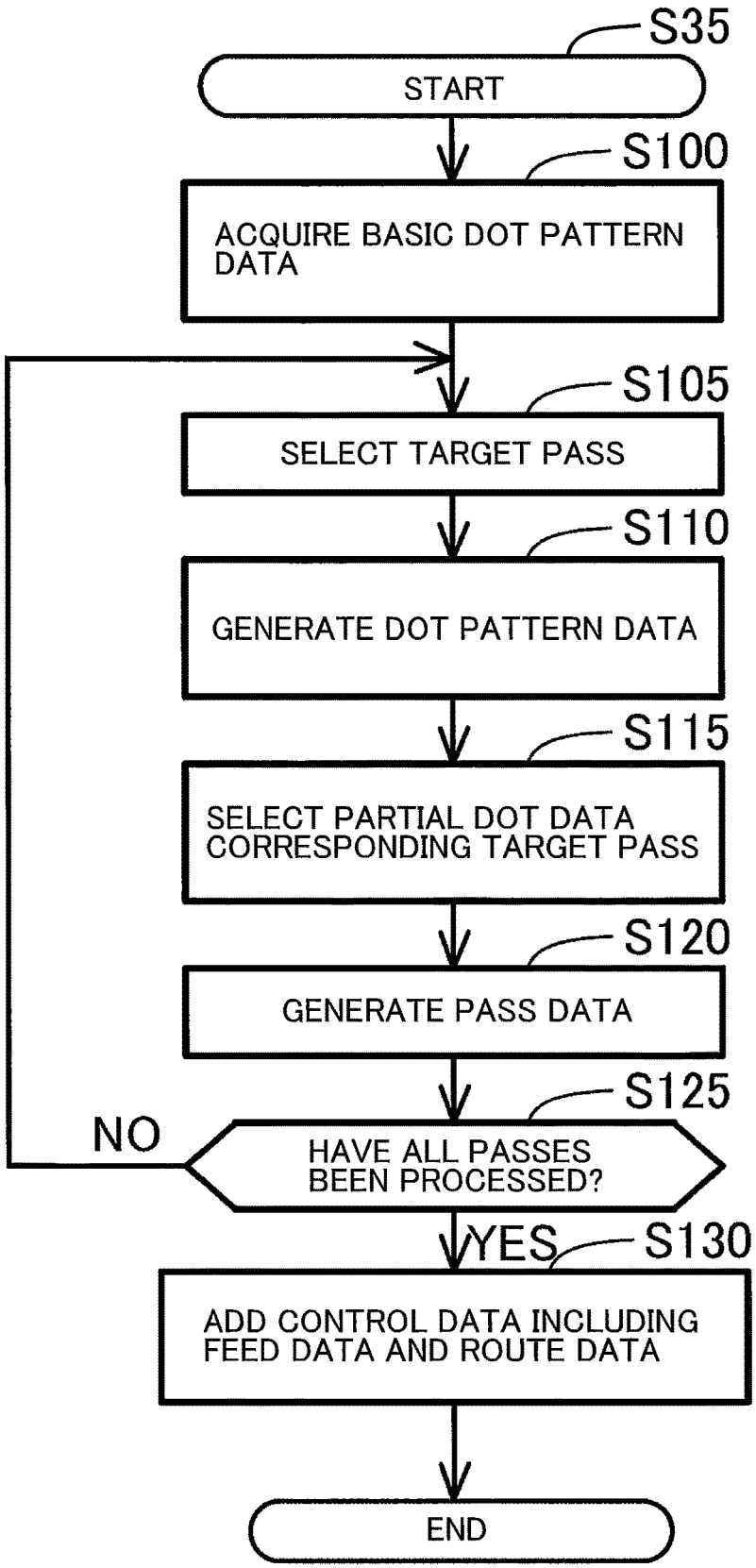
FIG. 6 is a flowchart illustrating steps in a print data generation process.

Next, the print data generation process in S35 of FIG. 4 will be described. FIG. 6 is a flowchart illustrating steps in the print data generation process.

Figure 7A:
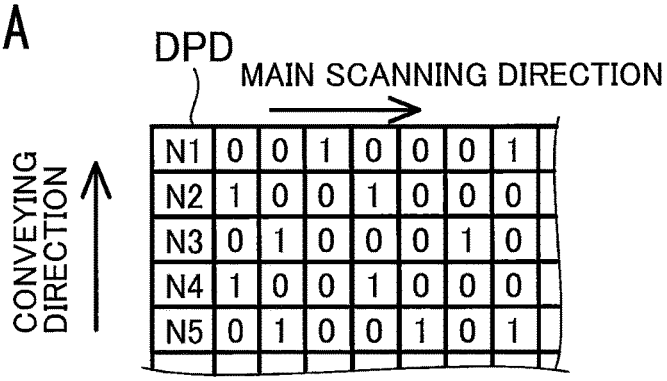
FIG. 7A shows an example of a portion of basic dot pattern data.
Figure 7B:
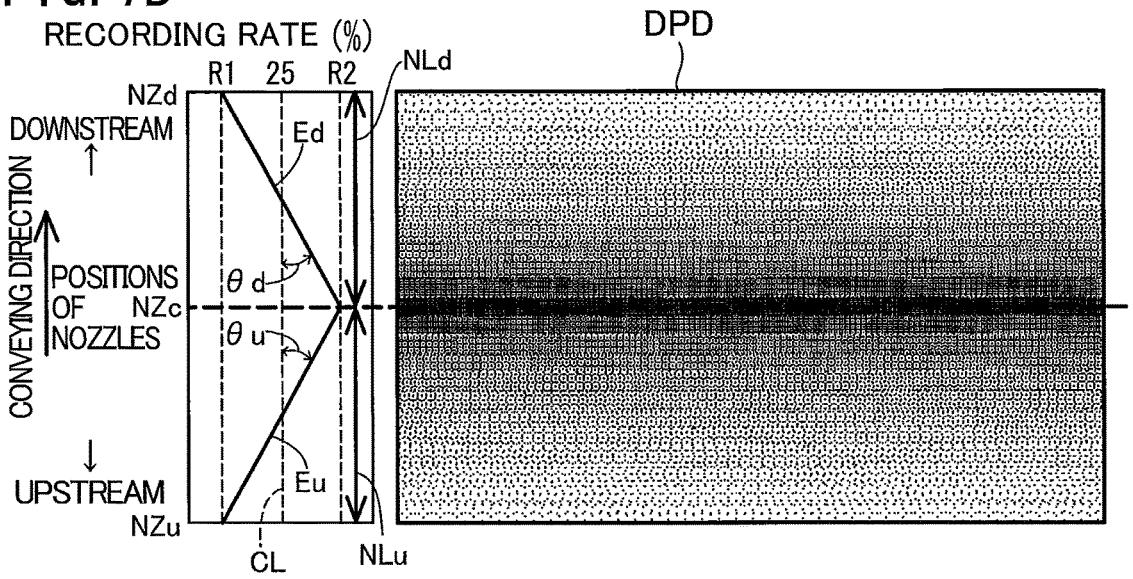
FIG. 7B conceptually illustrates the basic dot pattern data for a plurality of nozzles in a nozzle row for a single color component.
Figure 7C:
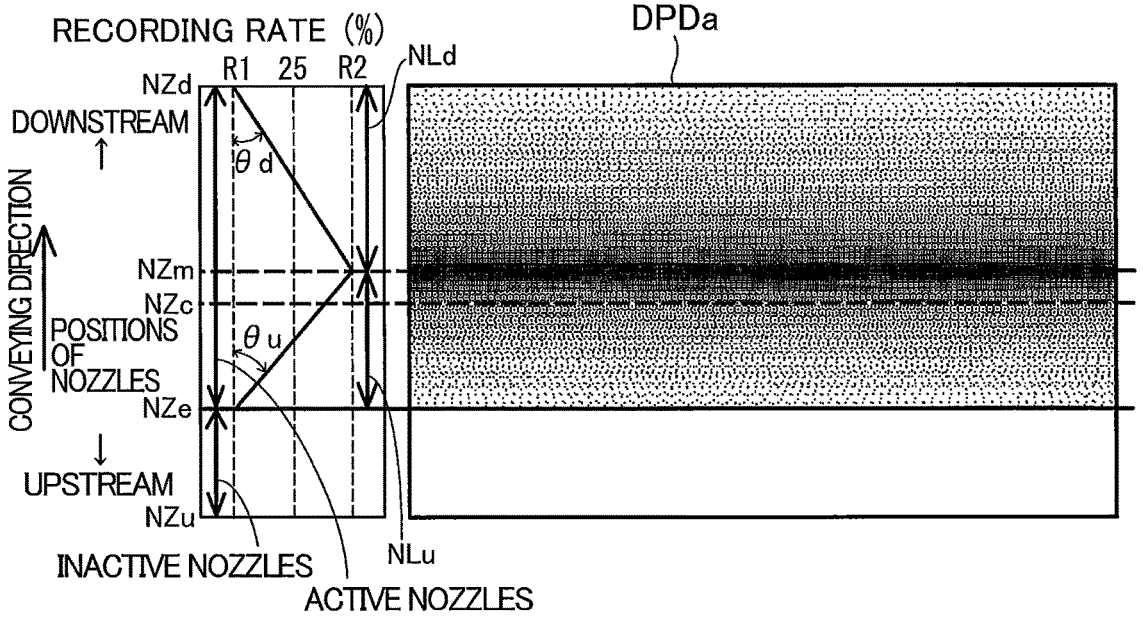
FIG. 7C shows an example of relationships between dot recording rates and dot pattern data based on the basic dot pattern data.

In S100 the CPU 110 acquires the basic dot pattern data DPD from the nonvolatile storage device 130. FIGS. 7A-7C are explanatory diagrams for dot pattern data. FIG. 7A shows a portion of the basic dot pattern data DPD. The basic dot pattern data DPD correlates one set of dot pattern data for one line with each of the nozzles NZ along the total nozzle length D. Dot pattern data for one line specifies whether to allow dot formation for each pixel in a single raster line that corresponds to one individual nozzle and includes a plurality of pixels aligned in the main scanning direction. For example, dot pattern data for the first line in the basic dot pattern data DPD of FIG. 7A records either a "1" or a "0" for each of the plurality of pixels in a raster line corresponding to the nozzle NZ having nozzle number "N1", where "1" denotes that dot formation is allowed and "0" denotes that dot formation is not allowed. In other words, line dot pattern data defines, for corresponding nozzles NZ, the positions on the sheet M in the main scanning direction at which dot formation is allowed and at which dot formation is not allowed.

FIG. 7B conceptually illustrates the basic dot pattern data DPD for a plurality of nozzles NZ in a nozzle row (the nozzle row NC, for example) for a single color component (cyan in this case). The left side of FIG. 7B indicates nozzle positions in the conveying direction in the nozzle row, and a recording rate DR for nozzles NZ at corresponding nozzle positions. The recording rate DR of a nozzle NZ specifies the ratio of pixels for which dot formation is allowed to the total number of pixels in the raster line corresponding to the respective nozzle NZ. The recording rate DR of a nozzle NZ is expressed by NM1/(NM1+NM0), where NM1 denotes the number of "1" in line dot pattern data corresponding to the nozzle NZ, while NM0 denotes the number of "0". The "1" values are distributed in each set of line dot pattern data and so that total a number of the "1" values conforms to the recording rate predefined for the corresponding nozzle NZ.

The nozzle NZ whose recording rate DR has a maximum value R2 in the basic dot pattern data DPD (hereinafter called the maximum recording rate nozzle) is a nozzle NZc positioned in the center of the nozzle row along the conveying direction. The nozzles NZ whose recording rate DR is a minimum value R1 (hereinafter called the minimum recording rate nozzles) are the upstream nozzle NZu and downstream nozzle NZd in the nozzle row.

The recording rates DR in the basic dot pattern data DPD change continuously according to the positions of nozzles NZ in the print head 240 relative to the sub scanning direction (paper-conveying direction). When depicting the recording rate DR with continuous change based on the nozzle positions in the conveying direction, as in the example of FIG. 7B, the recording rate DR has an upstream graded section Eu on the upstream side of the maximum recording rate nozzle, and a downstream graded section Ed on the downstream side of the maximum recording rate nozzle. The recording rate DR in the upstream graded section Eu decreases linearly at a prescribed gradient toward the upstream side from the position of the maximum recording rate nozzle, and the recording rate DR in the downstream graded section Ed decreases linearly at a prescribed gradient toward the downstream side from the position of the maximum recording rate nozzle. Since the recording rate DR corresponding to the positions of nozzles in the conveying direction changes at a gradient, the recording rate DR used in the embodiment will be called a graded recording rate DR.

As shown in FIG. 7B, the gradient of the graded recording rate DR can be represented using the acute angles θd and θu between the lines respectively representing the downstream graded section Ed and upstream graded section Eu and a line CL indicating the graded recording rate DR if the graded recording rate DR were constant for all nozzle positions in the conveying direction. More specifically, the gradient of the graded recording rate DR in the upstream graded section Eu is represented by the acute angle θu shown in FIG. 7B. Hereinafter, the gradient of the graded recording rate DR in the upstream graded section Eu will be called the upstream-side gradient θu. Similarly, the gradient of the graded recording rate DR in the downstream graded section Ed is represented by the acute angle θd shown in FIG. 7B. Hereinafter, the gradient of the graded recording rate DR in the downstream graded section Ed will be called the downstream-side gradient θd. In the basic dot pattern data DPD, the downstream-side gradient θd and upstream-side gradient θu are equivalent (θu=θd). Hereinafter, a larger value for θu and θd will signify a larger gradient, while a smaller value for θu and θd will signify a smaller gradient.

Further, the nozzle length for nozzles regulated by a graded recording rate DR from the maximum recording rate nozzle to the nozzle on the upstream end, i.e., the nozzle length of the upstream graded section Eu will be called the upstream-side nozzle length NLu. Similarly, the nozzle length from the maximum recording rate nozzle to the nozzle on the downstream end, i.e., the nozzle length of the downstream graded section Ed will be called the downstream-side nozzle length NLd. In the basic dot pattern data DPD of FIG. 7B, the graded recording rate DR regulates all nozzles, and the maximum recording rate nozzle is the center nozzle NZc in the center of the nozzle rows in the conveying direction. Therefore, the upstream-side nozzle length NLu is the nozzle length from the nozzle NZc to the upstream nozzle NZu, and the downstream-side nozzle length NLd is the nozzle length from the nozzle NZc to the downstream nozzle NZd. Thus, the upstream-side nozzle length NLu and downstream-side nozzle length NLd are equivalent in the basic dot pattern data DPD (NLu=NLd), and the sum of the upstream-side nozzle length NLu and downstream-side nozzle length NLd is equivalent to the total nozzle length D (D=NLu+NLd).

The average value of the graded recording rate DR for all nozzles whose graded recording rate DR is specified will be called the average recording rate DRav. In multi-pass printing for printing a partial region on the sheet using p pass processes (where p is an integer of 2 or greater), the average recording rate DRav is expressed as (100/p) with the units being "%". Since the multi-pass printing of the first embodiment is four-pass printing (p=4) as will be described later, the average recording rate DRav is 25%. Further, the minimum value R1 and maximum value R2 of the graded recording rate DR are set to R1=(DRav−ΔDR) and R2=(DRav+ΔDR), for example. In the first embodiment, R1=5% and R2=45% (DRav=25% and ΔDR=20%).

In S105 of FIG. 6, the CPU 110 selects a target pass process from among m pass processes used for executing the printing process. The number m of pass processes may differ between normal control and special control.

In S110 the CPU 110 generates dot pattern data DPDa for the target pass process on the basis of the basic dot pattern data DPD. For example, when the graded recording rate DR used in the target pass process is identical to the graded recording rate DR of the basic dot pattern data DPD, the graded recording rate DR of the basic dot pattern data DPD is used unchanged as the dot pattern data DPDa. However, when the graded recording rate DR used in the target pass process differs from the graded recording rate DR in the basic dot pattern data DPD, the basic dot pattern data DPD is used to generate the dot pattern data DPDa according to the graded recording rate DR used in the target pass process. Specifically, the CPU 110 first identifies active nozzles to be used for generating dots in the target pass process, and the maximum recording rate nozzle. The active nozzles and the maximum recording rate nozzle are preset for each pass process. The active nozzles are consecutively arranged and selected from the plurality of nozzles for each of the plurality of pass processes. Further, as will be described later, the active nozzles and the maximum recording rate nozzle differ between the normal control and the special control. The CPU 110 can identify the graded recording rate DR to be used in the target pass process based on the active nozzles and the maximum recording rate nozzle. FIG. 7C shows an example of the graded recording rate DR used in the target pass process. In the example of FIG. 7C, nozzle NZe is the nozzle on the upstream end of the active nozzles used in the target pass process. Hence, nozzles NZ from the downstream nozzle NZd to the nozzle NZe are the active nozzles in this target pass process, while nozzles NZ from the nozzle NZe to the upstream nozzle NZu are inactive nozzles. The nozzle length from the nozzle on the upstream end of the active nozzles to the nozzle on the downstream end of the active nozzles will be called the active nozzle length.

The maximum recording rate nozzle in this target pass process is a nozzle NZm. As shown in FIG. 7C, the nozzle NZm of this target pass process is a different nozzle from the center nozzle NZc, which is the nozzle in the center of the nozzle row relative to the conveying direction and is different from the center nozzle in the conveying direction of the active nozzles from the downstream nozzle NZd to the nozzle NZe. Therefore, the downstream-side nozzle length NLd and upstream-side nozzle length NLu are different in this target pass process. Further, the downstream-side nozzle length NLd and upstream-side nozzle length NLu in this pass process are shorter than the downstream-side nozzle length NLd and upstream-side nozzle length NLu in the basic dot pattern data DPD.

In this case, the downstream-side gradient θd in the graded recording rate is smaller for longer downstream-side nozzle lengths NLd and is larger for shorter downstream-side nozzle lengths NLd. Similarly, the upstream-side gradient θu in the graded recording rate is smaller for longer upstream-side nozzle lengths NLu and is larger for shorter upstream-side nozzle lengths NLu. Further, when the upstream-side nozzle length NLu is longer than the downstream-side nozzle length NLd in the graded recording rate (NLu>NLd), the upstream-side gradient θu is smaller than the downstream-side gradient θd (θu<θd). Similarly, when the upstream-side nozzle length NLu is shorter than the downstream-side nozzle length NLd in the graded recording rate (NLu<NLd), the upstream-side gradient θu is greater than the downstream-side gradient θd (θu>θd). When the upstream-side nozzle length NLu and downstream-side nozzle length NLd are equal in the graded recording rate (NLu=Nld), the upstream-side gradient θu is equivalent to downstream-side gradient θd (θu=θd).

In all pass processes including this target pass process, the graded recording rate DR for the maximum recording rate nozzle is the maximum value R2 and is equivalent to the maximum value R2 of the graded recording rate DR in the basic dot pattern data DPD. Further, in all pass processes, the graded recording rate DR for the upstream nozzle and downstream nozzle among the active nozzles is the minimum value R1 and is equivalent to the minimum value R1 of the graded recording rate DR in the basic dot pattern data DPD. Hence, the graded recording rate DR in all pass processes grows linearly smaller in both upstream and downstream directions from the position of the nozzle NZm.

In S110 the CPU 110 generates the dot pattern data DPDa for the target pass process by thinning out dot pattern data for a specific number of lines from the dot pattern data for the total nozzle length D worth of line dot pattern data included in the basic dot pattern data DPD. Specifically, the CPU 110 sets the downstream-side nozzle length NLd and upstream-side nozzle length NLu in the basic dot pattern data DPD to NLd(0) and NLu(0), respectively, and sets the downstream-side nozzle length NLd and upstream-side nozzle length NLu in the dot pattern data DPDa for the target pass process to NLd(t) and NLu(t), respectively. Next, the CPU 110 generates line dot pattern data for the upstream-side nozzle length NLu(t) in the dot pattern data DPDa by thinning out the line dot pattern data for {NLu(0)-NLu(t)} lines from dot pattern data for lines in the upstream-side nozzle length NLu(0) in the basic dot pattern data DPD. Next, the CPU 110 generates line dot pattern data for lines in the downstream-side nozzle length NLd(t) in the dot pattern data DPDa by thinning out line dot pattern data for {NLd(0)-NLd(t)} lines from the line dot pattern data for the downstream-side nozzle length NLd(0) worth of lines in the basic dot pattern data DPD. Through this process, the CPU 110 generates the dot pattern data DPDa that includes dot pattern data for the number of lines corresponding to the active nozzle length UD in the target pass process (NLu(t)+NLd(t)).

In S115 the CPU 110 selects partial dot data corresponding to the target pass process from the dot data generated in S30 of FIG. 4. That is, the CPU 110 selects partial dot data PDo for a plurality of raster lines corresponding to the plurality of active nozzles in the target pass process. In S120 the CPU 110 generates pass data for the target pass process using the dot pattern data DPDa generated in S110 and the partial dot data PDo selected in S115.

FIGS. 8A-8C are explanatory diagrams illustrating the generation of pass data. FIG. 8A shows an example of dot pattern data DPDa for a target pass process. FIG. 8B shows an example of partial dot data PDo for the target pass process. FIG. 8C shows pass data PD generated on the basis of the dot pattern data DPDa of FIG. 8A and the partial dot data PDo of FIG. 8B. The plurality of values included in the dot pattern data DPDa have a one-on-one correspondence with the plurality of pixels values included in the partial dot data PDo. The CPU 110 generates the pass data by calculating the product of each pixel value in the dot pattern data DPDa with each corresponding pixel value in the partial dot data PDo and setting each pixel value in the pass data PD to the corresponding product. As a result, the value of each pixel in the partial dot data PDo for which dot formation is allowed in the dot pattern data DPDa is maintained at the same pixel value in the pass data PD. Pixel values in the partial dot data PDo for which dot formation is not allowed in the dot pattern data DPDa are set to "0" (i.e., "no dot") in the pass data PD regardless of the value of the pixel in the partial dot data PDo.

In S125 the CPU 110 determines whether the above process has been performed for all pass processes (i.e., the m pass processes). When there remain unprocessed pass processes (S125: NO), the CPU 110 returns to S105 and selects an unprocessed pass process to be the target pass process. When all pass processes have been processed (S125: YES), in S130 the CPU 110 generates print data by adding control data to the m sets of pass data generated above. Here, the control data includes the feed data FD indicating feed amounts for the m conveying processes performed prior to each of the m pass processes, and the route data RD indicating the conveying path. Through this process, the CPU 110 generates print data for controlling the printing mechanism 200 to execute a printing operation according to the type of print control (the normal control or the special control) selected in S15 of FIG. 4.

A-5. Printing Process

Next, a printing process using the printing mechanism 200 will be described. In S40 of FIG. 4, the CPU 110 prints an image on a sheet M by controlling the printing mechanism 200 to repeatedly and alternately execute the conveying process and pass process. In a single conveying process, the conveying mechanism 210 conveys the sheet M the feed amount specified in the feed data FD. In one pass process, the main scan mechanism 220 moves the print head 240 (see FIGS. 1 and 2) once in the main scanning direction (X direction) while the sheet M is stationary. In a single pass process, the head-driving circuit 230 (see FIG. 1) supplies the drive signal DS to the print head 240 based on the pass data to control the print head 240 to eject ink droplets from the plurality of nozzles NZ while the print head 240 is moving.

Figure 9A:
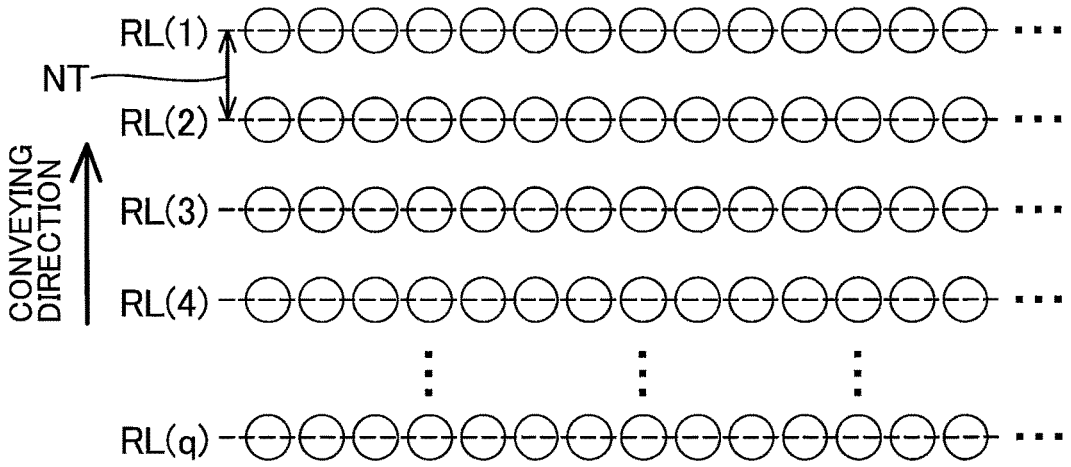
FIGS. 9A and 9B are explanatory diagrams illustrating four-pass printing.
Figure 9B:
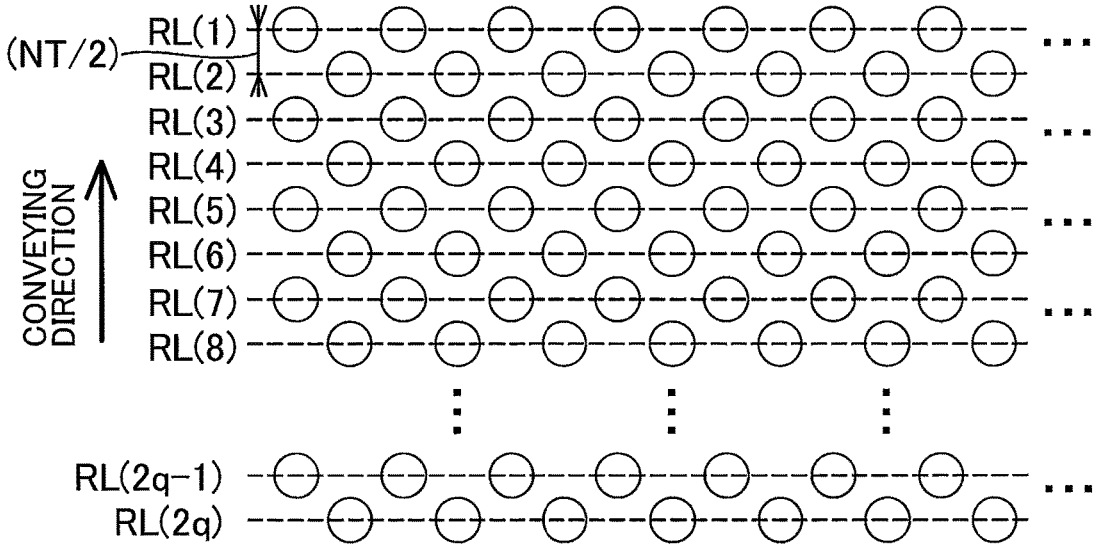

In the first embodiment, the CPU 110 executes four-pass printing, whereby four pass processes are used to print a partial region on the sheet M, such as a partial area whose width in the conveying direction is equivalent to the active nozzle length. FIGS. 9A and 9B are explanatory diagrams illustrating four-pass printing in the first embodiment. In the example of FIG. 9A, the CPU 110 executes four-pass printing using four of the m pass processes to print q raster lines RL(1)-RL(q) shown in FIG. 9A. In this example, the distance between two adjacent raster lines is equivalent to the nozzle pitch NT.

As an alternative, the CPU 110 may execute four-pass printing using two of the odd-numbered (m/2) pass processes to print the odd-numbered raster lines RL(1)-RL(2q−1) and using two of the even-numbered (m/2) pass processes to print the even-numbered raster lines RL(2)-RL(2q). The four-pass printing of FIG. 9B may be achieved by setting the feed amounts in conveying processes for the four-pass printing of FIG. 9A to half the nozzle pitch NT (NT/2). Thus, the distance between two adjacent raster lines in the four-pass printing of FIG. 9B is (NT/2). If L is the number of dots that can be formed in one raster line in the four-pass printing of FIG. 9A, the number of dots that can be formed in one raster line in the four-pass printing of FIG. 9B is (L/2).

The CPU 110 of the first embodiment can also perform borderless printing for printing in a printing area PA that extends to all four edges of a sheet M without leaving any margins on the edges.

A-5-1. Normal Control

Next, a printing process performed under the normal control will be described. The printing process will be separated into a printing process for printing from the downstream edge to the middle section and a printing process for printing from the middle section to the upstream edge.

Printing from Downstream Edge to Middle Section

Figure 10:
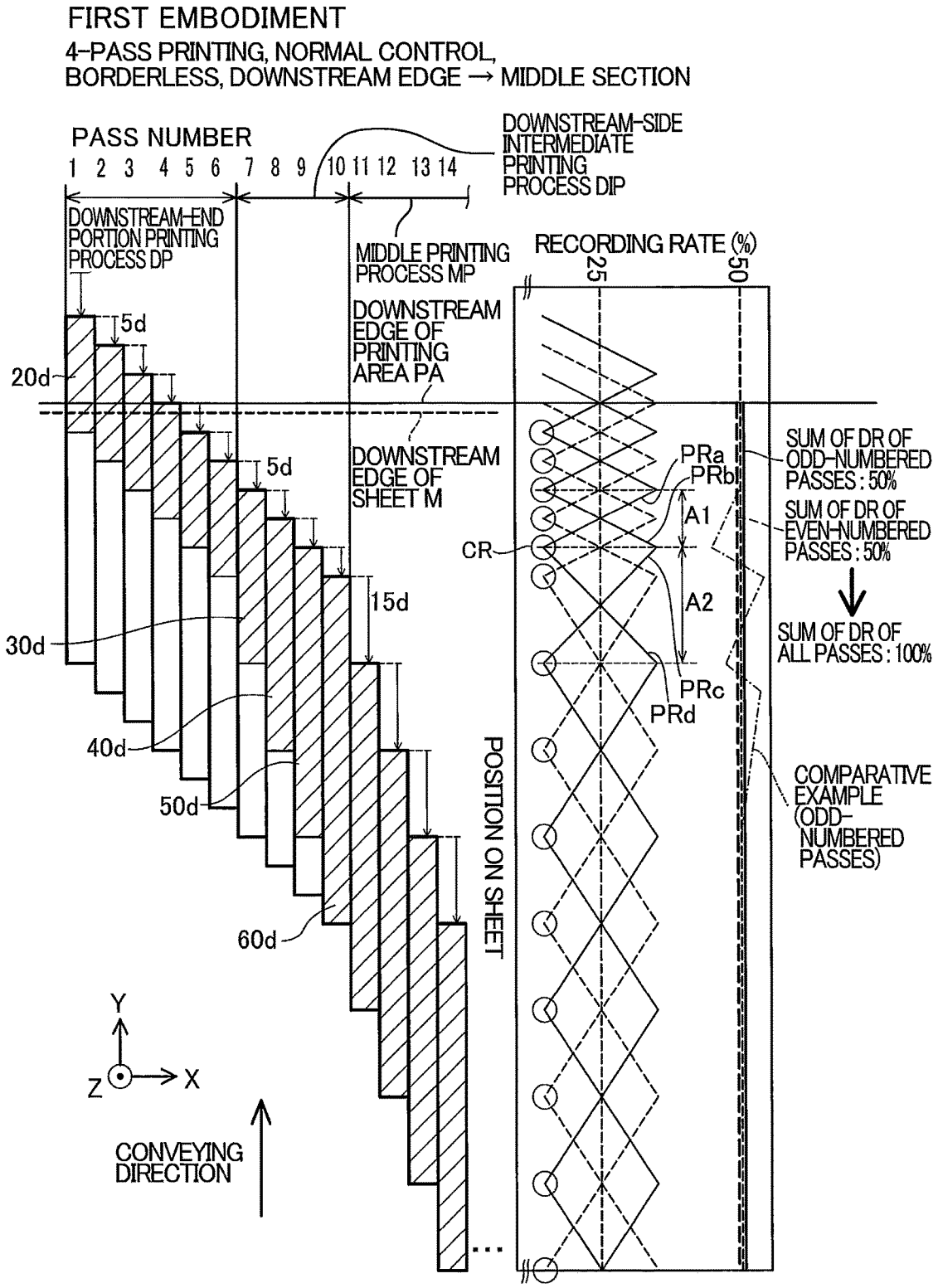
FIG. 10 is an explanatory diagram showing positions of the print head when printing from the downstream edge to the middle section of a sheet in a normal control according to a first embodiment.

FIG. 10 shows the position of the print head (hereinafter called the "head position") for each pass process when the CPU 110 is printing the region of the sheet M from the downstream edge to the middle section in the conveying direction (hereinafter simply called the "middle section"). Each head position indicates the position of the print head 240 in the conveying direction when the downstream edge of the sheet M is at the position depicted by a dashed line in FIG. 10. A border indicating each head position has a length in the conveying direction equivalent to the length in the conveying direction of the nozzle area NA on the print head 240, i.e., the total nozzle length D. The head positions correspond to pass processes having pass numbers 1-14 indicated in the top of the drawing. The pass processes with pass numbers 1-14 in FIG. 10 are the first through fourteenth pass processes performed at the beginning of the printing process. A $s^{th}$ (where s is an integer of 1 or greater) pass process is represented as pass process P(s).

Note that the first (s=1) conveying process is the process for conveying the sheet M to its initial position, i.e., the process for conveying the sheet M to its position for the first pass process. The $s^{th}$ ($2 \leq s \leq m$) conveying process is the conveying process executed between the $(s-1)^{th}$ pass process and the $s^{th}$ pass process. The $s^{th}$ conveying process is expressed as conveying process F(s). As shown in FIG. 10, the feed amount in conveying processes F(2)-F(10) is 5 d, and the feed amount in conveying processes F(11)-F(14) is 15 d. Here, the length d is $1/60^{th}$ of the total nozzle length D (D=60 d). As is clear from FIG. 10, the head position moves relative to the sheet M in the direction opposite the conveying direction (−Y direction) each time the conveying process is executed.

Since the printer 600 according to the first embodiment executes borderless printing, as described above, the printing area PA is a region slightly larger than the sheet M. Accordingly, the downstream edge of the printing area PA is positioned slightly downstream from the downstream edge of the sheet M in FIG. 10.

Areas filled with hatching marks within the borders denoting head positions in FIG. 10 indicate the active nozzle region in which the active nozzles are positioned, i.e., the active nozzles NZ formed in the print head 240. The length in the conveying direction of this active nozzle region having hatching marks denotes the active nozzle length. Values attached to the active nozzle regions (such as 20 d and 30 d) indicate the active nozzle length. A longer active nozzle length signifies a greater number of active nozzles. Note that while the graded recording rate DR described above is specified for active nozzles in pass processes P(1)-P(3) that are downstream from the downstream edge of the printing area PA, dot data assigned to these nozzles indicates that dots are not to be formed. Accordingly, nozzles downstream from the downstream edge of the printing area PA do not actually form dots.

Figure 11:
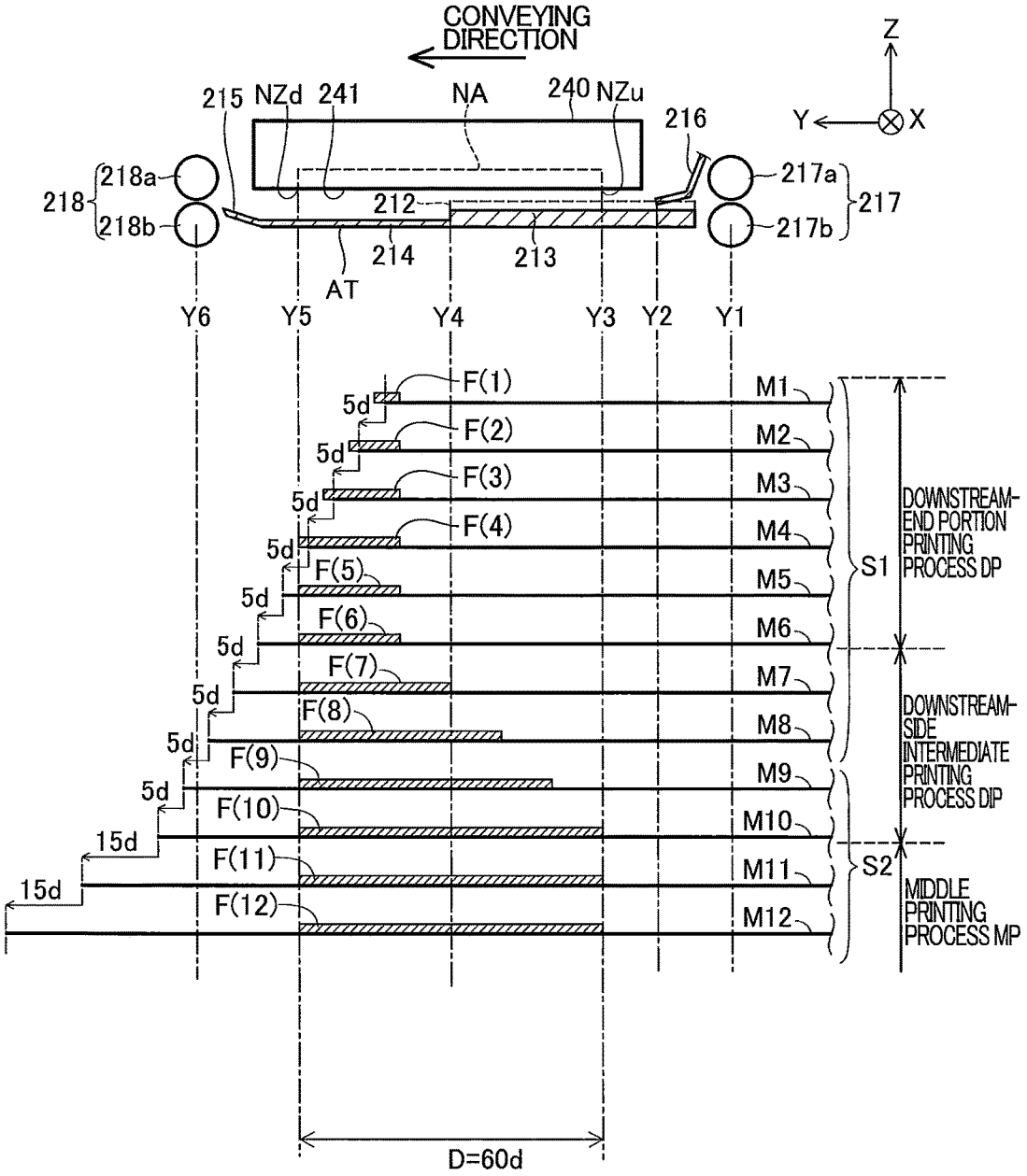
FIG. 11 is an explanatory diagram showing positions of the sheet when printing from the downstream edge to the middle section of the sheet in the normal control according to the first embodiment.

FIG. 11 shows the position of the sheet M in relation to the print head 240 for each pass process when printing the area from the downstream edge of the sheet M to the middle section. As can be seen in FIG. 11, each time a conveying process is executed, the sheet M is moved in the conveying direction (+Y direction) relative to the print head 240. The position of a sheet Ms in FIG. 11 denotes the position of the sheet M when executing the $s^{th}$ pass process. Thus, sheets M1-M12 in FIG. 11 denote twelve positions of the sheet M corresponding to pass processes P(1)-P(12). Regions on sheets M1-M12 with hatching marks in FIG. 11 denote the printing regions on the sheet that are printed in the corresponding pass process. Regions with hatching marks in FIG. 11 correspond to the positions of the active nozzles depicted by hatching marks in FIG. 10.

Positions Y1 and Y6 in FIG. 11 denote positions in the conveying direction at which the sheet is held by the upstream rollers 217 and the downstream rollers 218, respectively. Position Y2 denotes the position in the conveying direction at which the sheet is held between the high support members 212 and the pressing members 216. In this description, the upstream rollers 217, high support members 212, and pressing members 216 that hold sheets at positions Y2 and Y1 on the upstream side of the print head 240 will be collectively called the upstream-side holding unit. The downstream rollers 218 that hold sheets at the Y6 on the downstream side of the print head 240 will be called the downstream-side holding unit. The upstream-side holding unit is a member for holding sheets on the upstream side of the print head 240, while the downstream-side holding unit is a member for holding sheets on the downstream side of the print head 240.

Positions Y3 and Y5 are the positions in the conveying direction of the upstream nozzles NZu and downstream nozzles NZd, respectively, formed in the print head 240. Position Y4 is the position of the downstream ends of the high support members 212 and low support members 213.

The CPU 110 begins printing the sheet M from the downstream end thereof in sequence as the sheet M is conveyed in the conveying direction. After printing the region near the downstream edge of the sheet M, the CPU 110 executes printing in the middle section of the sheet M.

The process for printing the area near the downstream edge of the sheet M from the beginning of the printing operation (i.e., the start of conveying process F(1) to the pass process P(6) will be called the downstream-end-portion printing process DP (see FIG. 10). As shown in FIG. 11, the sheet M is held by the upstream rollers 217 and between the high support members 212 and pressing members 216 during the downstream-end-portion printing process DP. The sheet M is not held by the downstream rollers 218 at this time. This held state will be called "held state S1" (see FIG. 11). The downstream-end-portion printing process DP includes pass processes P(1)-P(6) employing an active nozzle length of 20 d, and conveying processes F(2)-F(6) with a feed amount of 5 d executed when the sheet M is in the held state S1.

In the downstream-end-portion printing process DP, some ink droplets are ejected on at a position downstream of the downstream edge of the sheet M in order to perform borderless printing, as described above. When ink droplets ejected at a position downstream from the downstream edge of the sheet M becomes deposited on the high support members 212 and the low support members 213 supporting sheets M, the ink droplets can potentially become deposited on and soil the sheets M. Therefore, nozzles capable of ejecting ink droplets at a position downstream from the downstream edge of the sheet M are preferably nozzles that oppose the non-supporting part AT, which does not support the sheets, so that ink does not become deposited on the high support members 212 and the low support members 213. Accordingly, the nozzles within the active nozzle length of 20 d that are used for the downstream-end-portion printing process DP constitute a portion of the nozzles on the downstream side in the conveying direction. That is, the active nozzle length worth of nozzles used in the downstream-end-portion printing process DP include the downstream nozzle NZd but not the upstream nozzle NZu.

The process of printing the middle section of a sheet beginning from conveying process F(11) will be called the middle printing process MP (see FIG. 10). As shown in FIG. 11, a sheet being printed during the middle printing process MP is held by the upstream rollers 217, between the high support members 212 and pressing members 216, and also by the downstream rollers 218. This held state will be called "held state S2" (see FIG. 11). The middle printing process MP includes pass processes P(11)-P(14) employing an active nozzle length of 60 d (see FIG. 10), and conveying processes F(11)-F(14) with the feed amount 15 d that are executed while the sheet M is in the held state S2. The feed amount 15 d used in the middle printing process MP is one-fourth the total nozzle length D and is the uniform feed amount for four-pass printing. The uniform feed amount is the maximum feed amount that can be used when executing multi-pass printing such as four-pass printing with uniform feeding, that is, a uniform feed amount that can be performed when executing multi-pass printing using all nozzles within the total nozzle length D.

Thus, all nozzles across the total nozzle length D (60 d) serve as active nozzles in the pass processes P(11)-P(14) in the middle printing process MP. In other words, pass processes performed in the middle printing process MP use a group of nozzles that include: nozzles formed in positions confronting the non-supporting part AT in the Z direction; and nozzles formed in positions confronting the high support members 212 and the low support members 213 in the Z direction.

Since the downstream rollers 218 do not hold the sheet in the held state S1 during the downstream-end-portion printing process DP, conveying precision in the held state S1 is lower than in the held state S2 during the middle printing process MP. Hence, a feed amount of 5 d, smaller than the feed amount of 15 d used in the conveying processes F(11)-F(14) of the middle printing process MP, is used in the conveying processes F(2)-F(6) of the downstream-end-portion printing process DP executed in the held state S1 in order to suppress positional deviations in raster lines caused by irregular feed amounts. Accordingly, the active nozzle length 20 d for the pass processes P(1)-P(6) in the downstream-end-portion printing process DP is shorter than the active nozzle length 60 d in the pass processes P(11)-P(14) of the middle printing process MP. In other words, the active nozzles in the pass processes P(1)-P(6) of the downstream-end-portion printing process DP are fewer than the number of active nozzles in the pass processes P(11)-P(14) of the middle printing process MP.

The printing process performed between the downstream-end-portion printing process DP and middle printing process MP, and specifically the printing process performed from the conveying process F(7) to the pass process P(10) in the first embodiment will be called a downstream-side intermediate printing process DIP. The active nozzle lengths 30 d, 40 d, 50 d, and 60 d respectively used in the pass processes P(7)-P(10) of the downstream-side intermediate printing process DIP are all longer than the active nozzle length 20 d used in the downstream-end-portion printing process DP and less than or equal to the active nozzle length 60 d used in the middle printing process MP (see FIG. 10). In other words, the number of active nozzles used in the pass processes P(7)-P(10) in the downstream-side intermediate printing process DIP is larger than the number of active nozzles in the downstream-end-portion printing process DP and less than or equal to the number of active nozzles used in the middle printing process MP.

Thus, in each succeeding pass process (i.e., as the pass number increases), the active nozzle length in the four pass processes P(7)-P(10) increases by a uniform amount from the active nozzle length used in the previous pass process, and specifically increases by a length of 10 d. More specifically, the nozzle on the downstream end of the active nozzles used in the pass processes P(7)-P(10) remains the same (the downstream nozzle NZd) while the nozzle on the upstream end of the active nozzles is sequentially moved upstream by 10 d each time the pass number increases. In other words, the number of active nozzles in the four pass processes P(7)-P(10) increases by an equal amount, and specifically by the number of nozzles in a length of 10 d, in each succeeding pass process. This 10 d amount of increase in the active nozzle length during the downstream-side intermediate printing process DIP for four-pass printing is a value obtained by dividing the difference 40 d between the active nozzle length 60 d used in the middle printing process MP and the active nozzle length 20 d used in the downstream-end-portion printing process DP by 4.

During the middle printing process MP, the held state of the sheet transitions from the held state S1 to the held state S2 during the execution of conveying process F(9), as illustrated in FIG. 11. Accordingly, the conveying processes F(7) and F(8) are performed while the sheet is in the held state S1, and conveying process F(10) is performed while the sheet is in the held state S2.

FIG. 12 shows the graded recording rates for pass processes when printing from the downstream edge to the middle section of a sheet. Solid lines in graphs (A)-(E) in FIG. 12 denote the graded recording rates used in the first embodiment, and dashed lines in graphs (B)-(D) in FIG. 12 denote the graded recording rates in a comparative example for pass processes P(7)-P(9) in the downstream-side intermediate printing process DIP. In the graded recording rates of the comparative example, the upstream-side nozzle length NLu and downstream-side nozzle length NLd are equivalent. In other words, the upstream-side gradient θu is equivalent to the downstream-side gradient θd in the graded recording rates of the comparative example. Note that the graded recording rate for a pass process P(s) is expressed as the graded recording rate DR(s).

The graded recording rates DR(1)-DR(6) for the pass processes P(1)-P(6) in the downstream-end-portion printing process DP are defined for nozzles within the active nozzle length 20 d, as illustrated in the graph (A) in FIG. 12. The upstream-side nozzle length NLu and downstream-side nozzle length NLd are both 10 d in graded recording rates DR(1)-DR(6) (NLu=NLd=10 d). Therefore, the upstream-side gradient θu and the downstream-side gradient θd are equivalent to each other in the graded recording rates DR(1)-DR(6).

Graded recording rates DR(11)-DR(14) for the pass processes P(11)-P(14) in the middle printing process MP are defined for nozzles within an active nozzle length of 60 d, i.e., over the total nozzle length D, as illustrated in the graph (E) in FIG. 12. The upstream-side nozzle length NLu and downstream-side nozzle length NLd for the graded recording rates DR(11)-DR(14) are both 30 d (NLu=NLd=30 d). Accordingly, the upstream-side gradient θu and downstream-side gradient θd are equivalent to each other in the graded recording rates DR(11)-DR(14). Further, the upstream-side nozzle length NLu and downstream-side nozzle length NLd for the graded recording rates DR(11)-DR(14) are longer for the graded recording rates DR(1)-DR(6) used in the downstream-end-portion printing process DP shown in the graph (A) in FIG. 12. Consequently, the upstream-side gradient θu and downstream-side gradient θd in the graded recording rates DR(11)-DR(14) are smaller than those in the graded recording rates DR(1)-DR(6). As shown in the graph (E) in FIG. 12, the graded recording rates DR(11)-DR(14) are identical to the graded recording rates DR in the basic dot pattern data DPD of FIG. 7B).

As shown in the graphs (B) and (C) in FIG. 12, the graded recording rates DR(7) and DR(8) for the two initial pass processes P(7) and P(8) of the downstream-side intermediate printing process DIP define nozzles within respective active nozzle lengths of 30 d and 40 d, which are longer than the active nozzle length of 20 d used in pass processes P(1)-P(6) by 10 d and 20 d, respectively.

The downstream-side nozzle length NLd used in the graded recording rates DR(7) and DR(8) is equivalent to the downstream-side nozzle length NLd used in the graded recording rates DR(1)-DR(6) shown in the graph (A) in FIG. 12. Hence, the downstream-side gradient θd in the graded recording rates DR(7) and DR(8) is equivalent to the downstream-side gradient θd in the graded recording rates DR(1)-DR(6).

The upstream-side nozzle lengths NLu in the graded recording rates DR(7) and DR(8) are 20 d and 30 d, respectively, which are longer than the upstream-side nozzle length NLu in the graded recording rates DR(1)-DR(6) in the graph (A) in FIG. 12 (that is, 10 d) by 10 d and 20 d, respectively. Hence, the upstream-side gradients θu in the graded recording rates DR(7) and DR(8) are smaller than the upstream-side gradient θu in the graded recording rates DR(1)-DR(6). Further, the upstream-side gradient θu for the graded recording rate DR(8) is smaller than the upstream-side gradient θu for the graded recording rate DR(7).

The upstream-side nozzle length NLu for the graded recording rate DR(7) is shorter than the upstream-side nozzle length NLu for the graded recording rates DR(11)-DR(14) shown in the graph (E) in FIG. 12 for the middle printing process MP. Hence, the upstream-side gradient θu for the graded recording rate DR(7) is greater than the upstream-side gradient θu for the graded recording rates DR(11)-DR(14). The upstream-side nozzle length NLu for the graded recording rate DR(8) is equivalent to the upstream-side nozzle length NLu for the graded recording rates DR(11)-DR(14). Hence, the upstream-side gradient θu for the graded recording rate DR(8) is the same as the upstream-side gradient θu for the graded recording rates DR(11)-DR(14).

In the graded recording rates DR(7) and DR(8), the upstream-side nozzle length NLu is longer than the downstream-side nozzle length NLd. Hence, the upstream-side gradient θu is smaller than the downstream-side gradient θd for the graded recording rates DR(7) and DR(8). Accordingly, the maximum recording rate nozzle for the graded recording rates DR(7) and DR(8) is positioned downstream from the center position of the active nozzles in the conveying direction, as is clear when contrasted with the comparative example indicated with a dashed line in the graphs (B) and (C) of FIG. 12.

As shown in the graphs (D) and (E) of FIG. 12, the graded recording rates DR(9) and DR(10) for the two final pass processes P(9) and P(10) in the downstream-side intermediate printing process DIP define nozzles over active nozzle lengths of 50 d and 60 d, respectively, which are longer than the active nozzle length 40 d for pass process P(8) by 10 d and 20 d, respectively.

The downstream-side nozzle lengths NLd for the graded recording rates DR(9) and DR(10) are 20 d and 30 d, respectively, which are greater than the downstream-side nozzle length NLd (10 d) for the graded recording rates DR(1)-DR(6) in the graph (A) of FIG. 12 and the graded recording rates DR(7) and DR(8) in the graphs (B) and (C) of FIG. 12 by 10 d and 20 d, respectively. Accordingly, the downstream-side gradient θd for the graded recording rates DR(9) and DR(10) is smaller than the downstream-side gradient θd for the graded recording rates DR(1)-DR(8). Further, the downstream-side gradient θd for the graded recording rate DR(10) is smaller than the downstream-side gradient θd for the graded recording rate DR(9).

The downstream-side nozzle length NLd for the graded recording rate DR(10) is equivalent to the downstream-side nozzle length NLd (30 d) for the graded recording rates DR(11)-DR(14) in the pass processes P(11)-P(14) of the middle printing process MP. Accordingly, the downstream-side gradient θd for the graded recording rate DR(10) is equivalent to the downstream-side gradient θd for the graded recording rates DR(11)-DR(14).

The upstream-side nozzle length NLu for the graded recording rates DR(9) and DR(10) is equivalent to the upstream-side nozzle length NLu (30 d) for the graded recording rate DR(8) in the graph (C) of FIG. 12 and the graded recording rates DR(11)-DR(14) in the graph (E) of FIG. 12. Accordingly, the upstream-side gradients θu for the graded recording rates DR(9) and DR(10) are equivalent to the upstream-side gradients θu for the graded recording rates DR(8) and DR(11)-DR(14).

In the graded recording rate DR(9), the upstream-side nozzle length NLu is longer than the downstream-side nozzle length NLd. Hence, upstream-side gradient θu is smaller than downstream-side gradient θd for the graded recording rate DR(9). Thus, the maximum recording rate nozzle in the graded recording rate DR(9) is positioned downstream of the center position of the active nozzles in the conveying direction, as is clear when contrasted with the comparative example indicated by a dashed line in the graph (D) of FIG. 12.

As shown in the graph (E) of FIG. 12, the graded recording rate DR(10) for the final pass process P(10) in the downstream-side intermediate printing process DIP is identical to the graded recording rate DR(11) for the initial pass process P(11) in the middle printing process MP.

When viewed from the perspective of the upstream-side nozzle length NLu and the downstream-side nozzle length NLd as described above, the graded recording rates DR(6)-DR(10) from the final pass process P(6) in the downstream-end-portion printing process DP to the final pass process P(10) in the downstream-side intermediate printing process DIP change in each succeeding pass process as follows. For the first two increases in pass number, the upstream-side nozzle length NLu is increased by 10 d while the downstream-side nozzle length NLd does not change. As a result, the upstream-side nozzle length NLu is increased to the upstream-side nozzle length NLu used in the graded recording rates DR(11)-DR(14) in the middle printing process MP. For the subsequent two increases in pass number, the downstream-side nozzle length NLd is increased by 10 d while the upstream-side nozzle length NLu does not change. As a result, the downstream-side nozzle length NLd is increased to the downstream-side nozzle length NLd used for the graded recording rates DR(11)-DR(14) in the middle printing process MP. Through this process, the upstream-side nozzle length NLu and the downstream-side nozzle length NLd in the graded recording rate DR(10) for the final pass process P(10) in the downstream-side intermediate printing process DIP are set equivalent to the upstream-side nozzle length NLu and the downstream-side nozzle length NLd in the graded recording rates DR(11)-DR(14) for the middle printing process MP, respectively.

As described above, the downstream-side intermediate printing process DIP includes the two pass processes P(7) and P(8) using the graded recording rates DR(7) and DR(8) whose upstream-side nozzle length NLu is longer than that in the downstream-end-portion printing process DP and whose downstream-side nozzle length NLd is identical to that in the downstream-end-portion printing process DP, and two pass processes P(9) and P(10) using the graded recording rates DR(9) and DR(10) executed after the pass processes P(7) and P(8) whose upstream-side nozzle length NLu is identical to that used in the middle printing process MP and whose downstream-side nozzle length NLd is greater than that used in the downstream-end-portion printing process DP. Hence, the upstream-side nozzle length NLu in the graded recording rates DR(7) and DR(8) used in the two pass processes P(7) and P(8) increases sequentially as the pass number increases, and the downstream-side nozzle length NLd in the graded recording rates DR(9) and DR(10) used in the two pass processes P(9) and P(10) increases sequentially as the pass number increases.

From the perspective of the upstream-side gradient θu and downstream-side gradient θd, the graded recording rates DR(6)-DR(10) change as follows as the pass number increases. For the first two increases in pass number, the upstream-side gradient θu increases while the downstream-side gradient θd remains unchanged, with the upstream-side gradient θu becoming equal to the upstream-side gradient θu in the initial pass process P(11) of the middle printing process MP. For the subsequent two increases in pass number, the downstream-side gradient θd decreases while the upstream-side gradient θu remains unchanged such that the downstream-side gradient θd becomes equal to the downstream-side gradient θd in the initial pass process P(11) of the middle printing process MP. As a result, the upstream-side gradient θu and the downstream-side gradient θd in the final pass process P(10) of the downstream-side intermediate printing process DIP become equal to the upstream-side gradient θu and the downstream-side gradient θd in the initial pass process P(11) of the middle printing process MP, respectively.

Thus, the downstream-side intermediate printing process DIP includes the two pass processes P(7) and P(8) using the graded recording rates DR(7) and DR(8) whose upstream-side gradient θu is smaller than that in the downstream-end-portion printing process DP and whose downstream-side gradient θd is the same as that in the downstream-end-portion printing process DP, and the two pass processes P(9) and P(10) executed after the pass processes P(7) and P(8) using the graded recording rates DR(9) and DR(10) whose upstream-side gradient θu is the same as that in the middle printing process MP and whose downstream-side gradient θd is smaller than that in the downstream-end-portion printing process DP. Hence, the upstream-side gradient θu of the graded recording rates DR(7) and DR(8) used in the two pass processes P(7) and P(8) grows sequentially smaller as the pass number increases, and the downstream-side gradient θd of the graded recording rates DR(9) and DR(10) used in the two pass processes P(9) and P(10) gradually decreases as the pass number increases.

By using the graded recording rates described above, the printing process under the normal control according to the first embodiment can suppress banding caused by irregularities in sheet-feeding amounts, without giving rise to irregularities in printing density.

Next, the graded recording rates for pass processes performed from the downstream edge to the middle section of sheets will be described in greater detail with reference to FIG. 10. The right side in FIG. 10 indicates the graded recording rate for the head position in each pass process of FIG. 10. Graded recording rates depicted in solid lines on the right side of FIG. 10 are the graded recording rates for pass processes having odd-numbered pass numbers (hereinafter called "odd-numbered passes"), while the graded recording rates depicted in dashed lines denote graded recording rates for pass processes having even-numbered pass numbers (hereinafter called "even-numbered passes").

Each circle CR on the right side in FIG. 10 encircles a position on the sheet M in the conveying direction at which a nozzle NZ on the downstream end of the active nozzles for one pass process and a nozzle NZ on the upstream end of the active nozzles for another pass process are located. Thus, irregularities in the distance between raster lines are most likely to occur at positions encircled by circles CR due to irregularities in feed amounts. Consequently, positions encircled by circles CR are more susceptible to banding. Since a graded recording rate is used in the first embodiment, the percentage of dots formed by the nozzle NZ on the downstream end of active nozzles in one pass process and by the nozzle NZ on the upstream end of the active nozzles in another pass process is low at positions encircled by circles CR. Thus, the first embodiment can suppress banding caused by irregularities in sheet-feeding amounts by making banding at positions encircled by circles CR less noticeable.

As described above, the graded recording rates used in the first embodiment have specifically designed upstream-side and downstream-side gradients θu and θd and upstream-side and downstream-side nozzle lengths NLu and NLd. Thus, a portion PRa of the graded recording rate DR(5) for the pass process P(5) having the upstream-side gradient θu is positioned in the same section A1 depicted on the right side of FIG. 10 as a portion PRb of the graded recording rate DR(7) for the pass process P(7) having the downstream-side gradient θd, for example. These two portions PRa and PRb have an equivalent gradient (magnitude of slope) but a different direction of slope (growing smaller upstream or growing smaller downstream). Consequently, the sum of the graded recording rates DR at the two portions PRa and PRb is a constant value at all positions within the section A1. The same is true for a portion PRc of the graded recording rate DR(7) having the upstream-side gradient θu and positioned within a section A2 and a portion PRd of the graded recording rate DR(9) having the downstream-side gradient θd. While not shown in the drawings, these relationships are also true for graded recording rates of even-numbered passes (the dashed lines on the right side of FIG. 10). Hence, as indicated on the far right side of FIG. 10, the total value of graded recording rates DR for odd-numbered passes is maintained at a constant value (50%) irrespective of the position in the conveying direction, and the total value of graded recording rates DR for even-numbered passes is maintained at a constant value (50%) irrespective of the position in the conveying direction. Consequently, the total value of graded recording rates DR for all pass processes is also maintained at a constant value (100%) irrespective of the position in the conveying direction. Thus, the number of dots that can be printed in all raster lines can be maintained uniform irrespective of their positions in the conveying direction.

The total recording rate for odd-numbered passes when using the graded recording rates of the comparative example depicted by dashed lines in the graphs (B) and (C) of FIG. 12 is also indicated on the right side of FIG. 10. If these types of simple graded recording rates were to be used in the downstream-side intermediate printing process DIP, the total recording rate of odd-numbered passes would vary by position in the conveying direction rather than remain constant, as illustrated in FIG. 10. While not indicated in FIG. 10 to avoid complicating the drawing, the total value of recording rates for all pass processes is not constant since the total recording rate for odd-numbered passes is not uniform when using the graded recording rates of the comparative example. Consequently, the number of dots that can be printed in raster lines is not fixed in the region of transition from the downstream-end-portion printing process DP to the middle printing process MP in the comparative example, resulting in the occurrence of irregular densities in this region.

The downstream-side intermediate printing process DIP according to the first embodiment executed in the region of transition from the downstream-end-portion printing process DP to the middle printing process MP first reduces only the upstream-side gradient θu of the graded recording rate and subsequently reduces the downstream-side gradient θd. In other words, the downstream-side intermediate printing process DIP first increases only the upstream-side nozzle length NLu, and subsequently increases only the downstream-side nozzle length NLd. As a result of this process, the total value of recording rates in pass processes can be made to approach a constant. More specifically, the upstream-side nozzle length NLu is increased by equal amounts for two passes and subsequently the downstream-side nozzle length NLd is increased by equal amounts for two passes. As a result, the total value of recording rates for all pass processes can be made uniform. Since the number of dots that can be printed in each raster line is maintained uniform within the region of transition from the downstream-end-portion printing process DP to the middle printing process MP regardless of the position of the raster line in the conveying direction, this process suppresses the occurrence of irregular densities in this region. As is understood from the above description, this process suppresses banding caused by irregularities in sheet-feeding amounts, while not giving rise to irregularities in density. Further, since the total value of the graded recording rates DR for odd-numbered passes and the total value of the graded recording rates DR for even-numbered passes can be each be maintained at the same fixed value (50%) regardless of position in the conveying direction, this method can suppress banding caused by irregularities in sheet-feeding amounts without causing irregularities in density, even when executing four-pass printing illustrated in FIG. 9B in which odd-numbered raster lines are each printed in two odd-numbered passes and even-numbered raster lines are each printed in two even-numbered passes.

Further, the downstream-end-portion printing process DP is performed in the held state S1 (see FIG. 11) in which the sheet is held by the upstream-side holding unit (all of the upstream rollers 217, high support members 212, and pressing members 216 shown in FIG. 3A in the first embodiment), but is not held by the downstream-side holding unit (the downstream rollers 218 in FIG. 3A in the first embodiment). Further, the middle printing process MP is performed when the sheet is in the held state S2 (see FIG. 11) in which the sheet is held by both the upstream-side and downstream-side holding units. Thus, this method can reduce irregularities in printing density for regions printed during the transition between these sheet-conveying states, i.e., during the transition from the held state S1 to the held state S2.

In the first embodiment, the active nozzles in the downstream-end-portion printing process DP (see FIG. 10 and the graph (A) of FIG. 12) include nozzles formed at positions opposing the non-supporting part AT (the downstream nozzle NZd, for example) and do not include nozzles formed at positions opposing the support members 212 and 213 (the upstream nozzle NZu, for example). Further, the active nozzles in the middle printing process MP (see FIG. 10 and the graph (E) of FIG. 12) include both nozzles formed at positions opposing the support members 212 and 213 and nozzles formed at positions opposing the non-supporting part AT. As described above, the pass processes P(7)-P(10) in the downstream-side intermediate printing process DIP gradually increase the number of active nozzles by gradually shifting the position for the upstream end of the active nozzles upstream. This method restrains ink from becoming deposited on the support members 212 and 213 when performing borderless printing during the downstream-end-portion printing process DP on the downstream edge of the sheet, thereby preventing the sheet M from becoming soiled.

Printing from Middle Section to Upstream Edge

Figure 13:
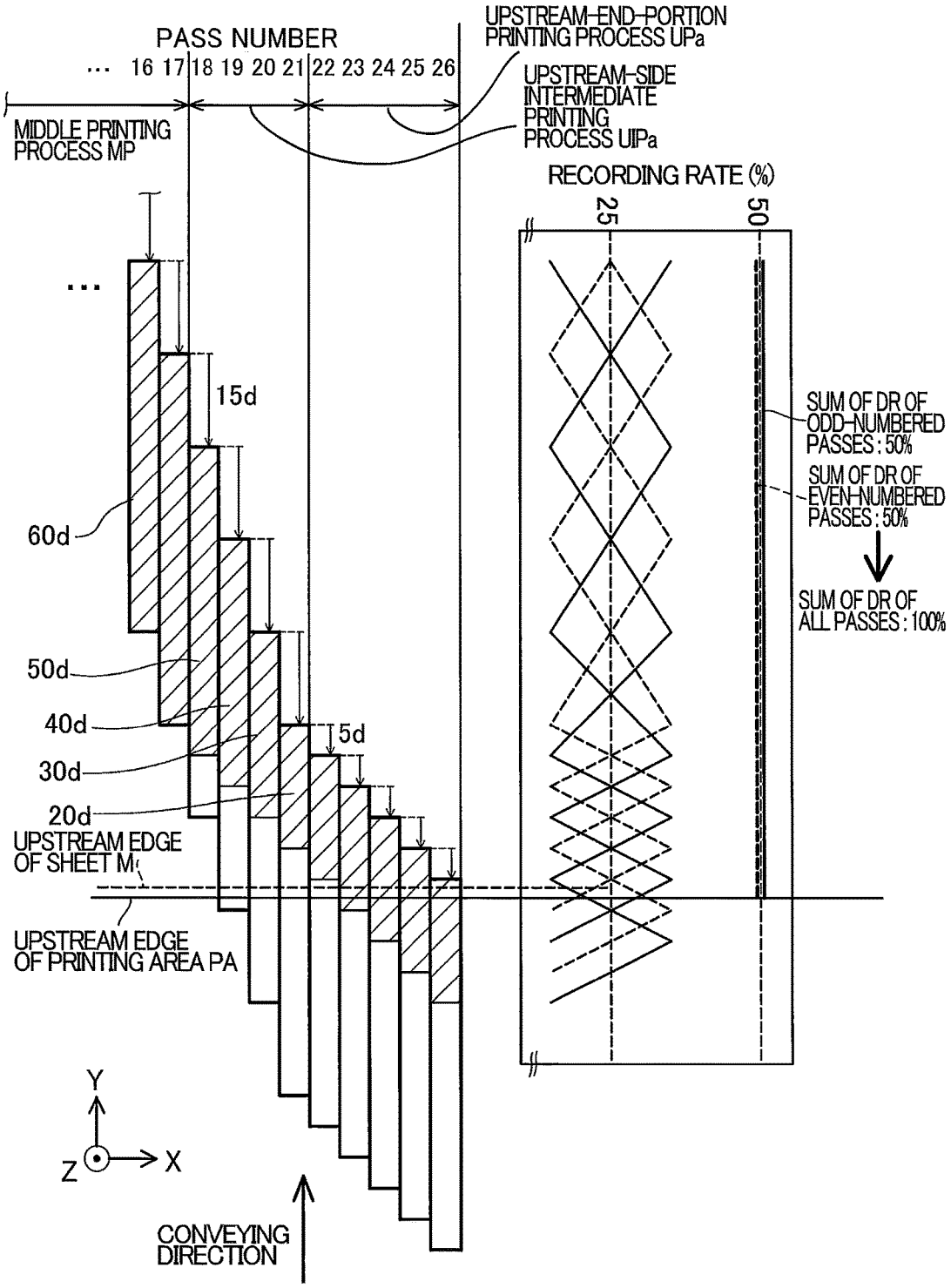
FIG. 13 is an explanatory diagram showing the positions of the print head when printing from the middle section to an upstream edge of the sheet in the normal control according to the first embodiment.

FIG. 13 shows the head position for each pass process performed under the normal control when printing the area of the sheet M from the middle section to the upstream edge. Each head position denotes the position of the print head 240 in the conveying direction when the upstream edge of the sheet M is positioned at the dashed line shown in FIG. 13. The head position corresponds to pass processes P(16)-P(26) having pass numbers 16-26 provided at the top of the drawing.

As shown in FIG. 13, the feed amount for conveying processes F(16)-F(21) is 15 d, while the feed amount for conveying processes F(22)-F(26) is 5 d.

Since the printer 600 according to the first embodiment can execute borderless printing as described above, the upstream edge of the printing area PA shown in FIG. 13 is positioned slightly upstream from the upstream edge of the sheet M.

As in FIG. 10, areas with hatching marks within borders specifying each head position in FIG. 13 denote the active nozzle regions in which the active nozzles are positioned. Values attached to the active nozzle regions (20 d and 30 d, for example) indicate the active nozzle lengths. While the graded recording rate DR described above is defined for nozzles upstream from the upstream edge of the printing area PA for the active nozzles in the pass processes P(23)-P(26), the dot data assigned to these nozzles specifies that dots are not formed. Accordingly, nozzles positioned upstream from the upstream edge of the printing area PA do not actually form dots.

Figure 14:
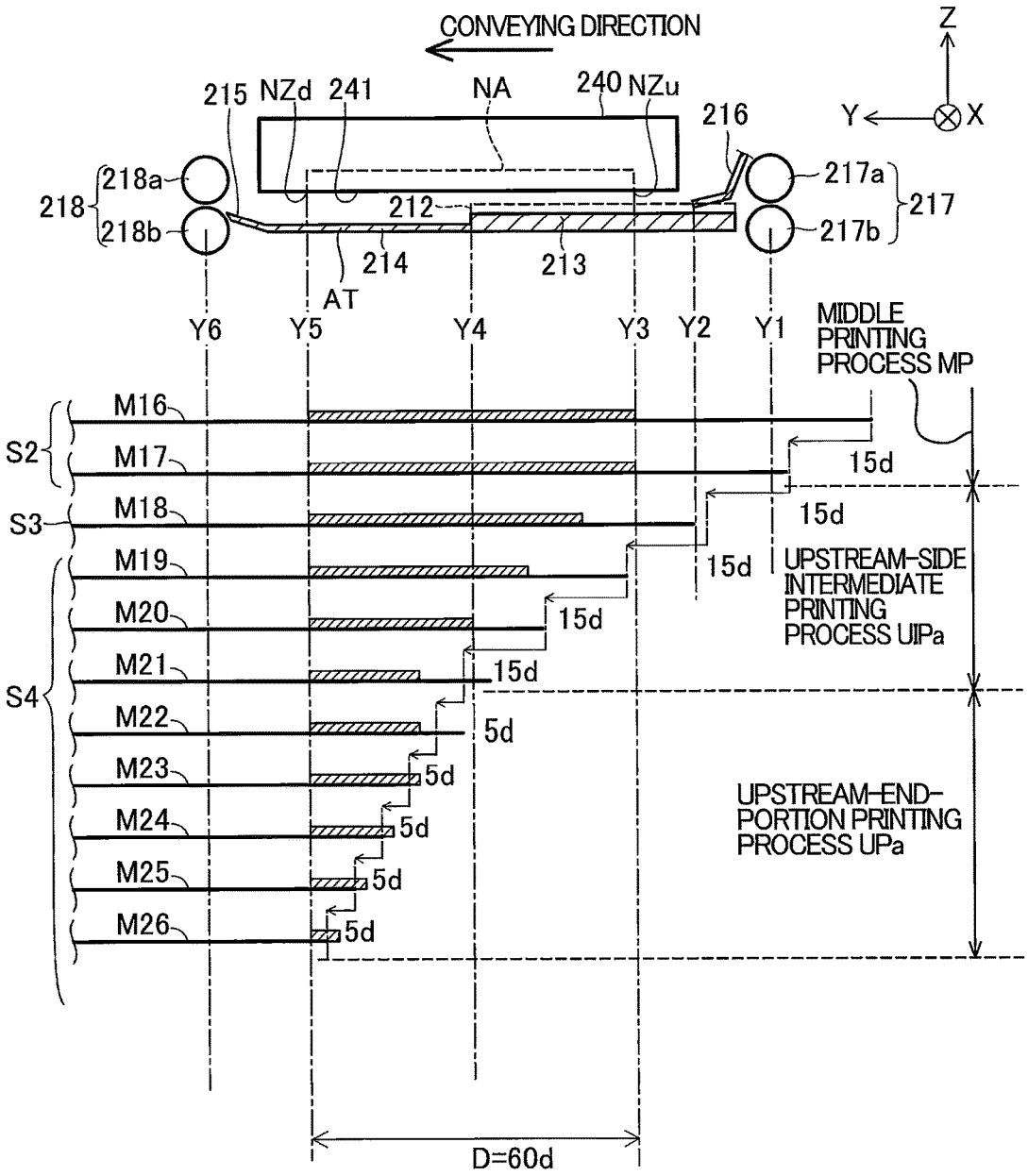
FIG. 14 is an explanatory diagram showing the positions of the sheet when printing from the middle section to the upstream edge of the sheet in the normal control according to the first embodiment.

FIG. 14 shows the position of the sheet M in relation to the print head 240 for each pass process when printing the region from the middle section of the sheet M to the upstream edge of the sheet M under the normal control. Sheets M16-M26 shown in FIG. 14 indicate the eleven positions of a sheet that correspond to the pass processes P(16)-P(26). As in FIG. 11, areas with hatching marks on the sheets M16-M26 in FIG. 14 denote printing regions on the sheet that are printed in the corresponding pass processes.

After printing the middle section of the sheet M being conveyed in the conveying direction, the CPU 110 executes a printing operation on the region near the upstream edge of the sheet M. Pass process P(17) in FIG. 13 is the last pass process of the middle printing process MP.

The process for printing the area near the upstream edge of the sheet M from the conveying process F(22) to the last pass process P(26) under the normal control will be called the upstream-end-portion printing process UPa (see FIG. 13). During the upstream-end-portion printing process UPa, the sheet is not held by the upstream rollers 217 and is not held between the high support members 212 and pressing members 216, but is held by the downstream rollers 218, as illustrated in FIG. 14. This held state will be called "held state S4" (see FIG. 14). The upstream-end-portion printing process UPa includes pass processes P(22)-P(26) having an active nozzle length of 20 d, and conveying processes F(22)-F(26) having a feed amount of 5 d executed in the held state S4.

During the upstream-end-portion printing process UPa, ink droplets are also ejected at a position upstream from the upstream edge of the sheet M in order to implement borderless printing. If the ink ejected at the position upstream from the upstream edge of the sheet M becomes deposited on the support members 212 and 213 supporting the sheet M, this ink could potentially become deposited on and soil the sheet M. Therefore, nozzles capable of ejecting ink droplets upstream from the upstream edge of the sheet M are preferably nozzles opposing the non-supporting part AT, which does not support the sheet M, so that ink will not become deposited on the support members 212 and 213. As in the downstream-end-portion printing process DP, nozzles within an active nozzle length of 20 d that are used during the upstream-end-portion printing process UPa are the portion of nozzles on the downstream side in the conveying direction. In other words, the nozzles used in the upstream-end-portion printing process UPa include the downstream nozzle NZd but not the upstream nozzle NZu.

Since sheets in the held state S4 are not held by the downstream rollers 218, the high support members 212, the low support members 213, and the pressing members 216 during the upstream-end-portion printing process UPa, sheet-conveying precision is lower than in the held state S2 of the middle printing process MP. Therefore, a feed amount smaller than the 15 d used in the conveying processes F(16) and F(17) in the middle printing process MP, and specifically a feed amount of 5 d is used in the conveying processes F(22)-F(26) in the upstream-end-portion printing process UPa executed while the sheet M is in the held state S4 in order to suppress positional deviation of raster lines caused by irregularities in feed amounts. For this reason, the active nozzle length used in the pass processes P(22)-P(26) in the upstream-end-portion printing process UPa is shorter than the active nozzle length of 60 d used in the pass processes P(16) and P(17) in the middle printing process MP. Specifically, the active nozzle length used in the pass processes P(22)-P(26) is 20 d. Therefore, the number of active nozzles in the pass processes P(22)-P(26) in the upstream-end-portion printing process UPa is fewer than the number of active nozzles in the pass processes P(16) and P(17) in the middle printing process MP.

Under the normal control, the printing process performed between the middle printing process MP and the upstream-end-portion printing process UPa and specifically from the conveying process F(18) to the pass process P(21) in the first embodiment will be called the upstream-side intermediate printing process UIPa. The active nozzle lengths 50 d, 40 d, 30 d, and 20 d respectively used in pass processes P(18)-P(21) in the upstream-side intermediate printing process UIPa are all greater than or equal to the active nozzle length 20 d used in the upstream-end-portion printing process UPa and shorter than the active nozzle length 60 d used in the middle printing process MP (see FIG. 13). Thus, the number of active nozzles used in the pass processes P(18)-P(21) in the upstream-side intermediate printing process UIPa is greater than or equal to the number used in the upstream-end-portion printing process UPa and less than the number used in the middle printing process MP.

As this pass number increases in these four pass processes P(18)-P(21), the active nozzle length used in the pass process is reduced by a uniform length from the active nozzle length used in the previous pass process. Specifically, the active nozzle length is reduced sequentially by 10 d. More specifically, the nozzle on the downstream end of the active nozzles used in the pass processes P(18)-P(21) remains the same nozzle (the downstream nozzle NZd) while the nozzle defining the upstream end of the active nozzles moves sequentially downstream by 10 d in each succeeding pass process. In other words, the number of active nozzles used in the four pass processes P(18)-P(21) decreases by a uniform number, and specifically by the number of nozzles in a length 10 d in each succeeding pass process. In four-pass printing, a decrease in 10 d in the active nozzle length used in the upstream-side intermediate printing process UIPa is a value obtained by dividing the difference of 40 d between the active nozzle length of 60 d used in the middle printing process MP and the active nozzle length of 20 d used in the upstream-end-portion printing process UPa by 4.

As shown in the example of FIGS. 13 and 14, when the conveying process F(18) is executed during the middle printing process MP, the held state of the sheet transitions from the held state S2 to the held state S3. In the held state S3 the sheet is no longer held by the upstream rollers 217, but remains held between the high support members 212 and pressing members 216 and by the downstream rollers 218. Further, in the example of FIGS. 13 and 14, when the conveying process F(19) is executed during the upstream-side intermediate printing process UIPa, the held state of the sheet transitions from the held state S3 to the held state S4. Accordingly, the conveying processes F(20) and F(21) are performed while the sheet is in the held state S4.

FIG. 15 shows the graded recording rates for pass processes when printing the region from the middle section of the sheet M to the upstream edge under the normal control. As shown in the graph (A) of FIG. 15, the graded recording rates DR(16) and DR(17) in the middle printing process MP are the same as those described above with reference to the graph (E) of FIG. 12.

As shown in the graph (E) of FIG. 15, the graded recording rates DR(22)-DR(26) for the pass processes P(22)-P(26) in the upstream-end-portion printing process UPa are identical to the graded recording rates DR(1)-DR(6) in the downstream-end-portion printing process DP described with reference to the graph (A) of FIG. 12. In other words, the graded recording rates DR(22)-DR(26) regulate nozzles within an active nozzle length of 20 d. The upstream-side nozzle length NLu and downstream-side nozzle length NLd for the graded recording rates DR(22)-DR(26) are equivalent and equal to 10 d (NLu=NLd=10 d). Accordingly, the upstream-side gradient θu and downstream-side gradient θd are equivalent to each other in the graded recording rates DR(22)-DR(26).

As shown in graphs (B) and (C) of FIG. 15, the graded recording rates DR(18) and DR(19) for the first two pass processes P(18) and P(19) in the upstream-side intermediate printing process UIPa are defined for nozzles for respective active nozzle lengths 50 d and 40 d, which are shorter than the active nozzle length 60 d in the pass processes P(16) and P(17) by 10 d and 20 d, respectively.

The downstream-side nozzle length NLd for the graded recording rates DR(18) and DR(19) is equivalent to the downstream-side nozzle length NLd for the graded recording rates DR(16) and DR(17) shown in the graph (A) of FIG. 15. Therefore, the downstream-side gradient θd for the graded recording rates DR(18) and DR(19) is equivalent to the downstream-side gradient θd for the graded recording rates DR(16) and DR(17).

The upstream-side nozzle lengths NLu for the graded recording rates DR(18) and DR(19) are 20 d and 10 d, respectively, which are shorter than the upstream-side nozzle length NLu (30 d) for the graded recording rates DR(16) and DR(17) in the graph (A) of FIG. 15 by 10 d and 20 d, respectively. Therefore, the upstream-side gradients θu for the graded recording rates DR(18) and DR(19) are greater than the upstream-side gradient θu for the graded recording rates DR(16) and DR(17). The upstream-side gradient θu for the graded recording rate DR(19) is also greater than the upstream-side gradient θu for the graded recording rate DR(18).

The upstream-side nozzle length NLu for the graded recording rate DR(18) is longer than the upstream-side nozzle length NLu for the graded recording rates DR(22)-DR(26) in the upstream-end-portion printing process UPa shown in the graph (E) of FIG. 15. Therefore, the upstream-side gradient θu for the graded recording rate DR(18) is smaller than the upstream-side gradient θu for the graded recording rates DR(22)-DR(26) in the graph (E) of FIG. 15. The upstream-side nozzle length NLu for the graded recording rate DR(19) is equivalent to the upstream-side nozzle length NLu for the graded recording rates DR(22)-DR(26) in the graph (E) of FIG. 15. Therefore, the upstream-side gradient θu for the graded recording rate DR(19) is the same as the upstream-side gradient θu for the graded recording rates DR(22)-DR(26) in the graph (E) of FIG. 15.

In the graded recording rates DR(18) and DR(19), the upstream-side nozzle length NLu is shorter than the downstream-side nozzle length NLd. Accordingly, the upstream-side gradient θu is greater than the downstream-side gradient θd for the graded recording rates DR(18) and DR(19). The maximum recording rate nozzle in the graded recording rates DR(18) and DR(19) is positioned upstream from the center position of the active nozzles in the conveying direction.

As shown in the graphs (D) and (E) of FIG. 15, the graded recording rates DR(20) and DR(21) for the last two pass processes P(20) and P(21) in the upstream-side intermediate printing process UIPa are specified for nozzles within active nozzle lengths of 30 d and 20 d, respectively, which are shorter than the active nozzle length 40 d in pass process P(19) by 10 d and 20 d, respectively.

The downstream-side nozzle lengths NLd for the graded recording rates DR(20) and DR(21) are 20 d and 10 d, respectively, which are shorter than the downstream-side nozzle length NLd (30 d) for the graded recording rates DR(16) and DR(17) in the graph (A) of FIG. 15 and the graded recording rates DR(18) and DR(19) in the graphs (B) and (C) of FIG. 15 by 10 d and 20 d, respectively. Hence, the downstream-side gradients θd for the graded recording rates DR(20) and DR(21) are greater than the downstream-side gradient θd for the graded recording rates DR(16)-DR(19). Further, the downstream-side gradient θd for the graded recording rate DR(21) is greater than the downstream-side gradient θd for the graded recording rate DR(20).

The downstream-side nozzle length NLd of the graded recording rate DR(21) is equivalent to the downstream-side nozzle length NLd (10 d) of the graded recording rates DR(22)-DR(26) for the pass processes P(22)-P(26) in the upstream-end-portion printing process UPa. Accordingly, the downstream-side gradient θd for the graded recording rate DR(21) is identical the downstream-side gradient θd for the graded recording rates DR(22)-DR(26).

The upstream-side nozzle length NLu of the graded recording rates DR(20) and DR(21) is equivalent to the upstream-side nozzle length NLu (10 d) of the graded recording rate DR(19) in the graph (C) of FIG. 15 and the graded recording rates DR(22)-DR(26) in the graph (E) of FIG. 15. Accordingly, the upstream-side gradient θu of the graded recording rates DR(20) and DR(21) is equivalent to the upstream-side gradient θu of the graded recording rates DR(19) and DR(22)-DR(26).

In the graded recording rate DR(20), the upstream-side nozzle length NLu is shorter than the downstream-side nozzle length NLd. Therefore, the upstream-side gradient θu is greater than the downstream-side gradient θd in the graded recording rate DR(20). Thus, the maximum recording rate nozzle in the graded recording rate DR(20) is positioned upstream of the center position of the active nozzles in the conveying direction.

As shown in the graph (E) of FIG. 15, the graded recording rate DR(21) for the last pass process P(21) in the upstream-side intermediate printing process UIPa is equivalent to the graded recording rate DR(22) for the first pass process P(22) in the upstream-end-portion printing process UPa.

As is clear from the above description, from the viewpoint of the upstream-side nozzle length NLu and downstream-side nozzle length NLd, the graded recording rates DR(17)-DR(21) from the last pass process P(17) in the middle printing process MP to the last pass process P(21) in the upstream-side intermediate printing process UIPa changes as follows as the pass number increases. For the first two increases in pass number, the upstream-side nozzle length NLu is shortened by 10 d while the downstream-side nozzle length NLd does not change. As a result, the upstream-side nozzle length NLu becomes equivalent to the upstream-side nozzle length NLu for the graded recording rates DR(22)-DR(26) in the upstream-end-portion printing process UPa. For the subsequent two increases in pass number, the downstream-side nozzle length NLd is sequentially shortened by 10 d while the upstream-side nozzle length NLu remains unchanged. As a result, the downstream-side nozzle length NLd is set identical to the downstream-side nozzle length NLd in the graded recording rates DR(22)-DR(26) in the upstream-end-portion printing process UPa. Through this process, the upstream-side nozzle length NLu and downstream-side nozzle length NLd of the graded recording rate DR(21) for the last pass process P(21) in the upstream-side intermediate printing process UIPa are set identical to the upstream-side nozzle length NLu and downstream-side nozzle length NLd for the graded recording rates DR(22)-DR(26) in the upstream-end-portion printing process UPa.

In other words, the upstream-side intermediate printing process UIPa includes: two pass processes P(18) and P(19) executed using the graded recording rates DR(18) and DR(19) whose upstream-side nozzle length NLu is shorter than that in the middle printing process MP and whose downstream-side nozzle length NLd is the same as that in the middle printing process MP; and the two pass processes P(20) and P(21) executed after the pass processes P(18) and P(19) using the graded recording rates DR(20) and DR(21) whose upstream-side nozzle length NLu is the same as that in the upstream-end-portion printing process UPa and whose downstream-side nozzle length NLd is shorter than that in the middle printing process MP. Further, the upstream-side nozzle lengths NLu for the graded recording rates DR(18) and DR(19) used in the two pass processes P(18) and P(19) are sequentially shortened and the downstream-side nozzle lengths NLd for the graded recording rates DR(20) and DR(21) used in the two pass processes P(20) and P(21) are sequentially shortened.

Further, from the viewpoint of the upstream-side gradient θu and downstream-side gradient θd, the graded recording rates DR(16)-DR(21) change in each succeeding pass process as follows. For the first two increases in pass number, the upstream-side gradient θu grows larger while the downstream-side gradient θd remains unchanged. As a result, the upstream-side gradient θu becomes identical to the upstream-side gradient θu for the graded recording rates DR(22)-DR(26) in the upstream-end-portion printing process UPa. For the subsequent two increases in pass number, the downstream-side gradient θd grows larger while the upstream-side gradient θu remains unchanged. As a result, the downstream-side gradient θd becomes identical the downstream-side gradient θd for the graded recording rates DR(22)-DR(26) in the upstream-end-portion printing process UPa. Accordingly, the upstream-side gradient θu and downstream-side gradient θd for the graded recording rate DR(21) in the last pass process P(21) of the upstream-side intermediate printing process UIPa become identical to the upstream-side gradient θu and downstream-side gradient θd for the graded recording rates DR(22)-DR(26) in the upstream-end-portion printing process UPa.

In other words, the upstream-side intermediate printing process UIPa includes: the pass processes P(18) and P(19) executed using the graded recording rates DR(18) and DR(19) whose upstream-side gradient θu is greater than that in the middle printing process MP and the downstream-side gradient θd is identical to that in the middle printing process MP; and the pass processes P(20) and P(21) executed following pass processes P(18) and P(19) using the graded recording rates DR(20) and DR(21) whose upstream-side gradient θu is identical to that in the upstream-end-portion printing process UPa and whose downstream-side gradient θd is greater than that in the middle printing process MP. Further, the upstream-side gradient θu for the graded recording rates DR(18) and DR(19) used in the two pass processes P(18) and P(19) increases sequentially, and the downstream-side gradient θd for the graded recording rates DR(20) and DR(21) used in the two pass processes P(20) and P(21) increases sequentially.

By using the graded recording rates described above, the printing process under the normal control according to the first embodiment can suppress banding generated from irregularities in sheet-feeding amounts, without giving rise to irregularities in density.

The graded recording rates for pass processes performed when printing the upstream end portion of the sheet will be described in greater detail with reference to FIG. 13. The right side in FIG. 13 indicates the above graded recording rates associated with the head position in each pass process shown in FIG. 13. Graded recording rates depicted in solid lines on the right side of FIG. 13 are the graded recording rates for odd-numbered passes, while those depicted in dashed lines denote graded recording rates for even-numbered passes.

As described above, the use of graded recording rates in the first embodiment can suppress banding caused by irregularities in sheet-feeding amounts at positions on the sheet M that include the nozzle NZ at the downstream end of the active nozzles in one pass process and the nozzle NZ at the upstream end of the active nozzles in another pass process.

Since the first embodiment employs graded recording rates with specially designed upstream-side gradient θu, downstream-side gradient θd, upstream-side nozzle length NLu, and downstream-side nozzle length NLd. As described above, the total value of graded recording rates DR for odd-numbered passes is maintained at a constant value (50%) irrespective of the position in the conveying direction, and the total value of graded recording rates DR for even-numbered passes is maintained at a constant value (50%) irrespective of the position in the conveying direction, as indicated on the right side of FIG. 13. Thus, the total value of graded recording rates DR for all pass processes is maintained at a constant value (100%) irrespective of the position in the conveying direction. As a result, the number of dots that can be printed in all raster lines can be maintained uniform irrespective of the positions of the raster lines in the conveying direction. When using a simple graded recording rate, for example, as when printing from the downstream edge to the middle section described with reference to FIG. 10, the total value of graded recording rates DR for odd-numbered passes, the total value of graded recording rates DR for even-numbered passes, and hence the total value of graded recording rates DR for all passes are not constant values in the region of transition from the middle printing process MP to the upstream-end-portion printing process UPa. The method according to the first embodiment can maintain these total values of graded recording rates DR at constant values in this region. As described above, the method of the first embodiment can suppress banding caused by irregularities in sheet-feeding amounts, without giving rise to irregularities in density.

Further, the middle printing process MP is performed while the sheet is in the held state S2 (see FIG. 14), i.e., while the sheet is held by the upstream-side holding unit and downstream-side holding unit. The upstream-end-portion printing process UPa is performed while the sheet is in the held state S4 (see FIG. 14), i.e., while the sheet is held by the downstream-side holding unit (the downstream rollers 218 of FIG. 3A in the first embodiment) but not held by the upstream-side holding unit (the upstream rollers 217, high support members 212, and pressing members 216 of FIG. 3A in the first embodiment). As a result, the method of the present disclosure can reduce irregularities in printing density in regions of transition between these sheet-conveying states, i.e., during the transition from the held state S2 to the held state S4.

In the first embodiment, the active nozzles used in the upstream-end-portion printing process UPa (see FIG. 13 and the graph (E) of FIG. 15) do not include nozzles formed at positions opposing the support members 212 and 213 (the upstream nozzle NZu, for example), but include nozzles formed at positions opposing the non-supporting part AT (the downstream nozzle NZd, for example). Further, active nozzles used in the middle printing process MP (see FIG. 13 and the graph (A) of FIG. 15) include both nozzles formed at positions opposing the support members 212 and 213 and nozzles formed at positions opposing the non-supporting part AT. As described above, the number of active nozzles is gradually decreased in the pass processes P(18)-P(21) of the upstream-side intermediate printing process UIPa by gradually shifting the position of the upstream end of the active nozzles downstream. In this way, the method of the first embodiment can restrain ink from becoming deposited on the support members 212 and 213 when performing borderless printing on the upstream edge portion of the sheet M during the upstream-end-portion printing process UPa, thereby preventing the sheet M from becoming soiled.

Further, the graded recording rates DR(11)-DR(17) used in the middle printing process MP are identical to the graded recording rates of the basic dot pattern data DPD in FIG. 7B. However, the graded recording rates for the downstream-side and upstream-side intermediate printing processes DIP and UIPa (DR(7)-DR(9) and DR(18)-DR(21), for example) differ from the graded recording rates in the basic dot pattern data DPD. Hence, as described in the print data generation process of FIG. 6, the CPU 110 generates the dot pattern data DPDa based on the graded recording rates of the intermediate printing processes DIP and UIPa using the basic dot pattern data DPD conforming to the graded recording rates used in the middle printing process MP. This method makes it possible to use a nonvolatile storage device 130 with a more economical capacity since dot pattern data for all graded recording rates need not be stored in the nonvolatile storage device 130 in advance. Further, the dot pattern data DPDa for use in the intermediate printing processes DIP and UIPa having relatively short active nozzle lengths is generated using the basic dot pattern data DPD for the middle printing process MP employing a relatively long active nozzle length. Thus, suitable dot pattern data DPDa for the intermediate printing processes DIP and UIPa can be generated by thinning out the basic dot pattern data DPD.

In the first embodiment described above, the pass processes P(18) and P(19) in the upstream-side intermediate printing process UIPa are examples of a (c1)-pass process, and the pass processes P(20) and P(21) are examples of a (c2)-pass process. Further, the pass processes P(7) and P(8) in the downstream-side intermediate printing process DIP are examples of a (e1)-pass process and a (C1)-pass process, while the pass processes P(9) and P(10) are examples of a (e2)-pass process and a (C2)-pass process. Further, the basic dot pattern data DPD is an example of basic dot formation data and first dot formation data. The dot pattern data DPDa conforming to the graded recording rates DR(18)-DR(21) in the upstream-side intermediate printing process UIPa is an example of second dot formation data, while the dot pattern data DPDa conforming to the graded recording rates DR(7)-DR(9) in the downstream-side intermediate printing process DIP is an example of second dot formation data.

A-5-2. Special Control

Next, a printing process under the special control will be described. Under the special control, the printing process for the region from the downstream edge to the middle section is identical to that under the normal control, but printing in the region from the middle section to the upstream edge differs from the process under the normal control. Below, the printing process for this region from the middle section to the upstream edge under the special control will be described.

Printing from Middle Section to Upstream Edge

Figure 16:
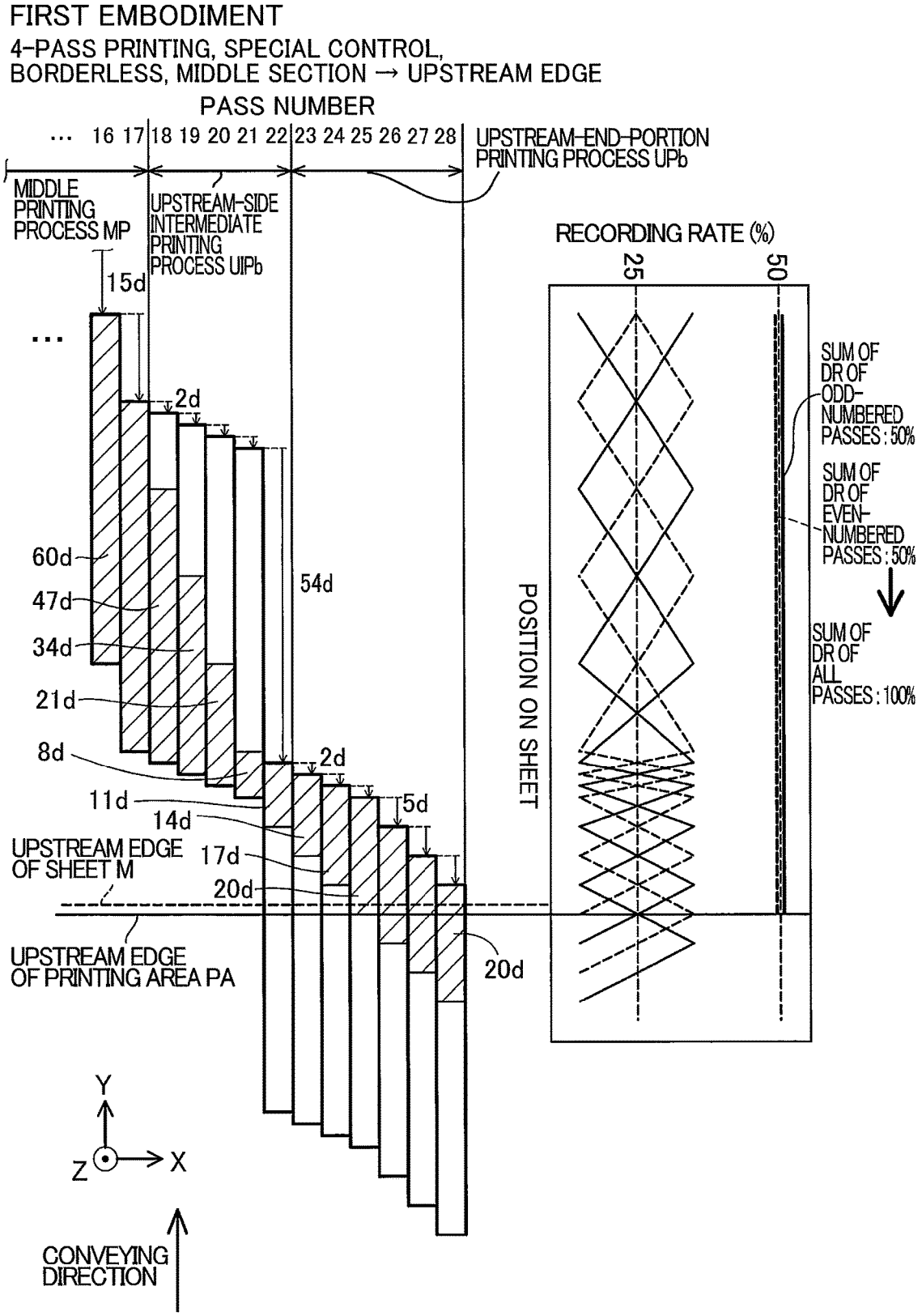
FIG. 16 is an explanatory diagram showing the positions of the print head when printing from the middle section to the upstream edge of the sheet in a special control according to the first embodiment.

FIG. 16 shows the head position for each pass process performed under the special control when printing the region of the sheet M from the middle section to the upstream edge. FIG. 16 indicates head positions for pass processes P(16)-P(28) having pass numbers 16-28 indicated in the top of the drawing.

As in FIGS. 10 and 13, values attached to the active nozzle regions (60 d and 20 d, for example) depicted with hatching marks within the borders indicating the head positions in FIG. 16 denote the active nozzle lengths. Note that while the graded recording rates DR described above are specified for active nozzles upstream from the upstream edge of the printing area PA among the active nozzles in pass processes P(26)-P(28), dot data assigned to these nozzles indicates that dots are not to be formed. Accordingly, nozzles upstream from the upstream edge of the printing area PA do not actually form dots.

Figure 17:
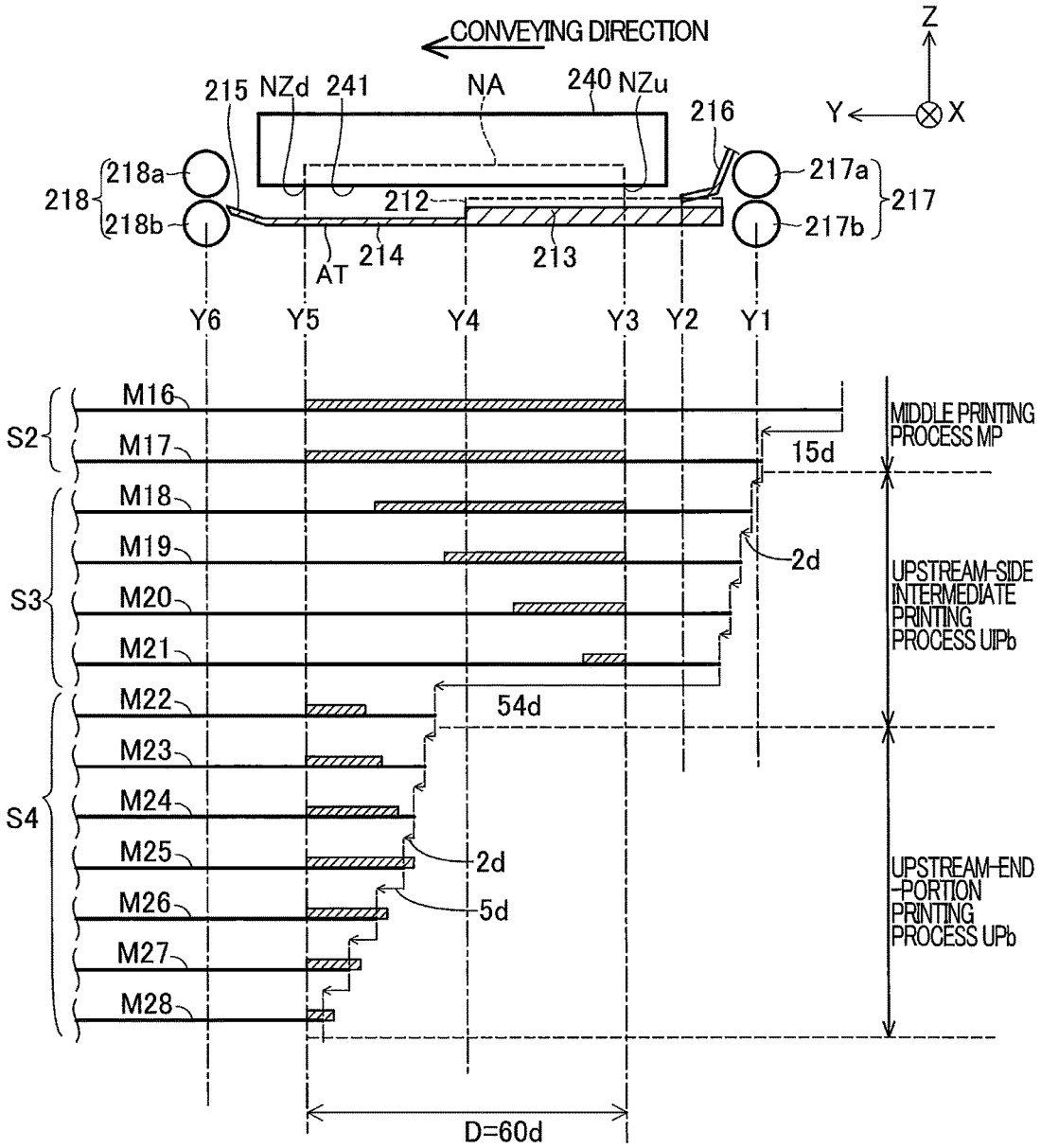
FIG. 17 is an explanatory diagram showing the positions of the sheet when printing from the middle section to the upstream edge of the sheet in the special control according to the first embodiment.

FIG. 17 shows the position of the sheet M relative to the print head 240 for each pass process under the special control when printing in the region of the sheet M from the middle section to the upstream edge. In FIG. 17, the sheets M16-M28 denote thirteen positions of the sheet M for the pass processes P(16)-P(28). As in FIGS. 11 and 14, regions with hatching marks on the sheets M16-M28 in FIG. 17 denote printing regions on the sheet printed through the corresponding pass process.

As shown in FIGS. 16 and 17, the feed amount in conveying processes F(16) and F(17) is 15 d, and the feed amount in conveying processes F(18)-F(21) is 2 d. Further, the feed amount in a conveying process F(22) is 54 d. Thus, the conveying process F(22) is a conveying process using the large feed described above. The feed amount in conveying processes F(23)-F(25) is 2 d, while the feed amount in conveying processes F(26)-F(28) is 5 d.

The process for printing the region near the upstream edge of the sheet M under the special control from the conveying process F(23) to the last pass process P(28) will be called an upstream-end-portion printing process UPb (see FIG. 16). As illustrated in FIG. 17, the held state of the sheet M during the upstream-end-portion printing process UPb is the held state S4 described above.

As with the upstream-end-portion printing process UPa for the normal control described above, active nozzles in the upstream-end-portion printing process UPb are set to a portion of nozzles on the downstream side in order to perform borderless printing. That is, the active nozzles used in the upstream-end-portion printing process UPb include the downstream nozzle NZd but not the upstream nozzle NZu.

Under the special control, the printing process performed between the middle printing process MP and the upstream-end-portion printing process UPb, which is the printing process from the conveying process F(18) to the pass process P(22) in the first embodiment, will be called the upstream-side intermediate printing process UIPb. The active nozzle lengths used in the pass processes P(18)-P(22) of the upstream-side intermediate printing process UIPb are shorter than the active nozzle length 60 d used in the middle printing process MP (see FIG. 16). Hence, the number of active nozzles used in the pass processes P(18)-P(22) for the upstream-side intermediate printing process UIPb is fewer than the number of active nozzles used in the middle printing process MP.

The active nozzle lengths for the four pass processes P(18)-P(21) performed prior to the conveying process F(22) having the large feed of 54 d are sequentially reduced by a uniform amount from the active nozzle length in the previous pass process in each succeeding pass process. Specifically, the active nozzle length in these pass processes is reduced each time by 13 d. Hence, the active nozzle lengths for the pass processes P(18)-P(21) are 47 d, 34 d, 21 d, and 8 d. More specifically, the nozzle on the upstream end of the active nozzles in the pass processes P(18)-P(21) remains the same (the upstream nozzle NZu) while the nozzle on the downstream end is sequentially moved upstream by 13 d in each succeeding pass process. In other words, the number of active nozzles in the four pass processes P(18)-P(21) is sequentially reduced by a constant number, i.e., the number of nozzles within the length 13 d each time the pass number is increased. The feed amount used in the four conveying processes F(18)-F(21) prior to the conveying process F(22) having the large feed of 54 d is 2 d.

By sequentially reducing the active nozzle length in the pass processes P(18)-P(21) while performing the conveying processes F(18)-F(21) at the relatively small feed amount of 2 d for four times prior to the conveying process F(22) having the large feed of 54 d, the CPU 110 can perform this conveying process F(22) without encountering an unprintable raster line.

The held state of the sheet M changes from the held state S2 to the held state S3 when the CPU 110 executes the conveying process F(18) at the feed amount 2 d, and subsequently changes from the held state S3 to the held state S4 when the CPU 110 executes the conveying process F(22) having the large feed of 54 d. Hence, when executing the conveying process F(22), the sheet is shifted from a state in which it is held on both the upstream side and the downstream side of the print head 240 to a state in which it is held only on the downstream side. By performing the conveying process F(22) having the large feed of 54 d, the printing process under the special control can shorten the length of the portion of the sheet M positioned upstream of the downstream rollers 218 when printing in the held state S4.

The three conveying processes performed after the conveying process F(22) having the large feed of 54 d, i.e., the initial three conveying processes F(23)-F(25) in the upstream-end-portion printing process UPb are performed with a relatively small feed amount of 2 d. In this way, the CPU 110 can avoid encountering an unprintable raster line following the conveying process F(22). Further, the active nozzle length is gradually increased in the four pass processes following the conveying process F(22) having the large feed of 54 d. That is, the active nozzle length in the last pass process P(22) of the upstream-side intermediate printing process UIPb and the initial three pass processes P(23)-P(25) in the upstream-end-portion printing process UPb is increased a uniform amount from the active nozzle length in the previous pass process, and specifically by 3 d, in each succeeding pass process. Hence, the active nozzle lengths in the pass processes P(23)-P(25) are 11 d, 14 d, 17 d, and 20 d, respectively.

Subsequently, the CPU 110 performs conveying processes F(26)-F(28) in the upstream-end-portion printing process UPb at a feed amount of 5 d, and pass processes P(26)-P(28) with an active nozzle length of 20 d.

Note that under the normal control in the example shown in FIG. 14, five pass processes are executed while the upstream edge portion of the sheet M is no long supported from below by the support members 212 and 213, i.e., while the upstream edge of the sheet M is positioned on the downstream side of position Y4 (M22-M26 of FIG. 14). Under the special control in the example of FIG. 17, seven pass processes (i.e., more than under the normal control) are executed in this state (M22-M28 of FIG. 17).

Figure 18:
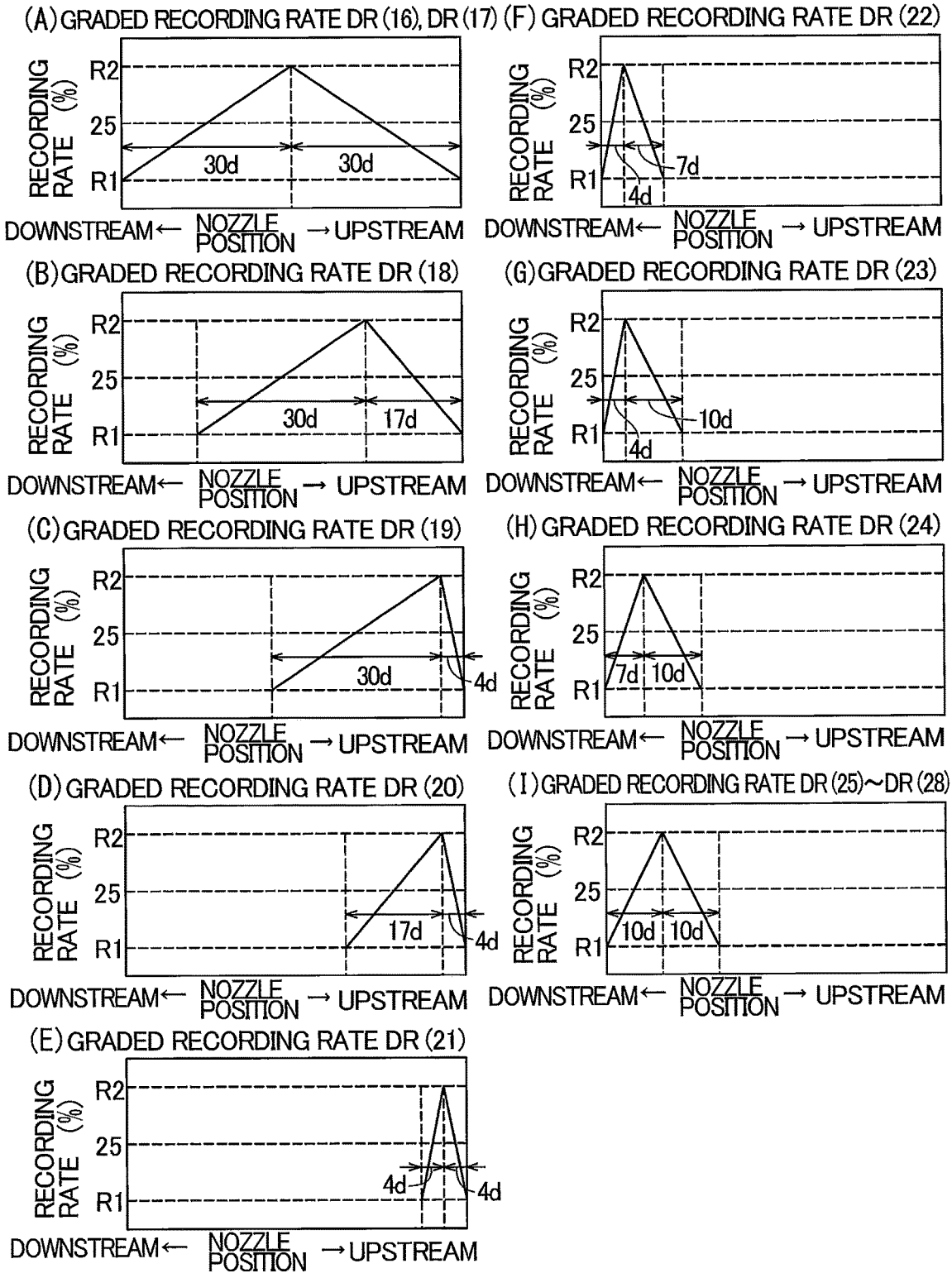
FIG. 18 shows graphs denoting the graded recording rates when printing from the middle section to the upstream edge of the sheet in the special control according to the first embodiment.

FIG. 18 shows the graded recording rates for pass processes when printing the region from the middle section to the upstream edge of the sheet under the special control. The graded recording rates DR(16) and DR(17) for the middle printing process MP shown in the graph (A) of FIG. 18 are identical to those described earlier with reference to the graph (E) of FIG. 12.

The graded recording rates DR(18) and DR(19) for the first two pass processes P(18) and P(19) in the upstream-side intermediate printing process UIPb shown in graphs (B) and (C) of FIG. 18 regulate nozzles within respective active nozzle lengths 47 d and 34 d, which are shorter than the active nozzle length of 60 d used in the pass processes P(16) and P(17) by 13 d and 26 d, respectively.

The downstream-side nozzle length NLd in the graded recording rates DR(18) and DR(19) is equivalent to the downstream-side nozzle length NLd in the graded recording rates DR(16) and DR(17) shown in the graph (A) of FIG. 18. Accordingly, the downstream-side gradient θd in the graded recording rates DR(18) and DR(19) is equivalent to the downstream-side gradient θd in the graded recording rates DR(16) and DR(17).

The upstream-side nozzle lengths NLu in the graded recording rates DR(18) and DR(19) are 17 d and 4 d, respectively, which are shorter than the upstream-side nozzle length NLu in the graded recording rates DR(16) and DR(17) shown in the graph (A) of FIG. 18 by 13 d and 26 d, respectively. Therefore, the upstream-side gradients θu in the graded recording rates DR(18) and DR(19) are greater than the upstream-side gradient θu in the graded recording rates DR(16) and DR(17). Further, the upstream-side gradient θu in the graded recording rate DR(19) is greater than the upstream-side gradient θu in the graded recording rate DR(18).

In each of the graded recording rates DR(18) and DR(19), the upstream-side nozzle length NLu is shorter than the downstream-side nozzle length NLd. Therefore, the upstream-side gradient θu is greater than the downstream-side gradient θd for both the graded recording rates DR(18) and DR(19). The maximum recording rate nozzle in each of the graded recording rates DR(18) and DR(19) is positioned upstream from the center position of the active nozzles in the conveying direction.

In the next two pass processes P(20) and P(21) in the upstream-side intermediate printing process UIPb shown in the graphs (D) and (E) of FIG. 18, the graded recording rates DR(20) and DR(21) regulate nozzles having active nozzle lengths of 21 d and 8 d, respectively, which are shorter than the active nozzle length 34 d in the pass process P(19) by 13 d and 26 d, respectively.

The downstream-side nozzle lengths NLd in the graded recording rates DR(20) and DR(21) are 17 d and 4 d, respectively, which are shorter than the downstream-side nozzle length NLd (30 d) in the graded recording rates DR(16) and DR(17) shown in the graph (A) of FIG. 18 and in the graded recording rates DR(18) and DR(19) shown in the graphs (B) and (C) of FIG. 18 by 13 d and 26 d, respectively. Therefore, the downstream-side gradients θd in the graded recording rates DR(20) and DR(21) are greater than the downstream-side gradient θd in the graded recording rates DR(16)-DR(19). Further, the downstream-side gradient θd in the graded recording rate DR(21) is greater than the downstream-side gradient θd in the graded recording rate DR(20).

The upstream-side nozzle length NLu in the graded recording rates DR(20) and DR(21) is equivalent to the upstream-side nozzle length NLu (4 d) in the graded recording rate DR(19) shown in the graph (C) of FIG. 18. Accordingly, the upstream-side gradient θu in the graded recording rates DR(20) and DR(21) is identical to the upstream-side gradient θu in the graded recording rate DR(19).

In the graded recording rate DR(20), the upstream-side nozzle length NLu is shorter than the downstream-side nozzle length NLd. Therefore, the upstream-side gradient θu is greater than the downstream-side gradient θd in the graded recording rate DR(20). The maximum recording rate nozzle in the graded recording rate DR(20) is positioned upstream from the center position of the active nozzles in the conveying direction.

In the graded recording rate DR(21), the upstream-side nozzle length NLu is equivalent to the downstream-side nozzle length NLd. Hence, the upstream-side gradient θu is equivalent to the downstream-side gradient θd in the graded recording rate DR(21). The maximum recording rate nozzle in the graded recording rate DR(21) is positioned at the center of the active nozzles in the conveying direction.

The graded recording rates DR(22) and DR(23) for the two pass processes shown in graphs (F) and (G) of FIG. 18, i.e., the last pass process P(22) in the upstream-side intermediate printing process UIPb and the first pass process P(23) in the upstream-end-portion printing process UPb regulate nozzles within active nozzle lengths of 11 d and 14 d, respectively, which are longer than the active nozzle length of 8 d in the pass process P(21) by 3 d and 6 d, respectively.

The downstream-side nozzle length NLd in the graded recording rates DR(22) and DR(23) is equivalent to the upstream-side nozzle length NLu in the graded recording rate DR(21) shown in the graph (E) of FIG. 18. Accordingly, the downstream-side gradient θd in the graded recording rates DR(22) and DR(23) is equivalent to the upstream-side gradient θu in the graded recording rate DR(21).

The upstream-side nozzle lengths NLu in the graded recording rates DR(22) and DR(23) are 7 d and 10 d, respectively, which are longer than the downstream-side nozzle length NLd (4 d) in the graded recording rate DR(21) shown in the graph (E) of FIG. 18 by 3 d and 6 d, respectively. Therefore, the upstream-side gradients θu in the graded recording rates DR(22) and DR(23) are smaller than the downstream-side gradient θd in the graded recording rate DR(21). The upstream-side gradient θu in the graded recording rate DR(23) is also smaller than the upstream-side gradient θu in the graded recording rate DR(22).

In the graded recording rates DR(22) and DR(23), the upstream-side nozzle length NLu is longer than the downstream-side nozzle length NLd. Accordingly, the upstream-side gradient θu is smaller than the downstream-side gradient θd in both the graded recording rates DR(22) and DR(23). The maximum recording rate nozzle in the graded recording rates DR(22) and DR(23) is positioned on the downstream side of the center position of the active nozzles in the conveying direction.

In the final two pass processes P(24) and P(25) of the upstream-end-portion printing process UPb shown in the graphs (H) and (I) of FIG. 18, the graded recording rates DR(24) and DR(25) regulate nozzles having active nozzle lengths 17 d and 20 d, respectively, which are longer than the active nozzle length 14 d in the pass process P(23) by 3 d and 6 d, respectively.

The downstream-side nozzle lengths NLd in the graded recording rates DR(24) and DR(25) are 7 d and 10 d, respectively, which are longer than the downstream-side nozzle length NLd (4 d) in the graded recording rates DR(22) and DR(23) shown in the graphs (F) and (G) of FIG. 18 by 3 d and 6 d, respectively. Accordingly, the downstream-side gradients θd in the graded recording rates DR(24) and DR(25) are smaller than the downstream-side gradient θd in the graded recording rates DR(22) and DR(23). Further, the downstream-side gradient θd in the graded recording rate DR(25) is smaller than the downstream-side gradient θd in the graded recording rate DR(24).

The upstream-side nozzle length NLu in the graded recording rates DR(24) and DR(25) is equivalent to the upstream-side nozzle length NLu (10 d) in the graded recording rate DR(23) shown in the graph (G) of FIG. 18. Hence, the upstream-side gradient θu in the graded recording rates DR(24) and DR(25) is equivalent to the upstream-side gradient θu in the graded recording rate DR(23).

In the graded recording rate DR(24), the upstream-side nozzle length NLu is longer than the downstream-side nozzle length NLd. Therefore, the upstream-side gradient θu is smaller than the downstream-side gradient θd in the graded recording rate DR(24). The maximum recording rate nozzle in the graded recording rate DR(24) is positioned on the downstream side of the center position of the active nozzles in the conveying direction.

In the graded recording rate DR(25), the upstream-side nozzle length NLu is equivalent to the downstream-side nozzle length NLd. Hence, the upstream-side gradient θu is equivalent to the downstream-side gradient θd in the graded recording rate DR(25). The maximum recording rate nozzle in the graded recording rate DR(25) is positioned in the center position of the active nozzles in the conveying direction.

By using the graded recording rates described above under the special control, the printing operation in the first embodiment can suppress banding caused by irregularities in sheet-feeding amounts, without giving rise to irregularities in density.

The graded recording rates described above are shown in FIG. 16 in correlation with the head position for each pass process. Graded recording rates depicted with solid lines in the right side of FIG. 16 are graded recording rates for odd-numbered passes, while those depicted in dashed lines are graded recording rates for even-numbered passes.

By using such graded recording rates, the printer 600 according to the first embodiment can suppress banding caused by irregularities in sheet-feeding amounts at positions on the sheet M used as both: a position for a nozzle NZ that is disposed on the downstream end of the active nozzles in one pass process; and a position for a nozzle NZ that is disposed on the upstream end of the active nozzles in another pass process.

By using the graded recording rates described above with specially devised upstream-side and downstream-side gradients θu and θd and upstream-side and downstream-side nozzle lengths NLu and NLd, the printer 600 according to the first embodiment can maintain the total value for graded recording rates DR in odd-numbered passes at a constant value (50%) irrespective of the position in the conveying direction, and can maintain the total value for graded recording rates DR in even-numbered passes at a constant value (50%) irrespective of the position in the conveying direction, as indicated on the right side of FIG. 16. As a result, the total value of graded recording rates DR in all pass processes is maintained at a constant value (100%) irrespective of the position in the conveying direction, thereby maintaining a constant number of dots that can be printed in each raster line, regardless the position of the raster line in the conveying direction. As described above, the printer 600 of the first embodiment can suppress banding caused by irregularities in sheet-feeding amounts, without giving rise to irregularities in density.

B. Second Embodiment

Figure 19:
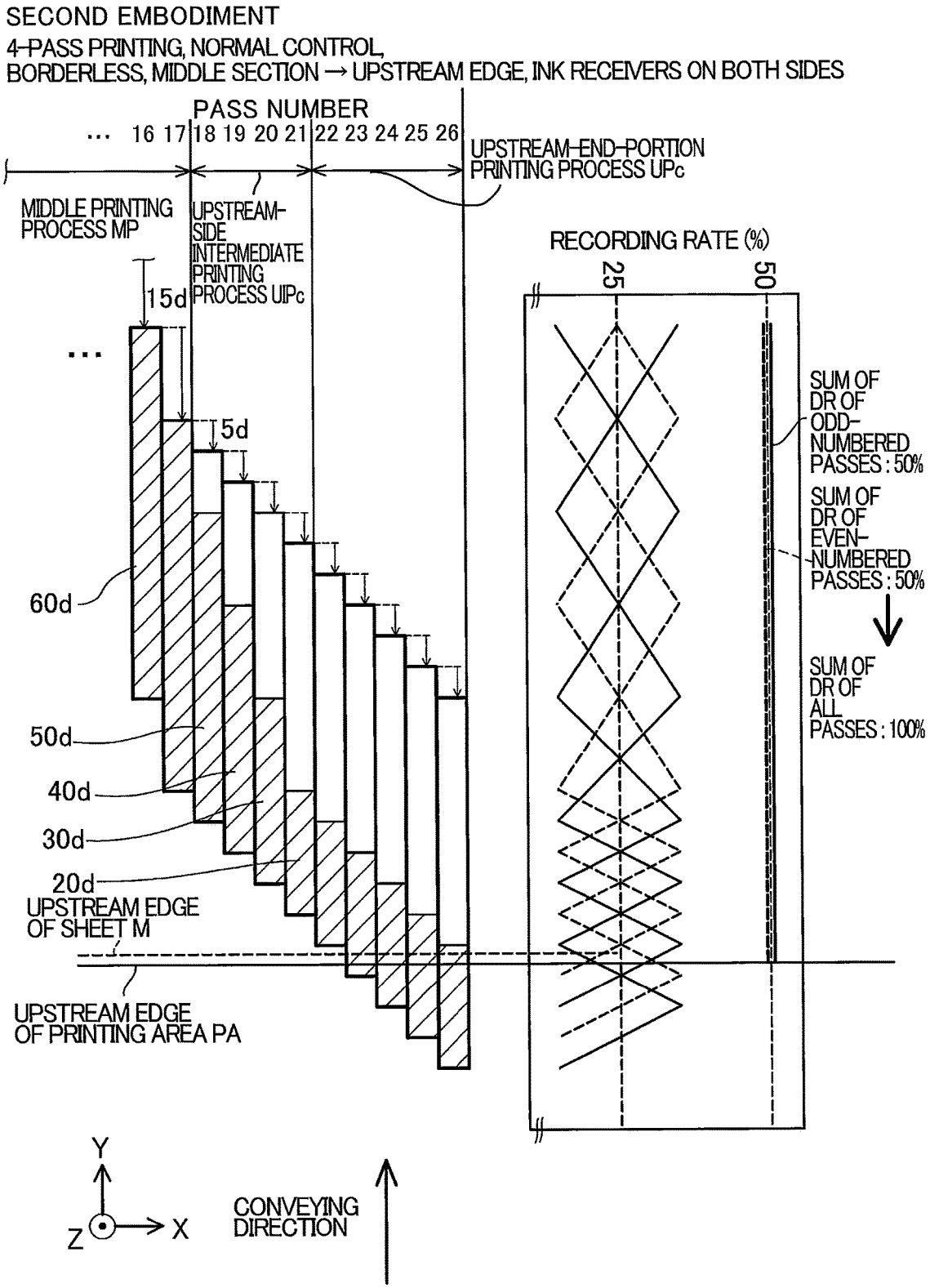
FIG. 19 is an explanatory diagram showing the positions of the print head when printing from the middle section to the upstream edge of the sheet in the normal control according to a second embodiment.
Figure 20:
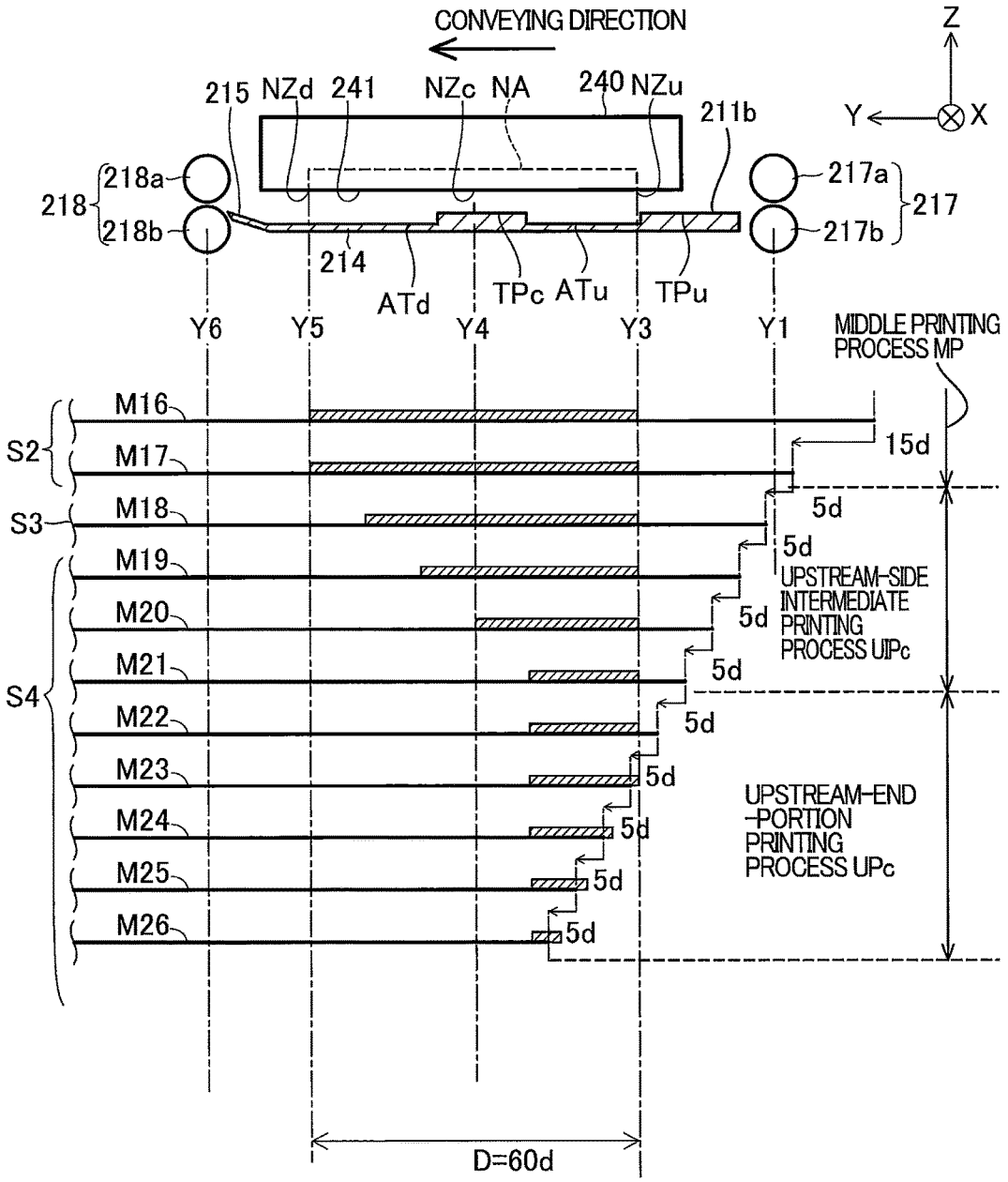
FIG. 20 is an explanatory diagram showing the positions of the sheet when printing from the middle section to the upstream edge of the sheet in the normal control according to the second embodiment.

Next, another example of a printing process for printing under normal control from the middle section of a sheet to its upstream edge will be described as a second embodiment. FIG. 19 shows the head position for each pass process under the normal control according to the second embodiment when printing a region of a sheet M from its middle section to its upstream edge. FIG. 20 shows the position of the sheet M relative to the print head 240 for each pass process under the normal control according to the second embodiment when printing the region from the middle section to the upstream edge of the sheet M. FIG. 21 shows the graded recording rates used in pass processes for printing the region from the middle section to the upstream edge of a sheet M under the normal control according to the second embodiment.

The following description will focus on differences from the printing process described with reference to FIGS. 13 through 15 for printing from the middle section to the upstream edge of the sheet M under the normal control according to the first embodiment. As shown in FIG. 20, a sheet support 211*b* according to the second embodiment includes a center supporting part TPc, an upstream supporting part TPu, an upstream non-supporting part ATu, and a downstream non-supporting part ATd in place of the high support members 212 and low support members 213 in the first embodiment. The top surfaces of the upstream non-supporting part ATu and downstream non-supporting part ATd are separated farther from the nozzle-forming surface 241 of the print head 240 than the top surfaces of the center supporting part TPc and upstream supporting part TPu. Thus, a sheet M conveyed along the sheet support 211*b* is supported from below by the top surfaces of the center supporting part TPc and upstream supporting part TPu, but is not supported by the upstream non-supporting part ATu and the downstream non-supporting part ATd. The upstream non-supporting part ATu and the downstream non-supporting part ATd function as ink receivers for receiving ink ejected beyond the edge of the sheet M during borderless printing.

The upstream non-supporting part ATu opposes an area of the nozzle-forming surface 241 of the print head 240 in which are formed a portion of the upstream-side nozzles that include the upstream nozzle NZu. The downstream non-supporting part ATd opposes an area of the nozzle-forming surface 241 of the print head 240 in which are formed a portion of the downstream-side nozzles that include the downstream nozzle NZd. The center supporting part TPc is positioned between the downstream non-supporting part ATd and upstream non-supporting part ATu. The center supporting part TPc opposes an area of the nozzle-forming surface 241 of the print head 240 in which are formed a portion of the nozzles in the middle section of the conveying direction that include the center nozzle NZc positioned at the center of the nozzle rows in the conveying direction. Thus, the sheet support 211*b* according to the second embodiment includes parts that function as ink receivers on both the upstream and downstream sides. In the second embodiment, printing the region of the sheet M from the downstream edge to the middle section is executed similarly to the process described in the first embodiment using the downstream non-supporting part ATd as an ink receiver when printing the downstream edge. Printing under the normal control in the second embodiment for the region of the sheet M from the middle section to the upstream edge is performed as described below using the upstream non-supporting part ATu as an ink receiver when printing the upstream edge.

The second embodiment differs from the first embodiment in that the active nozzles in the pass processes P(18)-P(21) of an upstream-side intermediate printing process UIPc and the pass processes P(22)-P(26) of an upstream-end-portion printing process UPc include the upstream nozzle NZu. More specifically, for the pass processes P(18)-P(21) in the upstream-side intermediate printing process UIPc, the active nozzle length is shortened by 10 d in each succeeding pass process as in the first embodiment described above by moving the position of the downstream end of the active nozzles upstream in each succeeding pass process (see FIG. 19). Thereafter, the active nozzles for the pass processes P(22)-P(26) in the upstream-end-portion printing process UPc remain the same as the active nozzles in the last pass process P(21) of the upstream-side intermediate printing process UIPc (see FIG. 19).

In the upstream-side intermediate printing process UIPc according to the second embodiment, the feed amount used in the conveying processes F(18)-F(21) is 5 d. This feed amount differs from the feed amount used in the first embodiment, but the feed amounts in other conveying processes in the second embodiment are identical to those in the first embodiment (see FIGS. 19 and 20).

As shown in FIG. 21, the shapes of the graded recording rates DR(16)-DR(26) for the pass processes P(16)-P(26) in the second embodiment are identical to those in the first embodiment. In other words, the upstream-side gradient θu, downstream-side gradient θd, upstream-side nozzle length NLu, and downstream-side nozzle length NLd in the graded recording rates DR(16)-DR(26) are identical to those in the first embodiment described above. However, the graded recording rates DR(18)-DR(26) according to the second embodiment regulate active nozzles that include the upstream nozzle NZu as described above.

As described above, printing under the normal control according to the second embodiment can suppress banding caused by irregularities in sheet-feeding amounts, without giving rise to irregularities in printing density, as with printing under the normal control in the first embodiment.

Further, the active nozzles used in the upstream-end-portion printing process UPc of the second embodiment (FIGS. 19 and 20 and the graph (E) of FIG. 21) include nozzles formed at a position opposing the upstream non-supporting part ATu (the upstream nozzle NZu, for example), but do not include nozzles formed at a position opposing the center supporting part TPc (the center nozzle NZc, for example). Further, active nozzles used in the middle printing process MP (see FIGS. 19 and 20 and the graph (A) of FIG. 21) include both nozzles formed at a position opposing the center supporting part TPc (the center nozzle NZc, for example) and nozzles formed at a position opposing the upstream non-supporting part ATu (the upstream nozzle NZu, for example). As described above, the number of active nozzles is sequentially decreased in the pass processes P(18)-P(21) of the upstream-side intermediate printing process UIPc by gradually shifting the position of the downstream end of the active nozzles upstream. This method suppresses ink from becoming deposited on the center supporting part TPc when performing borderless printing in the upstream-end-portion printing process UPc on the upstream edge of the sheet M, thereby preventing the sheet M from becoming soiled.

C. Third Embodiment

In the third embodiment, the printer 600 executes three-pass printing instead of four-pass printing in order to print a partial region of the sheet M in three pass processes. Next, this three-pass printing will be described for normal control.

Printing from Downstream Edge to Middle Section

FIG. 22 shows the head position for each pass process performed under the normal control in the third embodiment while printing the region of the sheet M from its downstream edge to its middle section. FIG. 23 shows the graded recording rates for pass processes performed under the normal control in the third embodiment when printing the region from the downstream edge to the middle section.

The printing process illustrated in FIG. 22 beginning from the start of the printing process (i.e., the start of the conveying process F(1)) to a pass process P(5) is the downstream-end-portion printing process DPd for printing the downstream section of the sheet M. The downstream-end-portion printing process DPd includes pass processes P(1)-P(5) having an active nozzle length of 15 d and conveying processes F(2)-F(5) having a feed amount of 5 d executed while the sheet M is in the held state S1 (see FIG. 11, for example).

The printing process from the conveying process F(9) to the pass process P(12) in FIG. 22 is a middle printing process MPd for printing the middle section of the sheet M. The middle printing process MPd includes pass processes P(9)-P(12) utilizing an active nozzle length of 60 d and conveying processes F(9)-F(12) having a feed amount of 20 d that are executed while the sheet M is in the held state S2 (see FIG. 11, for example).

The printing process from the conveying process F(6) to the pass process P(8) is a downstream-side intermediate printing process DIPd executed between the downstream-end-portion printing process DPd and the middle printing process MPd. In the three pass processes P(6)-P(8) of the downstream-side intermediate printing process DIPd, the active nozzle length is sequentially increased by a uniform amount from the active nozzle length in the previous pass process in each succeeding pass process by shifting the upstream end position of the active nozzles upstream by a uniform distance (and specifically 15 d at a time). In three-pass printing, an increase of 15 d in the active nozzle length is the value found by dividing the difference of 45 d between the active nozzle length 60 d used in the middle printing process MPd and the active nozzle length 15 d used in the downstream-end-portion printing process DPd by 3. During a single conveying process in the downstream-side intermediate printing process DIPd, the held state of the sheet changes from the held state S1 to the held state S2.

All graded recording rates used in the third embodiment have an upstream graded section Eu, a downstream graded section Ed, and a uniform section Ec whose graded recording rate DR is fixed at 50% between the upstream graded section Eu and the downstream graded section Ed, as shown in the example of the graph (A) of FIG. 23. The uniform section Ec may be considered the section in which a plurality of maximum recording rate nozzles are positioned and in which the graded recording rate DR is maintained at the maximum rate irrespective of the nozzle position in the conveying direction. Put another way, when depicting continuous changes in the graded recording rate DR relative to the nozzle position in the conveying direction (see the graph (A) of FIG. 23), the graded recording rate in the third embodiment has the uniform section Ec, the upstream graded section Eu on the upstream side of the uniform section Ec and the downstream graded section Ed on the downstream side of the uniform section Ec. The length of the uniform section Ec in the conveying direction will be called the uniform nozzle length NLc.

In the downstream-end-portion printing process DPd, as shown in the graph (A) of FIG. 23, the graded recording rates DR(1)-DR(5) for the pass processes P(1)-P(5) regulate nozzles within an active nozzle length of 15 d. In the graded recording rates DR(1)-DR(5), the uniform nozzle length NLc, upstream-side nozzle length NLu, and downstream-side nozzle length NLd are all equivalent at 5 d each.

In the middle printing process MPd, as shown in the graph (D) of FIG. 23, the graded recording rates DR(9)-DR(12) for the pass processes P(9)-P(12) regulate nozzles over an active nozzle length of 60 d, i.e., nozzles over the total nozzle length D. In the graded recording rates DR(9)-DR(12), the uniform nozzle length NLc, upstream-side nozzle length NLu, and downstream-side nozzle length NLd are all equivalent to each other and are 20 d each.

In the downstream-side intermediate printing process DIPd, as shown in the graph (B) of FIG. 23, the upstream-side nozzle length NLu in the graded recording rate DR(6) for the pass process P(6) is longer than the graded recording rates DR(1)-DR(5) by 15 d. The uniform nozzle length NLc and downstream-side nozzle length NLd of the graded recording rate DR(6) are equivalent to the uniform nozzle length NLc and downstream-side nozzle length NLd of the graded recording rates DR(1)-DR(5). Hence, the upstream-side gradient θu in the graded recording rate DR(6) is smaller than that in the graded recording rates DR(1)-DR(5).

In the downstream-side intermediate printing process DIPd, as shown in the graph (C) of FIG. 23, the uniform nozzle length NLc in the graded recording rate DR(7) for the pass process P(7) is longer than the uniform nozzle length NLc in the graded recording rate DR(6) by 15 d. The upstream-side nozzle length NLu and downstream-side nozzle length NLd in the graded recording rate DR(7) are equivalent to the upstream-side nozzle length NLu and downstream-side nozzle length NLd in the graded recording rate DR(6).

In the downstream-side intermediate printing process DIPd, as shown in the graph (D) of FIG. 23, the downstream-side nozzle length NLd in the graded recording rate DR(8) for the pass process P(8) is longer than the downstream-side nozzle length NLd in the graded recording rate DR(7) by 15 d. The upstream-side nozzle length NLu and uniform nozzle length NLc in the graded recording rate DR(8) are equivalent to the upstream-side nozzle length NLu and uniform nozzle length NLc in the graded recording rate DR(7). As is clear from the graph (D) of FIG. 23, the graded recording rate DR(8) is the same as the graded recording rates DR(9)-DR(12) for the pass processes P(9)-P(12) in the middle printing process MPd.

As described above, when viewed from the upstream-side gradient θu and downstream-side gradient θd, the graded recording rates DR(5)-DR(8) from the last pass process P(5) in the downstream-end-portion printing process DPd to the last pass process P(8) in the downstream-side intermediate printing process DIPd change as follows as the pass number increases. First, the upstream-side gradient θu grows smaller while the downstream-side gradient θd and the uniform nozzle length NLc remain unchanged. As a result of this step, the upstream-side gradient θu becomes identical to the upstream-side gradient θu for the graded recording rates DR(9)-DR(12) in the middle printing process MPd. Subsequently, the uniform nozzle length NLc is lengthened by 15 d while the upstream-side gradient θu and downstream-side gradient θd remain unchanged. As a result of this step, the uniform nozzle length NLc becomes equivalent to the uniform nozzle length NLc for the graded recording rates DR(9)-DR(12) in the middle printing process MPd. Next, the downstream-side gradient θd is decreased, while the upstream-side gradient θu and uniform nozzle length NLc remain unchanged. Through this step, the downstream-side gradient θd becomes equivalent to the downstream-side gradient θd for the graded recording rates DR(9)-DR(12) in the middle printing process MPd. Accordingly, by the last pass process P(8) in the downstream-side intermediate printing process DIPd, the upstream-side gradient θu, downstream-side gradient θd, and uniform nozzle length NLc for the graded recording rate DR(8) are equivalent to the upstream-side gradient θu, downstream-side gradient θd, and uniform nozzle length NLc for the graded recording rates DR(9)-DR(12) in the middle printing process MPd.

In this way, the downstream-side intermediate printing process DIPd according to the third embodiment includes: a single pass process P(6) executed using the graded recording rate DR(6) whose upstream-side gradient θu is smaller than that in the downstream-end-portion printing process DPd and whose downstream-side gradient θd is identical to that in the downstream-end-portion printing process DPd; a single pass process P(8) executed after the pass process P(6) using the graded recording rate DR(8) whose upstream-side gradient θu is identical to that in the middle printing process MPd and whose downstream-side gradient θd is smaller than that in the downstream-end-portion printing process DPd; and a pass process P(7) executed between the pass process P(6) and the pass process P(8) using the graded recording rate DR(7) whose upstream-side gradient θu and downstream-side gradient θd are identical to those in the pass process P(8) and whose uniform nozzle length NLc is longer than that in the pass process P(6).

By using the graded recording rates described above, the printing operation under the normal control according to the third embodiment can suppress banding caused by irregularities in sheet-feeding amounts, without giving rise to irregularities in printing density.

FIG. 22 shows the above graded recording rates for the head position of each pass process. On the right side of FIG. 22, the solid lines depict the graded recording rate DR(3t−2, where t is an integer of 1 or greater), the dashed lines depict the graded recording rate DR(3t−1), and the chain lines depict the graded recording rate DR(3t). As the drawing indicates, the total value of these graded recording rates is maintained at a constant value (100%) irrespective of the nozzle position in the conveying direction.

Printing from Middle Section to Upstream Edge

FIG. 24 shows the head position for each pass process performed under normal control according to the third embodiment when printing the region from the sheet M from the middle section to the upstream edge. FIG. 25 shows the graded recording rates of pass processes performed under the normal control according to the third embodiment when printing the region of the sheet M from the middle section to the upstream edge.

As shown in FIG. 24, the printing process performed from the conveying process F(17) to the pass process P(20) is an upstream-end-portion printing process UPd for printing the upstream end portion of the sheet M. The upstream-end-portion printing process UPd includes pass processes P(17)-P(20) performed using an active nozzle length of 15 d, and conveying processes F(17)-F(20 executed with a feed amount of 5 d while the sheet M is in the held state S4 (see FIG. 14, for example).

In FIG. 24, the pass process P(13) is the last pass process in the middle printing process MPd described above.

The printing process from the conveying process F(14) to the pass process P(16) is an upstream-side intermediate printing process UIPd that is executed between the middle printing process MPd and the upstream-end-portion printing process UPd. The upstream-side intermediate printing process UIPd includes three pass processes P(14)-P(16) whose active nozzle length is shortened from the active nozzle length of the previous pass process by a uniform amount in each succeeding pass process. The active nozzle length is decreased by shifting the upstream end position of the active nozzles downstream by a uniform amount (specifically by 15 d each time). In three-pass printing, a decrease of 15 d in the active nozzle length is the value found by dividing the difference of 45 d between the active nozzle length 60 d in the middle printing process MPd and the active nozzle length 15 d in the upstream-end-portion printing process UPd by 3. During a conveying process in the upstream-side intermediate printing process UIPd, the held state of the sheet changes from the state S2 to the state S4.

The graded recording rates DR(12) and DR(13) in the middle printing process MPd shown in the graph (A) of FIG. 25 are identical to those described above with reference to the graph (D) of FIG. 23. The graded recording rates DR(17)-DR(20) in the upstream-end-portion printing process UPd shown in the graph (D) of FIG. 25 are identical to the graded recording rates DR(1)-DR(5) in the downstream-end-portion printing process DPd described above with reference to the graph (A) of FIG. 23.

In the upstream-side intermediate printing process UIPd, as shown in the graph (B) of FIG. 25, the upstream-side nozzle length NLu in the graded recording rate DR(14) for the pass process P(14) is shorter than that in the graded recording rate DR(13) by 15 d. The uniform nozzle length NLc and the downstream-side nozzle length NLd in the graded recording rate DR(14) are equivalent to the uniform nozzle length NLc and the downstream-side nozzle length NLd in the graded recording rate DR(13), respectively. Hence, the upstream-side gradient θu in the graded recording rate DR(14) is greater than that in the graded recording rate DR(13).

In the upstream-side intermediate printing process UIPd, as shown in the graph (C) of FIG. 25, the uniform nozzle length NLc in the graded recording rate DR(15) for the pass process P(15) is shorter than that in the graded recording rate DR(14) by 15 d. The upstream-side nozzle length NLu and the downstream-side nozzle length NLd in the graded recording rate DR(15) are equivalent to the upstream-side nozzle length NLu and the downstream-side nozzle length NLd in the graded recording rate DR(14), respectively.

In the upstream-side intermediate printing process UIPd, as shown in the graph (D) of FIG. 25, the downstream-side nozzle length NLd in the graded recording rate DR(16) for the pass process P(16) is shorter than that in the graded recording rate DR(15) by 15 d. The upstream-side nozzle length NLu and the uniform nozzle length NLc in the graded recording rate DR(16) are equivalent to the upstream-side nozzle length NLu and the uniform nozzle length NLc in the graded recording rate DR(15), respectively. As is clear in the graph (D) of FIG. 25, the graded recording rate DR(16) is identical to the graded recording rate DR(17) for the pass process P(17) in the upstream-end-portion printing process UPd.

As described above, from the perspective of the upstream-side gradient θu and downstream-side gradient θd, the graded recording rates DR(13)-DR(16) from the last pass process P(13) in the middle printing process MPd to the last pass process P(16) in the upstream-side intermediate printing process UIPd change as follows as the pass number increases. First, the upstream-side gradient θu is increased while the downstream-side gradient θd and the uniform nozzle length NLc remain unchanged. As a result of this step, the upstream-side gradient θu becomes equivalent to the upstream-side gradient θu for the graded recording rates DR(17)-DR(19) in the upstream-end-portion printing process UPd. Subsequently, the uniform nozzle length NLc is shortened by 15 d while the upstream-side gradient θu and the downstream-side gradient θd remain unchanged. Through this step, the uniform nozzle length NLc becomes equivalent to the uniform nozzle length NLc for the graded recording rates DR(17)-DR(19) in the upstream-end-portion printing process UPd. Finally, the downstream-side gradient θd is increased while the upstream-side gradient θu and the uniform nozzle length NLc remain unchanged. As a result of this step, the downstream-side gradient θd becomes equivalent to the downstream-side gradient θd for the graded recording rates DR(17)-DR(19) in the upstream-end-portion printing process UPd. Accordingly, for the last pass process P(16) in the upstream-side intermediate printing process UIPd, the upstream-side gradient θu, downstream-side gradient θd, and uniform nozzle length NLc in the graded recording rate DR(16) are set equivalent to the upstream-side gradient θu, downstream-side gradient θd, and uniform nozzle length NLc for the graded recording rates DR(17)-DR(19) in the upstream-end-portion printing process UPd.

In this way, the upstream-side intermediate printing process UIPd according to the third embodiment includes: a single pass process P(14) executed using the graded recording rate DR(14) whose upstream-side gradient θu is greater than that in the middle printing process MPd and whose downstream-side gradient θd is identical to that in the middle printing process MPd; a single pass process P(16) executed after the pass process P(14) using the graded recording rate DR(16) whose upstream-side gradient θu is identical to that in the upstream-end-portion printing process UPd and whose downstream-side gradient θd is smaller than that in the middle printing process MPd; and a pass process P(15) executed between the pass process P(14) and pass process P(16) using the graded recording rate DR(15) whose upstream-side gradient θu and downstream-side gradient θd are identical to those in the pass process P(14) and whose uniform nozzle length NLc is shorter than that in the pass process P(14).

By using the graded recording rates described above, the printing operation under the normal control according to the third embodiment can suppress banding caused by irregularities in sheet-feeding amounts, without giving rise to irregularities in printing density.

FIG. 24 shows the above graded recording rates for the head position of each pass process. On the right side of FIG. 24, the solid lines depict the graded recording rate DR(3t−2, where t is an integer of 1 or greater), the dashed lines depict the graded recording rate DR(3t−1), and the chain lines depict the graded recording rate DR(3t). As the drawing indicates, the total value of these graded recording rates is maintained at a constant value (100%) irrespective of the nozzle position in the conveying direction.

In the third embodiment described above, pass process P(14) in the upstream-side intermediate printing process UIPd is an example of a (c1)-pass process, pass process P(16) is an example of a (c2)-pass process, and pass process P(15) is an example of the (c3)-pass process. Further, in the downstream-side intermediate printing process DIPd described in the third embodiment, pass process P(6) is an example of the (C1)-pass process, pass process P(8) is an example of the (C2)-pass process, and pass process P(7) is an example of a (C3)-pass process.

D. Variations of Embodiments (1) In the first embodiment described above, four-pass printing is performed under the normal control as an example of the multi-pass printing. However, another type of multi-pass printing may be performed for printing a partial region of the sheet using p pass processes, where p is an integer of 2 or greater.

For example, the printer 600 may perform two-pass printing or six-pass printing. When performing multi-pass printing in which the number p of passes is expressed as an even number (p=2×j, where j is an integer of 1 or greater), generally the downstream-side intermediate printing process under the normal control should include: j number of executions of (C1)-pass processes employing a graded recording rate in which the upstream-side gradient θu is smaller than that in the downstream-end-portion printing process and the downstream-side gradient θd is equivalent to that in the downstream-end-portion printing process; and j number of executions of (C2)-pass processes executed after the j number of executions of (C1)-pass processes using a graded recording rate in which the upstream-side gradient θu is the same as that in the middle printing process and the downstream-side gradient θd is smaller than that used in the downstream-end-portion printing process. When j is an integer of 2 or greater, the upstream-side gradient θu of the graded recording rate used in the j number of executions of (C1)-pass processes is preferably made gradually smaller in each succeeding pass process, while the downstream-side gradient θd of the graded recording rate used in the j number of executions of (C2)-pass processes is preferably made sequentially smaller in each succeeding pass process. In two-pass printing, for example, the downstream-side intermediate printing process preferably includes one (C1)-pass process and one (C2)-pass process. In four-pass printing as described in the first embodiment, the downstream-side intermediate printing process preferably includes two (C1)-pass processes and two (C2)-pass processes. In six-pass printing, the downstream-side intermediate printing process preferably includes three (C1)-pass processes and three (C2)-pass processes.

Further, when performing multi-pass printing in which the number p of passes is expressed as an even number (p=2×n, where n is an integer of 1 or greater), in generally the upstream-side intermediate printing process under the normal control preferably includes: n number of executions of (c1)-pass processes using a graded recording rate in which the upstream-side gradient θu is greater than that in the middle printing process and the downstream-side gradient θd is the same as that in the middle printing process; and n number of executions of (c2)-pass processes executed after the n number of executions of (c1)-pass process using a graded recording rate in which the upstream-side gradient θu is the same as that in the upstream-end-portion printing process and the downstream-side gradient θd is greater than that in the middle printing process. When n is an integer of 2 or greater, the upstream-side gradient θu in the graded recording rate used in the n number of executions of (c1)-pass processes preferably increases sequentially in each succeeding pass process, while the downstream-side gradient θd in the graded recording rate used in the n number of executions of (c2)-pass processes preferably increases sequentially in each succeeding pass process. In two-pass printing, for example, the upstream-side intermediate printing process preferably includes one (c1)-pass process and one (c2)-pass process. In four-pass printing, as described in the first embodiment, the upstream-side intermediate printing process preferably includes two (c1)-pass processes and two (c2)-pass processes. In six-pass printing, the upstream-side intermediate printing process preferably includes three (c1)-pass processes and three (c2)-pass processes.

(2) In the third embodiment described above, three-pass printing is executed as an example of the multi-pass printing of the present disclosure, but another type of multi-pass printing may be performed for printing a partial region of the sheet p pass processes, where p is an integer of 2 or greater. For example, the printer 600 may perform six-pass printing.

When performing multi-pass printing in which the number p of passes is expressed as a number (3×j) (where j is an integer of 1 or greater), in general the downstream-side intermediate printing process performed under the normal control preferably includes: j number of executions of (C1)-pass processes using a graded recording rate in which the upstream-side gradient θu is smaller than that in the downstream-end-portion printing process and the downstream-side gradient θd is equivalent to that in the downstream-end-portion printing process; j number of executions of (C2)-pass processes after the j number of executions of (C1)-pass processes using a graded recording rate in which the upstream-side gradient θu is the same as that used in the middle printing process and the downstream-side gradient θd is smaller than that used in the downstream-end-portion printing process; and j number of executions of (C3)-pass processes executed between the j number of executions of (C1)-pass processes and the j number of executions of (C2)-pass process using a graded recording rate in which the upstream-side gradient θu and the downstream-side gradient θd are the same as those in the j-th (C1)-pass process and the uniform nozzle length NLc is longer than that in the j-th (C1)-pass process. In the example of three-pass printing described in the third embodiment, the downstream-side intermediate printing process preferably includes one (C1)-pass process, one (C2)-pass process, and one (C3)-pass process. In six-pass printing, the downstream-side intermediate printing process preferably includes two (C1)-pass processes, two (C2)-pass processes, and two (C3)-pass processes.

Further, when performing multi-pass printing in which the number p of passes is expressed as a number (3×n) (where n is an integer of 1 or greater), the upstream-side intermediate printing process performed under the normal control preferably includes: n number of executions of (c1)-pass processes using a graded recording rate in which the upstream-side gradient θu is greater than that used in the middle printing process and the downstream-side gradient θd is the same as that used in the middle printing process; n number of executions of (c2)-pass processes executed after the n number of executions of (c1)-pass processes using a graded recording rate in which the upstream-side gradient θu is the same as that used in the upstream-end-portion printing process and the downstream-side gradient θd is greater than that used in the middle printing process; and n number of executions of (c3)-pass processes executed between the n number of executions of (c1)-pass processes and the n number of executions of (c2)-pass processes using a graded recording rate in which the upstream-side gradient θu and downstream-side gradient θd are the same as those used in the n-th (c1)-pass process and in which the uniform nozzle length NLc is shorter than that used in the n-th (c1)-pass process. In the example of three-pass printing described in the third embodiment, the upstream-side intermediate printing process preferably includes one (c1)-pass process, one (c2)-pass process, and one (c3)-pass process. In six-pass printing, the upstream-side intermediate printing process preferably includes two (c1)-pass processes, two (c2)-pass processes, and two (c3)-pass processes.

(3) In the first embodiment described above, the graded recording rates DR(11)-DR(17) in the middle printing process MP are equivalent to the graded recording rate in the basic dot pattern data DPD (see FIG. 7B). Hence, the basic dot pattern data DPD is used unchanged as the dot pattern data DPDa for use in the pass processes P(11)-P(17). When the graded recording rates DR(11)-DR(17) in the middle printing process MP differ from the graded recording rate of the basic dot pattern data DPD, in S110 of FIG. 6 the CPU 110 may generate the dot pattern data DPDa for use in the pass processes P(11)-P(17) of the middle printing process MP based on the basic dot pattern data DPD. For example, if the active nozzle length in the pass processes P(11)-P(17) of the middle printing process MP is shorter than the total nozzle length D, the CPU 110 may generate the dot pattern data DPDa for use in the pass processes P(11)-P(17) for the middle printing process MP by thinning out the basic dot pattern data DPD.

(4) In the first embodiment described above, the CPU 110 executes a printing process with a relatively shorter active nozzle length (specifically, the downstream-end-portion printing process DP and the upstream-end-portion printing processes UPa and UPb) when the sheet is being conveyed in the held state S1 and the held state S4 in which the conveying precision is relatively low, and executes a printing process with a relatively long active nozzle length (specifically, the middle printing process MP) when the sheet is being conveyed in the held state S2 in which the conveying precision is relatively high. As an alternative, the CPU 110 may execute a printing process using a relatively short active nozzle length when the sheet is being conveyed in another state in which conveying precision is relatively low and may execute a printing process using a relatively long active nozzle length when the sheet is being conveyed in another state in which conveying precision is relatively high. For example, conveying precision tends to be lower when the conveying speed is relatively high than when the speed is relatively low. Hence, the CPU 110 may execute a printing process with a relatively short active nozzle length when the sheet is conveyed at a relatively high speed and may execute a printing process with a relatively long active nozzle length when the sheet is conveyed at a relatively low speed. In this case as well, an intermediate printing process similar to the intermediate printing processes DIP, UIPa, and UIPb described in the embodiments is preferably performed between printing processes with a relatively short active nozzle length and printing processes with a relatively long active nozzle length.

(5) FIG. 26 shows an example of graded recording rates DR(16)-DR(26) in a variation of the embodiments. These graded recording rates DR(16)-DR(26) may be used in place of the graded recording rates DR(16)-DR(26) shown in FIG. 21 for the second embodiment used when printing a region of the sheet M from the middle section to the upstream edge under the normal control. In the graded recording rates DR(16)-DR(26) of FIG. 26, the upstream graded section Eu has a flat section Efu at a middle portion in which the graded recording rate DR does not decline linearly toward the upstream side. Similarly, the downstream graded section Ed in the graded recording rates DR(16)-DR(26) has a flat section Efd at which the graded recording rate DR does not decline linearly toward the downstream side. Hence, the graded recording rate DR need not be configured to decline linearly toward the upstream side and downstream side. As another example, the downstream graded section Ed of the graded recording rate DR may be configured as a curved line that expands upward, while the upstream graded section Eu may be configured as a curved line that expands downward. In this case, the downstream-side gradient θd of the downstream graded section Ed and the upstream-side gradient θu of the upstream graded section Eu are expressed as the average gradient of their respective curved lines (average angle).

Figure 27:
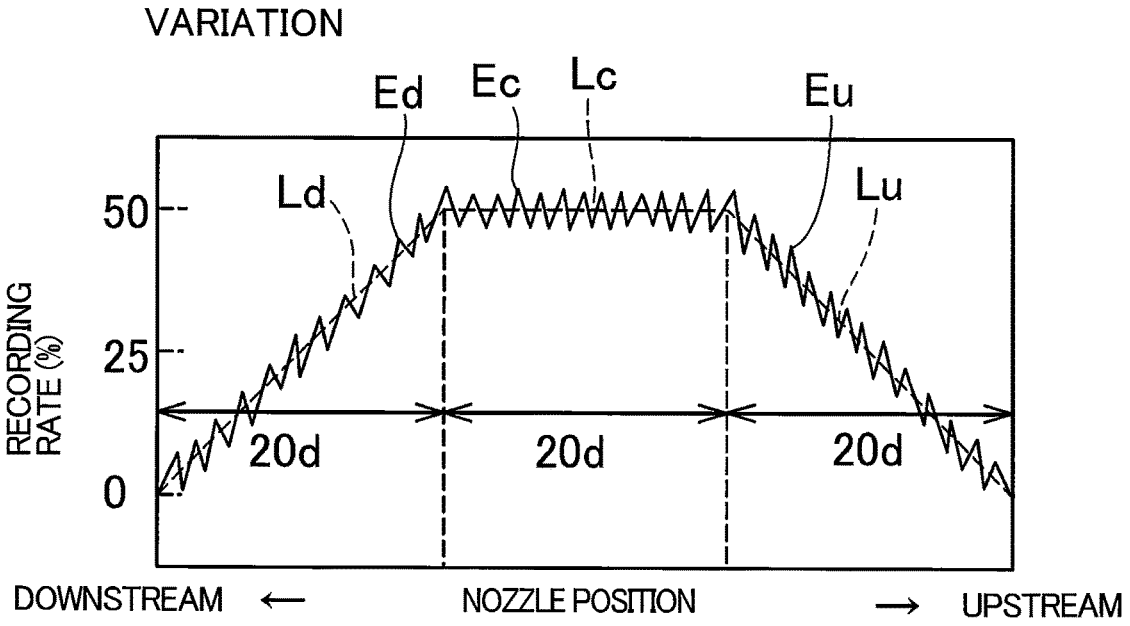
FIG. 27 shows graphs denoting the graded recording rates according to another variation of the third embodiment.

(6) FIG. 27 shows an example of a graded recording rate according to a variation of the third embodiment. In the upstream graded section Eu of this example, the recording rate may include localized regular or irregular increases and decreases, provided that overall the recording rate decreases toward the upstream side. In this case, the upstream-side gradient θu in the upstream graded section Eu may be expressed as the angle θu of an approximate straight line Lu found by approximating changes in the recording rate relative to the position in the conveying direction. Similarly, the recording rate in the downstream graded section Ed may include localized regular or irregular increases and decreases, provided that overall the recording rate decreases toward the downstream side. In this case, the downstream-side gradient θd of the downstream graded section Ed may be expressed as the angle θd of an approximate straight line Ld found by approximating changes in the recording rate relative to the position in the conveying direction. Similarly, the recording rate in the uniform section Ec may include localized regular or irregular increases and decreases, provided that overall the recording rate remains at the approximate maximum value irrespective of the position in the conveying direction. The recording rate in the uniform section Ec may be approximately fixed at an approximate maximum value using an approximate straight line Lc found by approximating changes in the recording rate relative to the position in the conveying direction along a straight line.

(7) In the first embodiment described above, the upstream-side holding unit of the conveying mechanism 210 includes the upstream rollers 217 for holding sheets at the position Y1, and the support members 212 and 213 and pressing members 216 for holding sheets at the position Y2. However, the upstream-side holding unit of the conveying mechanism 210 may include the upstream rollers 217 alone and not the support members 212 and 213 and pressing members 216 for holding the sheets.

(8) In the first to third embodiments and variations described above, the printer 600 may be configured to print always under the normal control, for example, rather than switching between the normal control and the special control.

(9) In the first to third embodiments and variations described above, part of the configuration implemented in hardware may be replaced with software and, conversely, all or part of the configuration implemented in software may be replaced with hardware.

While the description has been made in detail with reference to specific embodiments and variations thereof, it would be apparent to those skilled in the art that various changes and modifications may be made therein without departing from the spirit and scope of the present disclosure.

What is claimed is:

1. A printer comprising:

a print executing unit including:

a conveying mechanism configured to convey a sheet in a conveying direction;

a print head having a plurality of nozzles arranged in the conveying direction, each of the plurality of nozzles being configured to eject an ink droplet to form a dot on the sheet; and a main scanning mechanism configured to execute a main scan by moving the print head in a main scanning direction perpendicular to the conveying direction; and a controller configured to control the print executing unit to perform a multi-pass printing for printing a target image on the sheet with a plurality of pass processes, the plurality of pass processes forming a plurality of partial images respectively, two partial images formed with successive two pass processes overlapping partially, wherein K-number of active nozzles consecutively arranged are selected from the plurality of nozzles for each of the plurality of pass processes, dot recording rates of the K-number of active nozzles decreasing at an upstream gradient from a nozzle having a maximum dot recording rate among the dot recording rates of the K-number of active nozzles toward a most-upstream nozzle of the K-number of active nozzles in the conveying direction, the dot recording rates of the K-number of active nozzles decreasing at a downstream gradient from a nozzle having the maximum dot recording rate toward a most-downstream nozzle of the K-number of active nozzles in the conveying direction, wherein the controller is further configured to control the print executing unit to perform:

executing an (a)-print process in which the conveying mechanism conveys the sheet and a pass process is executed with Ka number of active nozzles;

executing, after the (a)-print process is executed, a (b)-print process in which the conveying mechanism conveys the sheet and a pass process is executed with Kb number of active nozzles, Kb being smaller than Ka; and executing, after the (a)-print process is executed and before the (b)-print process is executed, a (c)-print process in which the conveying mechanism conveys the sheet and at least two pass processes are executed with Kc number of active nozzles, Kc being greater than or equal to Kb and smaller than Ka, wherein the at least two pass processes includes:

a (c1)-pass process with Kc1 number of active nozzles as the Kc number of active nozzles, the downstream gradient of the dot recording rates of the Kc1 number of active nozzles used in the (c1)-pass process being the same as the upstream gradient of the dot recording rates of the Ka number of active nozzles used in the (a)-print process, the upstream gradient of the dot recording rates of the Kc1 number of active nozzles used in the (c1)-pass process being greater than the upstream gradient of the dot recording rates of the Ka number of active nozzles used in the (a)-print process; and a (c2)-pass process with Kc2 number of active nozzles, the (c2)-pass process being executed after the (c1)-pass process, the upstream gradient of the dot recording rates of the Kc2 number of active nozzles used in the (c2)-pass process being the same as the downstream gradient of the dot recording rates of the Kb number of active nozzles used in the (b)-print process, the downstream gradient of the dot recording rates of the Kc2 number of active nozzles used in the (c2)-pass process being greater than the downstream gradient of the dot recording rates of the Ka number of active nozzles used in the (a)-print process, Kc1 being greater than Kc2.

2. The printer according to claim 1, wherein the conveying mechanism includes:

an upstream holding unit configured to hold the sheet at a position upstream from the print head in the conveying direction; and a downstream holding unit configured to hold the sheet at a position downstream from the print head in the conveying direction, wherein the sheet is held by the upstream holding unit and the downstream holding unit in the (a)-print process, and wherein the sheet is not held by the upstream holding unit and is held by the downstream holding unit in the (b)-print process.

3. The printer according to claim 1, wherein the controller is configured to control the print executing unit to further perform:

executing, before the (a)-print process is executed, a (d)-print process in which the conveying mechanism conveys the sheet and a pass process is executed with Kd number of active nozzles, Kd being smaller than Ka; and executing, after the (d)-print process is executed before the (a)-print process is executed, a (e)-print process in which the conveying mechanism conveys the sheet and at least two pass processes are executed with Ke number of active nozzles, Ke being greater than or equal to Kd and smaller than Ka, wherein the (e)-print process includes:

a (e1)-pass process with Ke1 number of active nozzles as the Ke number of active nozzles, the upstream gradient of the dot recording rates of the Ke1 number of active nozzles used in the (e1)-pass process being smaller than the upstream gradient of the dot recording rates of the Kd number of active nozzles used in the (d)-print process, the downstream gradient of the dot recording rates of the Ke1 number of active nozzles used in the (e1)-pass process being the same as the upstream gradient of the dot recording rates of the Kd number of active nozzles used in the (d)-print process; and a (e2)-pass process with Ke2 number of active nozzles as the Ke number of active nozzles, the (e2)-pass process being executed after the (e1) pass process, the upstream gradient of the dot recording rates of the Ke2 number of active nozzles used in the (e2)-pass process being the same as the downstream gradient of the dot recording rates of the Ka number of active nozzles used in the (a)-print process, the downstream gradient of the dot recording rates of the Ke2 number of active nozzles used in the (e2)-pass process being smaller than the downstream gradient of the dot recording rates of the Kd number of active nozzles used in the (d)-print process, Ke1 being smaller than Ke2.

4. The printer according to claim 3, wherein the conveying mechanism includes:

an upstream holding unit configured to hold the sheet at a position upstream from the print head in the conveying direction; and a downstream holding unit configured to hold the sheet at a position downstream from the print head in the conveying direction, wherein the sheet is held by the upstream holding unit and the downstream holding unit in the (a)-print process, and wherein the sheet is held by the upstream holding unit and is not held by the downstream holding unit in the (d)-print process.

5. The printer according to claim 1, wherein the at least two pass processes of the (c)-print process include:

n number of executions of the (c1)-pass process, where n is an integer greater than or equal to 2; and n number of executions of the (c2)-pass process, wherein the upstream gradient of the dot recording rates of the Kc1 number of active nozzles used in the (c1)-pass process increases as n increases, wherein the downstream gradient of the dot recording rates of Kc2 number of active nozzles used in the (c2)-pass process increases as n increases, and wherein Kc1 and Kc2 decrease as n increases.

6. The printer according to claim 5, wherein the multi-pass printing includes (2×n) number of executions of pass processes as the plurality of pass processes.

7. The printer according to claim 1, wherein the multi-pass printing includes (3×n) number of executions of pass processes as the plurality of pass processes, where n is an integer greater than or equal to 1, wherein the dot recording rates of the K-number of active nozzles decreases at the upstream gradient from a most-upstream nozzle of an uniform section of the K-number of active nozzles toward the most-upstream nozzle of the K-number of active nozzles in the conveying direction, the uniform section including positions of nozzles each having the maximum dot recording rate among the dot recording rates of the K-number of active nozzles, the dot recording rates decreasing at the downstream gradient from a most-downstream nozzle of the uniform section toward the most-downstream nozzle of the K-number of active nozzles in the conveying direction;

wherein the (c)-print process includes:

n number of executions of the (c1)-pass process;

n number of executions of the (c2)-pass process after the (c1)-pass process is executed n times; and executing, after the (c1)-pass process is executed n times before an initial execution of then number of executions of the (c2)-pass process is performed, a (c3)-pass process with Kc3 number of active nozzles n times, the upstream gradient and the downstream gradient of the dot recording rates of the Kc3 number of active nozzles used in the (c3)-pass process being the same as the upstream gradient and the downstream gradient of the dot recording rates of the Kc1 number of active nozzles used when n-th (c1)-pass process is executed, respectively, a length of the uniform section of the dot recording rates of the Kc3 number of active nozzles used in the (c3)-pass process being smaller than a length of the uniform section of the dot recording rates of the Kc1 number of active nozzles used when n-th (c1)-pass process is executed.

8. The printer according to claim 1, wherein Kc decreases by an equal amount as a number of the pass process which has been executed in the (c)-print process increases.

9. The printer according to claim 1, wherein the print head has a nozzle surface in which the plurality of nozzles is formed, the nozzle surface including a first region in which a first nozzle of the plurality of nozzles is formed and a second region in which a second nozzle of the plurality of nozzles is formed, the second nozzle being positioned downstream from the first nozzle in the conveying direction, wherein the print executing unit further includes:

a holding unit opposing the first region and configured to hold the sheet; and an un-holding unit opposing the second region and separated farther from the nozzle-surface than the holding unit from the nozzle-surface, wherein the Ka number of active nozzles used in the (a)-print process include the first nozzle and the second nozzle, wherein the Kb number of active nozzles used in the (b)-print process exclude the first nozzle and include the second nozzle, and wherein Kc decreases while the most-upstream nozzle is sequentially moved downstream as a number of the pass process that has been executed in the (c)-print process increases.

10. The printer according to claim 1, wherein the print head has a nozzle surface in which the plurality of nozzles is formed, the nozzle surface including a first region in which a first nozzle of the plurality of nozzles is formed and a second region in which a second nozzle of the plurality of nozzles is formed, the second nozzle being positioned upstream from the first nozzle in the conveying direction, wherein the print executing unit further includes:

a holding unit opposing the first region and configured to hold the sheet; and an un-holding unit opposing the second region and separated farther from the nozzle-surface than the holding unit from the nozzle-surface, wherein the Ka number of active nozzles used in the (a)-print process include the first nozzle and the second nozzle, wherein the Kb number of active nozzles used in the (b)-print process exclude the first nozzle and include the second nozzle, and wherein Kc decreases while the most-downstream nozzle is sequentially moved upstream as a number of the pass process which has been executed in the (c)-print process increases.

11. The printer according to claim 1, wherein the controller is further configured to:

acquire first dot formation data based on basic dot pattern data, the basic dot pattern data specifying a dot position and a un-dot position in the main scanning direction for each of the plurality of nozzles according to the dot recording rate corresponding to the each of the plurality of nozzles, the dot position being a position in the main scanning direction at which a dot can be formed, the un-dot position being a position in the main scanning direction at which no dot should be formed, the first dot formation data specifying the dot position and the un-dot position in the main scanning direction for each of the Ka number of active nozzles used in the (a)-print process according to the dot recording rate of the each of the Ka number of active nozzles used in the (a)-print process; and acquire second dot formation data based on the basic dot pattern data, the second dot formation data specifying the dot position and the un-dot position in the main scanning direction for each of the Kc number of active nozzles used in the (c)-print process according to the dot recording rate of the each of the Kc number of active nozzles used in the (c)-print process, wherein the controller controls the print executing unit to execute the (a)-print process using the first dot formation data, and wherein the controller controls the print executing unit to execute the (c)-print process using the second dot formation data.

12. The printer according to claim 11, wherein the controller is configured to acquire the first dot formation data by generating the first dot formation data on a basis of the basic dot formation data.

* * * * *